US005084911A

United States Patent [19]

Sezan et al.

[11] Patent Number: 5,084,911

[45] Date of Patent: Jan. 28, 1992

[54] X-RAY PHOTOTIMER

[75] Inventors: Muhammed I. Sezan, Rochester; Ralph Schaetzing, Pittsford; William E. Moore, Macedon; Lee F. Frank, Rochester, all of N.Y.

[73] Assignee: Eastman Kodak Company, Rochester, N.Y.

[21] Appl. No.: 295,616

[22] Filed: Jan. 10, 1989

[51] Int. Cl.[5] ..... H05G 1/38

[52] U.S. Cl. ..... 378/96; 378/99; 378/207; 358/111

[58] Field of Search ..... 358/111; 378/99, 98, 378/96, 91, 97, 110, 112, 22, 207, 205

[56] References Cited

U.S. PATENT DOCUMENTS

| | | | |
|---|---|---|---|
| 3,911,273 | 1/1975 | Franke | 378/108 |
| 3,971,945 | 7/1976 | Franke | 378/96 |
| 4,178,508 | 12/1979 | Hottaeta | 378/97 |
| 4,247,780 | 1/1980 | Webber et al. | 378/205 |
| 4,260,894 | 4/1981 | Neumann | 378/16 |
| 4,341,956 | 7/1982 | Bax | 250/214 C |
| 4,366,382 | 12/1982 | Kotowski | 378/99 |
| 4,679,217 | 7/1987 | Fairchild | 378/97 |
| 4,697,280 | 11/1987 | Zarnstorff et al. | 378/97 |
| 4,748,649 | 5/1988 | Griesmer et al. | 378/108 |
| 4,991,193 | 2/1991 | Cecil et al. | 378/96 |

FOREIGN PATENT DOCUMENTS

| | | |
|---|---|---|
| 0011848 | 6/1980 | European Pat. Off. . |
| 0217456 | 4/1987 | European Pat. Off. . |
| 0223545 | 5/1987 | European Pat. Off. . |

*Primary Examiner*—Janice A. Howell
*Assistant Examiner*—Don Wong
*Attorney, Agent, or Firm*—William F. Noval

[57] ABSTRACT

A phototimer for controlling x-ray exposure includes an array of x-ray sensors, and digital processing electronics for calculating x-ray exposure by selecting one or more signals from the x-ray sensors, and calculating the x-ray exposure from the selected signals. After calculating the x-ray exposure, the calculated exposure is employed to control the x-ray exposure either by displaying the calculated exposure to an operator who compares the calculated exposure with a desired exposure and repeats the exposure if necessary, or by automatically terminating the exposure by sending a control signal to the x-ray source. The improvement in the state of x-ray phototimer technology resides in the automatic selection of a subset of signals from a plurality of photosensors, thereby improving the reliability of the measurement. In prior art devices, the signals from a plurality of sensors were either selected manually by a switch, or all employed in a predetermined algorithm.

19 Claims, 18 Drawing Sheets

FIG. 1
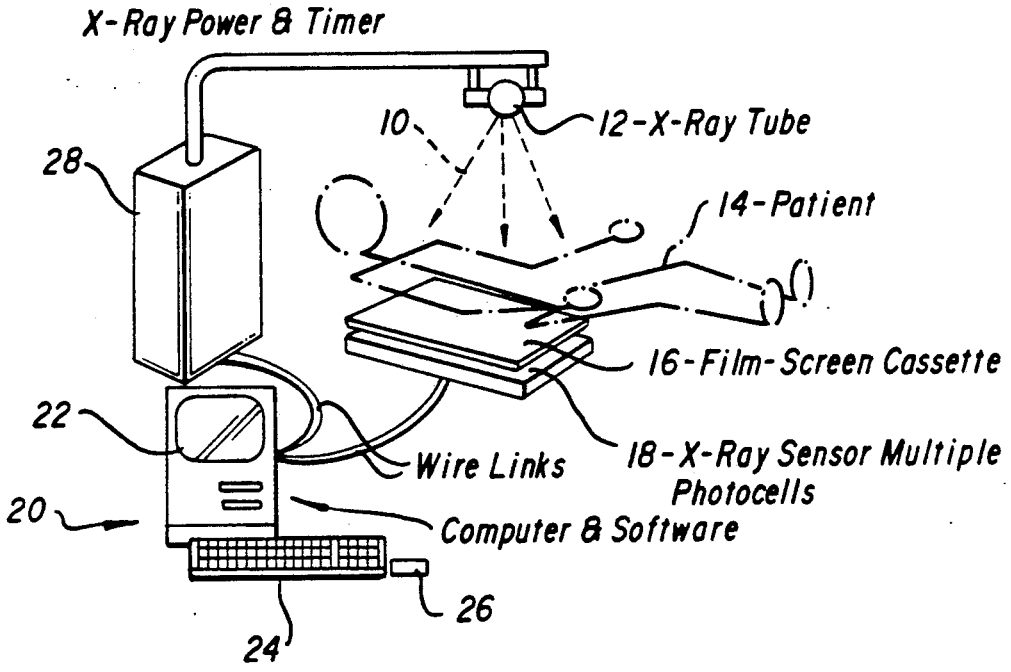
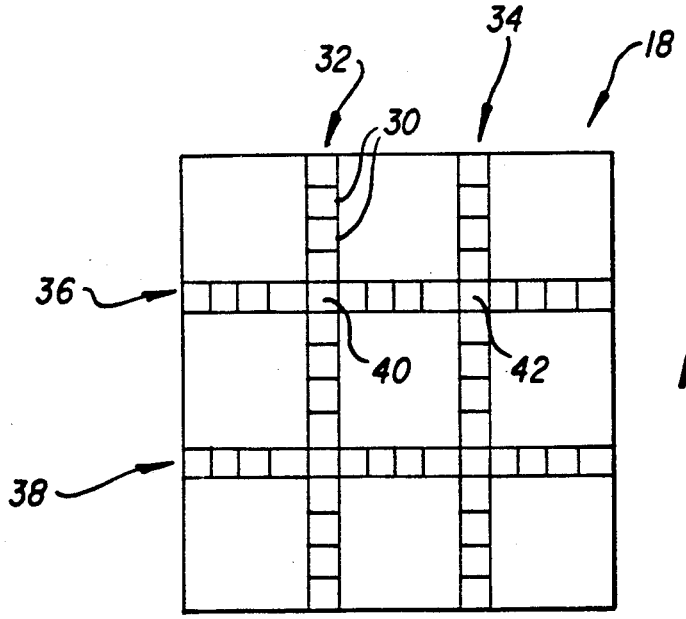
FIG. 2

CALIBRATE SENSORS

CALIBRATE ALGORITHM

READ SENSORS

CALCULATE EXPOSURE

SORTED DATA

DATA SEPARATED INTO 'VALID' AND 'INVALID' CATEGORIES

X-RAY PHOTOTIMER

A portion of the disclosure of this patent document contains material to which a claim of copyright protection is made. The copyright owner has no objection to the copying of the patent document or the patent disclosure but reserves all other rights.

BACKGROUND OF THE INVENTION

1. Field of the Invention

The invention relates to radiation imaging and more particularly to phototimers for detecting and automatically controlling patient exposure to radiation.

2. Background Art

Phototimers of the type having one or more photosensors positioned behind a subject in the path of an X-ray beam to control the X-ray exposure of the subject are well known. U.S. Pat. No. 4,748,649 issued to Griesmer et al. on May 31, 1988 shows a phototimer having three photosensors in a triangular arrangement. Depending upon the diagnostic procedure being performed, the operator selects any one or any combination of the outputs from the three sensors, which are then combined and compared to a computer generated reference level to control the X-ray exposure. Proper exposure depends upon correct placement of the phototimer sensors with respect to the patient. Typically, for a chest radiograph, the output from a pair of the photosensors is chosen. The phototimer is positioned with respect to the patient such that the two sensors of the pair are positioned on either side of the midline in the upper lung fields. It is often the case particularly in bedside radiography, where a film and phototimer are slipped under the patient to perform the exposure, that the sensors are not properly located with respect to the patient, resulting in an incorrect exposure. Also, where a patient is missing one lung or one lung is filled with fluid, an incorrect exposure is achieved. The incorrect exposure is discovered only upon developing the film. In 5 to 10 percent of the bedside radiographs, the exposure is so poor as to necessitate repeating the procedure.

It is the object of the present invention to provide a phototimer for detecting and controlling X-ray exposures that avoids the problems noted above.

SUMMARY OF THE INVENTION

The problem is solved according to the present invention by providing a phototimer having an array of X-ray sensors for producing a plurality of exposure signals. During an X-ray exposure, the signals are digitized and processed in a digital signal processor such as a microcomputer. The computer automatically selects one or more of the digital exposure signals and calculates a patient X-ray exposure from the selected signals. In one mode of practicing the invention, the calculated exposure is displayed so that an operator can immediately repeat the exposure if it was incorrect. In a second mode, the calculated exposure is compared to a desired exposure, and a control signal is produced to turn off the X-ray source when the calculated exposure equals the desired exposure.

In one embodiment of the invention for bedside chest radiography, the array of X-ray sensors comprises four linear arrays of photosensors arranged in a rectangular pattern. The linear arrays extend past the corners of a rectangle defined by the central portions of the four linear arrays. The digital signal processing means performs an exposure determination algorithm by forming a linear waveform from the signals from each linear array, and detecting overlapping peaks at the corners of the rectangle in the waveforms. The selection of signals for calculating exposure is then based on the occurrence of peak crossings at the corners of the rectangle.

In a second embodiment, not limited to use for chest radiography, the array of sensors can comprise any one of a variety of patterns. The digital signal processing means performs an exposure determining algorithm that sorts the exposure signals in a rank order, and detects the highest rank order that includes the object. The exposure at the median cell in the rank order in the object data is employed to estimate the object exposure.

According to another aspect of the present invention, a method of calibrating the phototimer is provided. The sensors in the array are calibrated by measuring the dark current of each sensor with X-rays off. X-rays are turned on for a predetermined time and the exposures of all the sensors are measured. The gain of each sensor is calculated as the exposure minus the average dark current of the sensor. The phototimer is then operated with a phantom in the beam and an empirically determined correct exposure is performed. The response of each sensor to the correct exposure is adjusted for the previously determined gain of each sensor, and an exposure value is determined by applying an exposure determining algorithm to the data to generate an exposure value. The exposure value determined by the algorithm is multiplied by the correct exposure time to generate a speed number.

Later, when the phototimer is employed to measure the actual exposure of a patient, the patient exposure value produced by the algorithm is divided by the speed number to yield a correct patient exposure time.

BRIEF DESCRIPTION OF THE DRAWINGS

FIG. 1 is a schematic diagram illustrating the use of the present invention in bedside radiography;

FIG. 2 is a schematic diagram illustrating the arrangement of X-ray sensors in a preferred arrangement of the sensor array;

MODES OF CARRYING OUT THE INVENTION

Figure 3:
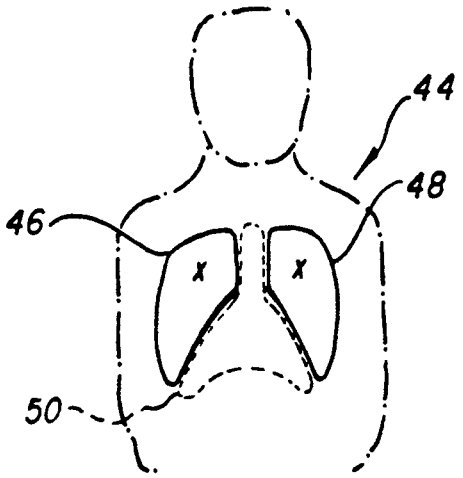
FIG. 3 is a schematic diagram of a human torso showing the lung field and mediastinum.

Referring to FIG. 1, X-rays 10 from an X-ray source 12 are directed through a human subject 14 onto an X-ray sensor such as a conventional X-ray cassette 16 containing, for example a film and intensifying screen (not shown). Alternatively, the X-ray sensor could be a stimulable phosphor screen or an X-ray sensitive photoconductor. A phototimer sensor array 18 according to the present invention is located under the cassette 16. The phototimer is electrically connected to a computer 20 which is programmed to perform the digital signal processing on the signals produced by sensor array 18. The computer 20 (for example a programmed personal computer) or special purpose exposure control computer may include a CRT display screen 22 and a keyboard and mouse inputs 24 and 26. The computer 20 may be connected to an X-ray power supply 28 to control the duration of the X-ray exposure. Alternatively, where the X-ray power supply 28 is not accessible to external control, the computer 20 displays the calculated exposure so an operator can perform another exposure if necessary.

FIG. 2 shows the presently preferred arrangement of sensors in the phototimer sensor array 18. The sensors 30 are arranged in groups of four linear arrays 32, 34, 36, and 38 which in turn are arranged in a rectangular configuration with the sides of the rectangle extending past the corners as shown in FIG. 2. Each of the linear arrays 32, 34, 36, and 38 contains a plurality of sensors, for example, 16 sensors in each array. The dimensions of the array are such that the sensors located at adjacent corner positions, for example where the vertical linear arrays cross a horizontal linear array (sensors 40 and 42 in FIG. 2), would lie in the right and left lung fields at the locations marked with an X in FIG. 3.

FIG. 3 is a schematic diagram showing a human torso generally designated 44, having a right lung 46 and a left lung 48. The mediastinum region 50 which includes the esophagus, great vessels and spine is outlined in FIG. 3 by dotted lines.

The sensors 30 in the phototimer sensor array 18 are PIN diode X-ray sensors. Alternatively, other X-ray sensors such as a scintillation screen and photodiodes, or cadmium sulfide or cadmium teluride X-ray sensors could be used.

Figure 4:
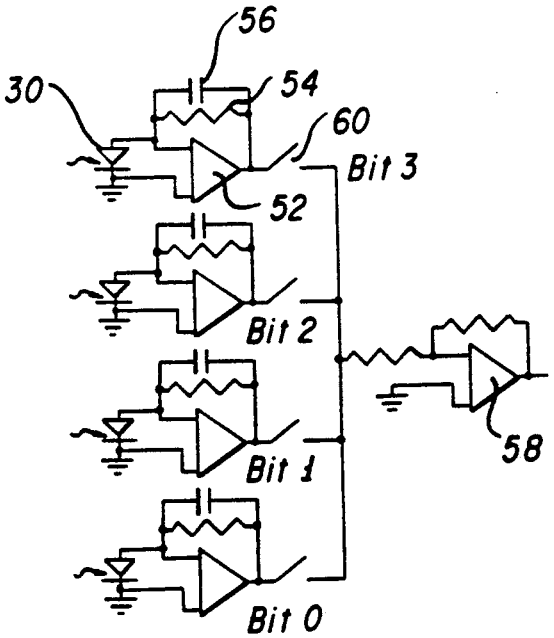
FIG. 4 is a schematic diagram of the readout electronics for the sensor array.

Each of the X-ray sensors 30 in the array is provided with a preamplifier 52 as shown in FIG. 4 that is configured with a resistor 54 and a capacitor 56 in the feedback path to act both as a current to voltage converter and short term integrator (i.e. a low pass filter).

The outputs of the preamplifiers 52 are connectible in groups of 4 to one of 16 scaling amplifiers 58 via computer controlled multiplexing switches 60. The output of the scaling amplifier 58 is supplied to an analog to digital converter in the computer 20.

The output circuitry for the sensors can be operated in one of several modes, as described below, by selecting the time constant of the preamplifiers 52 (determined by the product of feedback resistance and capacitance). If the time constant is substantially less than the measurement period (e.g. 3 to 5 milliseconds), the integration time smooths out any high frequency noise in the system, and inhibits oscillations due to the large number of closely coupled high gain amplifiers. If the time constant is selected to be substantially greater than the measurement time, the preamplifiers 52 act as integrators, and a test exposure of relatively short duration (e.g. 3 to 5 milliseconds) can be employed prior to interrogating the system for the exposure measurement.

In the long time constant mode of operation, the time constant provides an alternative to an additional analog switch for resetting the zero point of the integrators. The current provided by the PIN diode X-ray sensors 30 is sufficiently small so that leakage and offset effects in such an analogue switch would be a serious problem, which is avoided by the long time constant mode of operation. Alternatively, the integration mode of operation can be accomplished with an additional stage of gain after the preamplifiers 52, where sufficient current would be available to use analogue switches to reset the integrators. An improved circuit for implementing this additional stage of gain is shown in FIG. 5.

Figure 5:
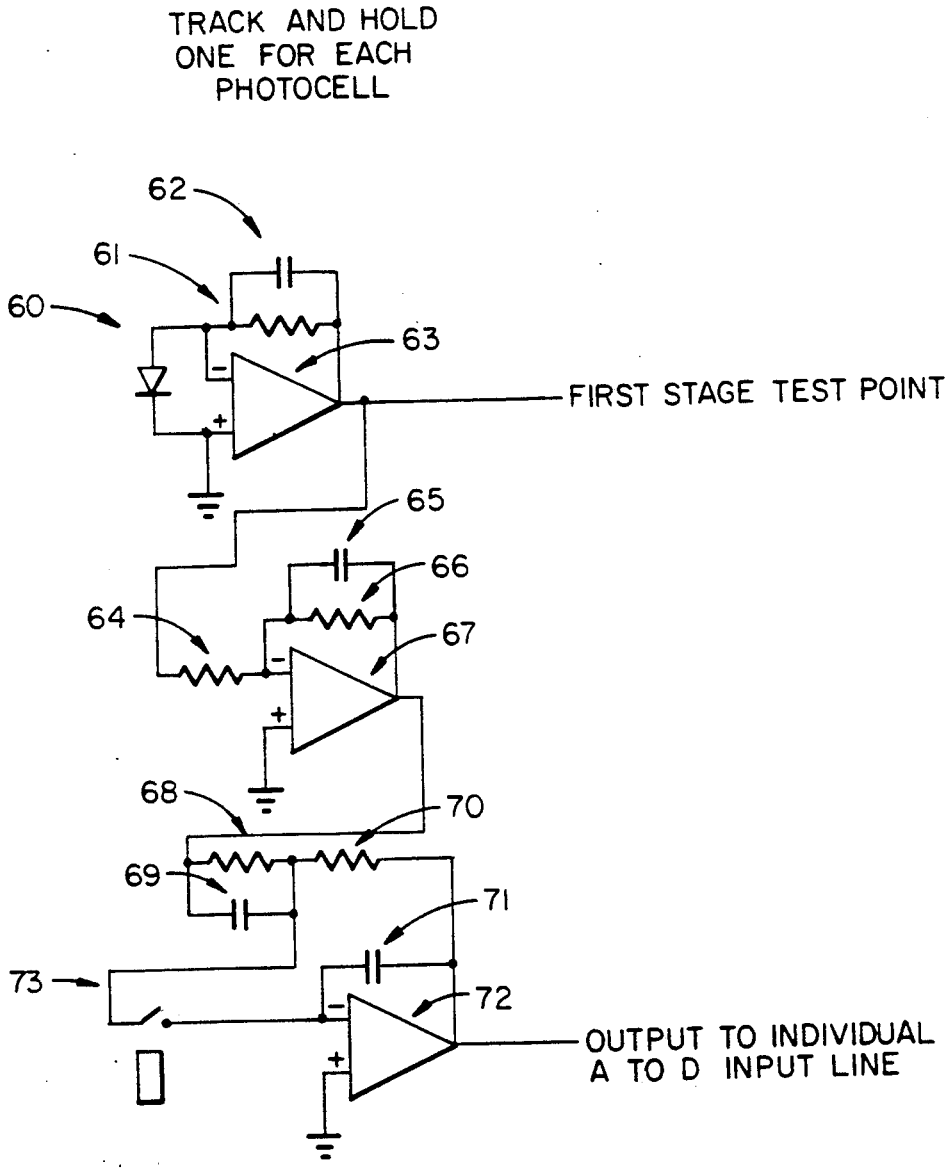
FIG. 5 is a schematic diagram of an improved circuit for reading out the signals from the sensor array.

In FIG. 5 the analog portion of the data acquisition circuit is shown for a single photocell of the array. All photocells have identical track and hold circuits. In this circuit the sensor is again shown as a PIN photodiode 60, although other sensors could be used. The output from the photocell is amplified and converted from a current to voltage signal by the preamplifier 63, the gain of which is controlled by feedback resistor 61, and the appropriate capacitor 62 is added to provide a degree of smoothing or frequency limitation to the amplifier. This capacitor exchanges some potentially more rapid response for better signal to noise ratio. An additional stage of amplification is shown with parts 64–67. The voltage gain is determined by the ratio of the input resistor 64 to the feedback resistor 66, and the smoothing function is again provided by a feedback capacitor 65. Because of the amplification required by the preamplifier 63, the offset current and offset voltage specifications of amplifier 67 are not as critical. The signal to noise ratio of the system is largely determined by components 60–67.

Components 68–72 provide the track and hold function. As shown in FIG. 5, solid state analog switch or relay 73 is in the open state. Thus the only feedback element around the output amplifier 72 is a capacitor 71. Ideally this would be a circuit with zero frequency response, which is the same as saying the output voltage is constant at the voltage of the capacitor. The active gain of the amplifier 72 acts to prevent any current from flowing into capacitor 71. In our real circuit there is a slight drift of about 0.3 volt/second in the output voltage. This is the amplifier in the hold condition. The voltage across the capacitor is equal to the voltage output of the system at the moment switch 73 is opened.

If switch 73 is closed, the low frequency gain of the system is equal to the ratio of the resistance of the feedback resistor 70 to the input resistor 68. If the capacitors have the reciprocal ratio to the resistors of equivalently the time constant of input elements (68, 69) equal the time constant of the feedback elements (70, 71) nominally there is very little band width limit of the circuit. Of course there is a limit due to maximum current limitation from the amplifier, but it is on amplitude.

Thus the output of amplifier 72 follows the voltage supplied to it, until the analog switch 73 is opened. After that the voltage is essentially fixed to that last value.

In operation the sensor array is operated in the tracking mode until the computer decides that it is an optimum time to obtain measurements. Then all the analog switches are opened, freezing the voltage distribution in the array outputs. These may now be interrogated in a relatively long time, to provide the needed data.

Figure 6:
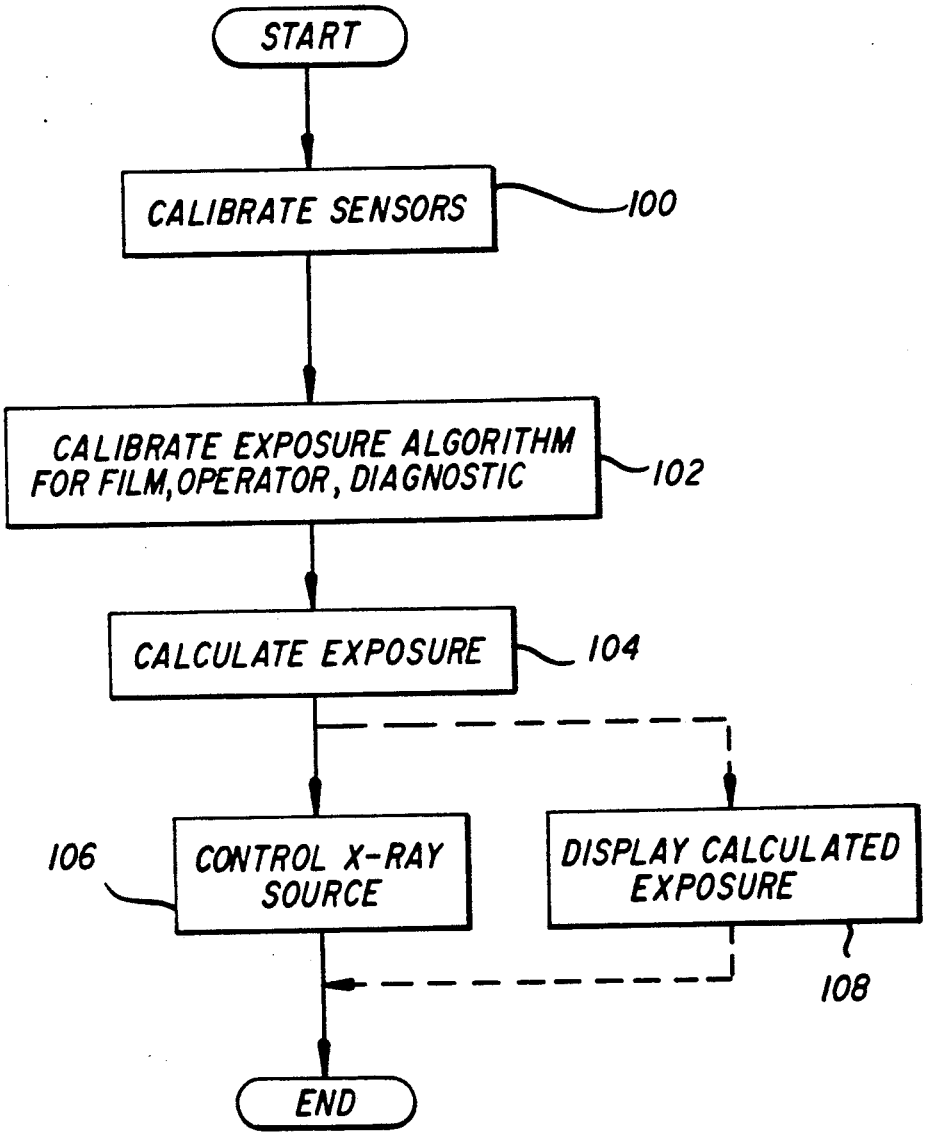
FIG. 6 is a flow chart illustrating the steps in operation of the phototimer according to the present invention.

The operation of the phototimer will now be described with reference to FIG. 6. Although the gain of the amplifiers 52 is relatively stable, some of the photocurrents being measured are comparable to the variations in offset current of the amplifiers. In addition, a measurement precision greater than the reproducibility of the gain in the amplifier is required. To achieve the degree of precision required, a sensor calibration procedure 100 (described below) is implemented by the computer 20 prior to each exposure. The sensor calibration procedure establishes the gain of each amplifier and the dark current of each sensor.

In addition to calibrating the sensor hardware, the exposure control algorithm is calibrated at least once for each film type, diagnostic type, and radiologists preference. The calibration procedure (102) which is described below in more detail, determines a speed number that is employed by the exposure calculation algorithm to calculate exposure. After the required calibrations (sensor and algorithm) have been performed, the phototimer is employed to calculate exposure (104), by implementing an algorithm that selects one or more of the signals from the sensors, and calculates an exposure from the selected signal(s). Although two specific algorithms will be described below, various other algorithms could be employed within the spirit and scope of the invention.

After an exposure time has been calculated (104), the calculated exposure may be employed to control the X-ray source (106), and/or the calculated exposure may be displayed (108) so that an operator can compare the calculated exposure with an ideal exposure, and repeat the exposure if the calculated exposure differs by more than a predetermined amount from the ideal.

Figure 7A:
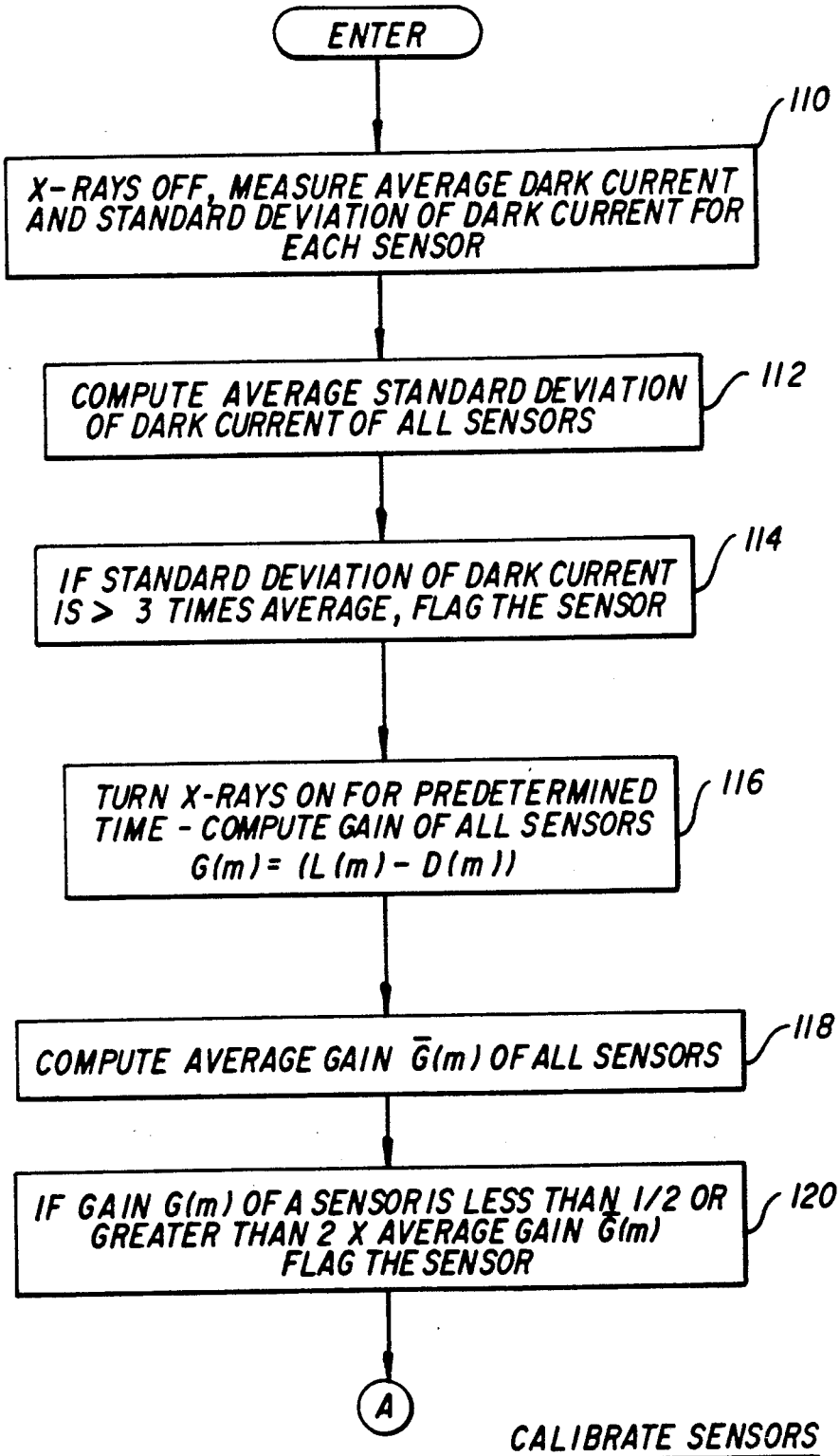
FIG. 7*a* illustrates the first part of the steps in calibration of the sensors.
Figure 7B:
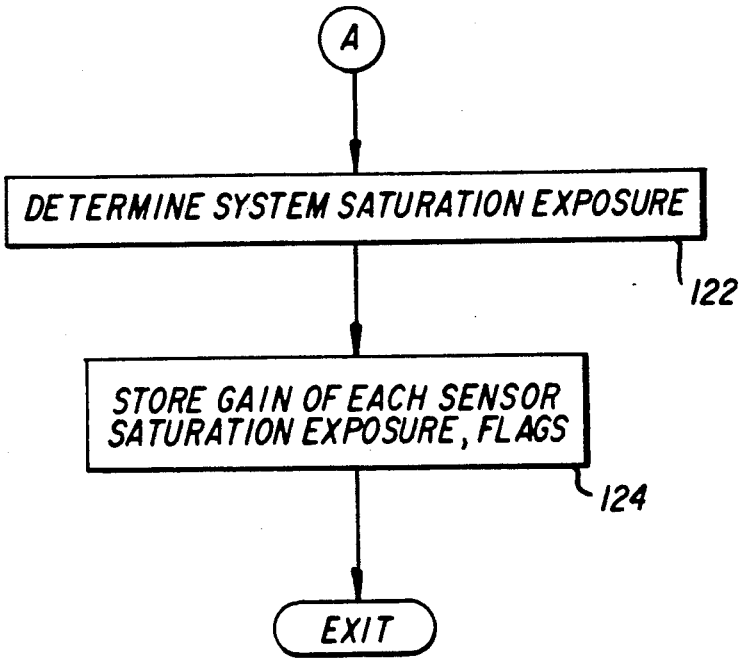
FIG. 7*b* illustrates the second part of the steps in calibration of the sensors.

The sensor calibration procedure (100) will now be described with reference to FIGS. 7*a* and 7*b*. Sensor calibration is performed periodically during routine maintenance of the phototimer. In the sensor calibration procedure, the phototimer is placed in the X-ray beam with no object. With the X-rays turned off, the dark current D(m) and standard deviation of dark current from each sensor is measured (110), by taking several readings of the dark current and computing the average and standard deviation of the several readings. The average standard deviation of dark current from all the sensors is then computed (112). If the standard deviation of the dark current for a given sensor is greater by some amount (e.g. 3 times) than the average standard deviation of all sensors, a flag is set (114) indicating a noisy sensor. This information is used as described below in the exposure calculation algorithm.

The X-ray source is turned on for a predetermined time at a preselected intensity, the outputs of all the sensors L(m) are sampled, and the gain G(m) of each sensor is calculated (116), as:

$$G(m)=(L(m)-\overline{D}(m)) \quad (1)$$

where L(m) is the signal value from the $m^{th}$ sensor and $\overline{D}(m)$ is the average dark current of the $m^{th}$ sensor.

Next, the average gain of all sensors $\overline{G}(m)$ is calculated (118), and if the gain of an individual sensor is less then a predetermined factor (e.g. one-half) or greater than a predetermined factor (e.g. 2) times the average gain, the sensor is flagged (120).

The system saturation exposure is then calculated (122) by computing the equivalent saturation exposure for each sensor and finding the minimum saturation exposure for all sensors. The equivalent saturation exposure for each sensor is determined by linearly extrapolating the sensor response to the maximum capability of the electronics.

Figure 8:
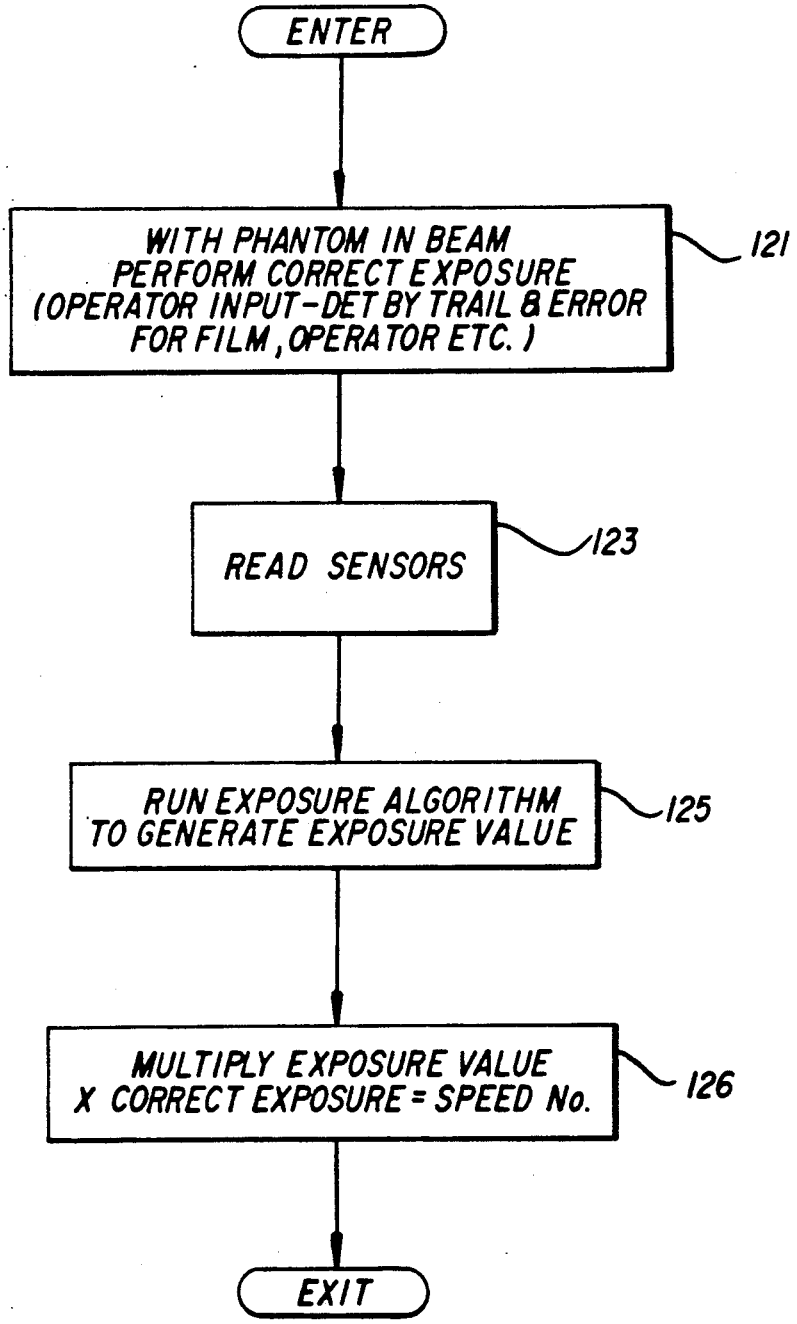
FIG. 8 is a flow chart illustrating the calibration of the exposure calculation algorithm.

The calibration of the exposure algorithm will now be described with reference to FIG. 8. A phantom is placed in the X-ray beam and an optimum exposure is determined empirically by trial and error for a given film, diagnostic type, processing conditions, and radiologist preference. When the optimum exposure is determined, an exposure is made (121) with the phototimer operating. The output of the phototimer sensors are read (123) and the exposure control algorithm is applied to the sensor outputs to generate an exposure value (125). The exposure value produced by the phototimer is multiplied by the empirically derived optimum exposure (126) to derive a speed number for the algorithm. The speed number is employed in calculating exposure as described below.

Figure 9:
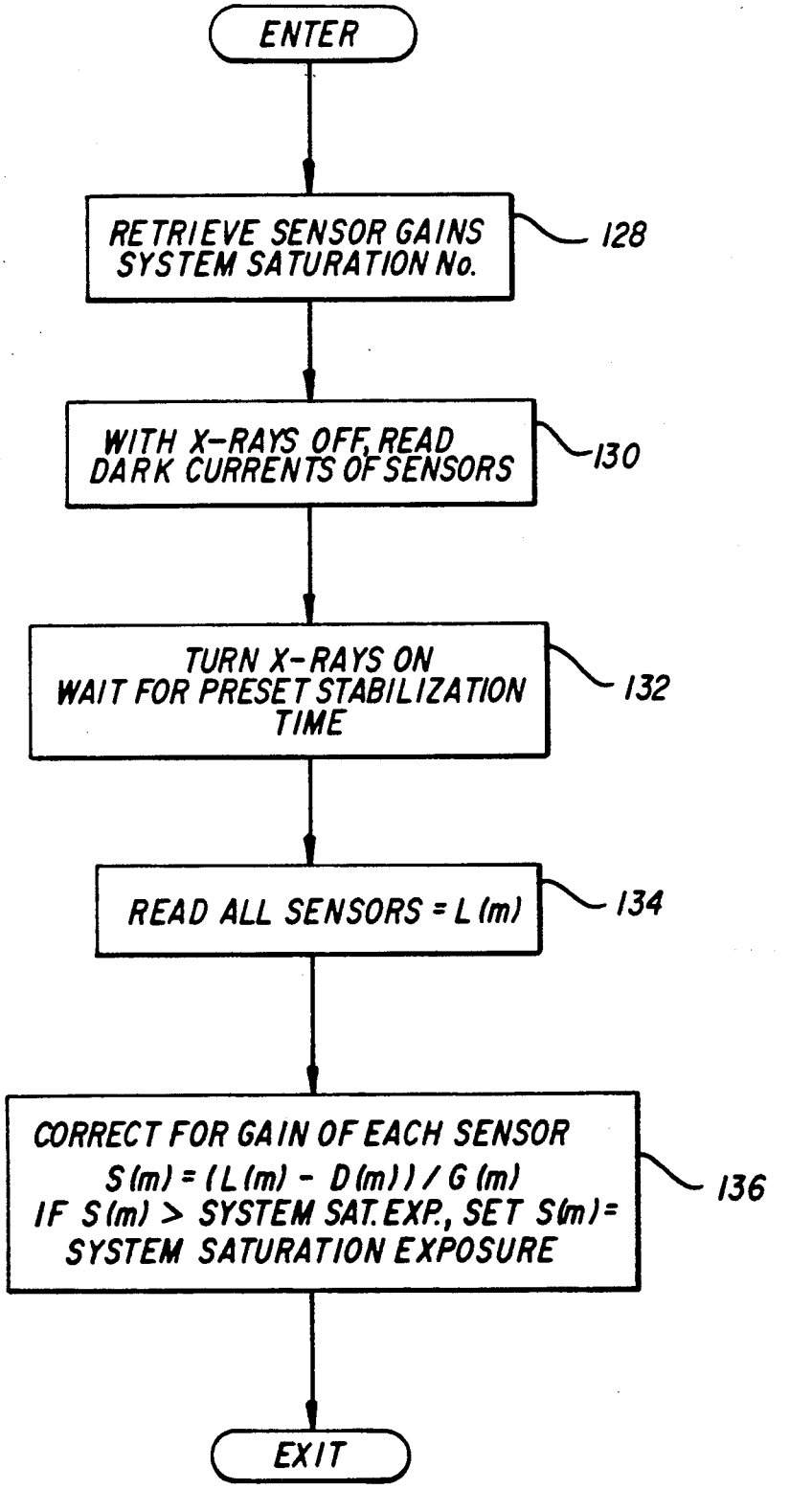
FIG. 9 is a flow chart illustrating the steps employed in reading the sensors.

Next, the process of reading the sensor outputs (123) will be described with reference to FIG. 9. First, the sensor gains and system saturation number are retrieved (128) from the previous sensor calibration, where they were stored. Next, with the X-ray source turned off, the dark currents D(m) of the sensor are sampled (130). Then, the X-rays are turned on and a predetermined time (e.g. 3 to 5 milliseconds) is allowed to elapse while the sensors stabilize (132). After the predetermined elapsed time, the sensors are sampled (134) for photocurrent levels L(m). Finally, the level from each sensor is corrected for dark current and gain according to the equation:

$$S(m)=(L(m)-D(m))/G(m) \quad (2)$$

where S(m) is the corrected sensor signal level. If S(m) is greater than the system saturation exposure determined during the sensor calibration step, S(m) is set equal to the system saturation exposure.

As noted above, the feedback capacitance and resistance of the sensor amplifier can be selected to operate in either of two modes; an integration mode, or a continuous sensing mode. In the integration mode (sensors have a long time constant, slow decay), the sensor array is powered up several seconds before the exposure to allow the system to stabilize from a cold start. Sufficient time (on the order of 6 integration times) is allowed to elapse and the unexposed voltage levels are measured (130 in FIG. 9), then the X-ray source is turned on to effect the exposure. In the integration mode of operation, the X-rays are left on for a predetermined short time (e.g. 3 to 5 milliseconds, much less than a normal exposure time of 100 milliseconds) and the sensor is interrogated for voltage levels at each sensor.

In the continuous sensing mode (nonintegrating), the X-rays can then either be continued while exposure computation proceeds, in expectation that the optimum exposure time will be established prior to a predetermined nominal exposure time, or the X-rays can be turned off after the predetermined nominal exposure and computation of the estimated actual exposure is continued to completion. In either event, the signals from the sensor are corrected numerically by the calibration data for both zero offset and gain variations from sensor-to-sensor, and a subset of the signals are selected for computing the exposure.

If the X-rays are turned off prior to completion of the exposure calculation, the calculated exposure can be displayed (108 in FIG. 6) and the operator can compare the estimated actual exposure measured by the sensor with the desired exposure. The operator then repeats the exposure if the calculated and desired exposure differ by more than a predetermined amount. Until the nominal exposure time is reached, the calculated exposure is periodically compared to a desired exposure until the desired exposure is equalled. At this point, exposure can be automatically terminated by sending a control signal to the X-ray source.

Adequate sensitivity is available to operate the sensor either behind the film screen cassette 16 during exposure, or prior to exposure with a very short test exposure. The latter mode of operation is appropriate for use with X-ray machines without adequate electrical access to the exposure timing mechanism.

Figure 10:
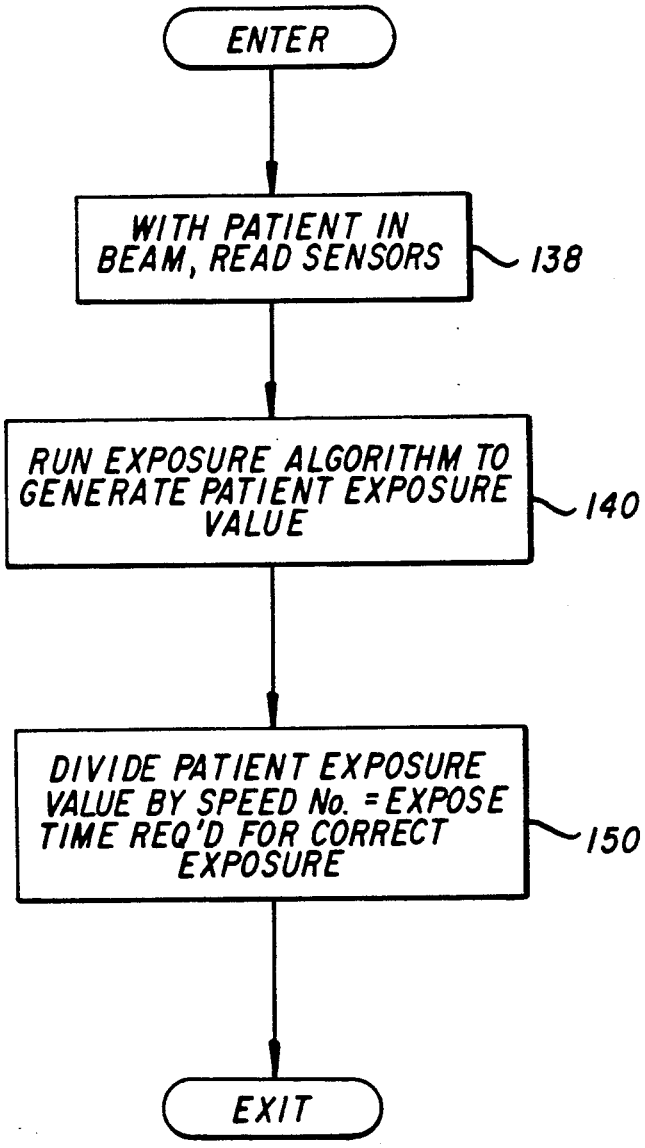
FIG. 10 is a flow chart illustrating calculation of the estimated X-ray exposure.

The steps of calculating the exposure will now be further described with reference to FIG. 10. With a patient in the beam, the "read sensors" step is performed (138). The exposure calculation algorithm is performed (140) on the sensor signals S(m) produced in the read sensors step 138 to generate a patient exposure value. The patient exposure value is divided by the speed number (150) generated in the exposure algorithm calibration step to produce an exposure time required for correct exposure.

The computer program (Calb. C) written in the C language for operation on a Compact TM personal computer to calibrate a sensor array according to the present invention is provided in Appendix A. A computer program (Grab. C) for reading the sensor is provided in Appendix B. A computer program (Xhruna. C) for calibrating an exposure control algorithm to produce the speed number is provided in Appendix C. The program in Appendix C calibrates the second exposure calculation algorithm disclosed below, however it is a simple substitution of code as can be seen from FIG. 8 block 125 to modify it to calibrate the first algorithm described below.

Figure 11:
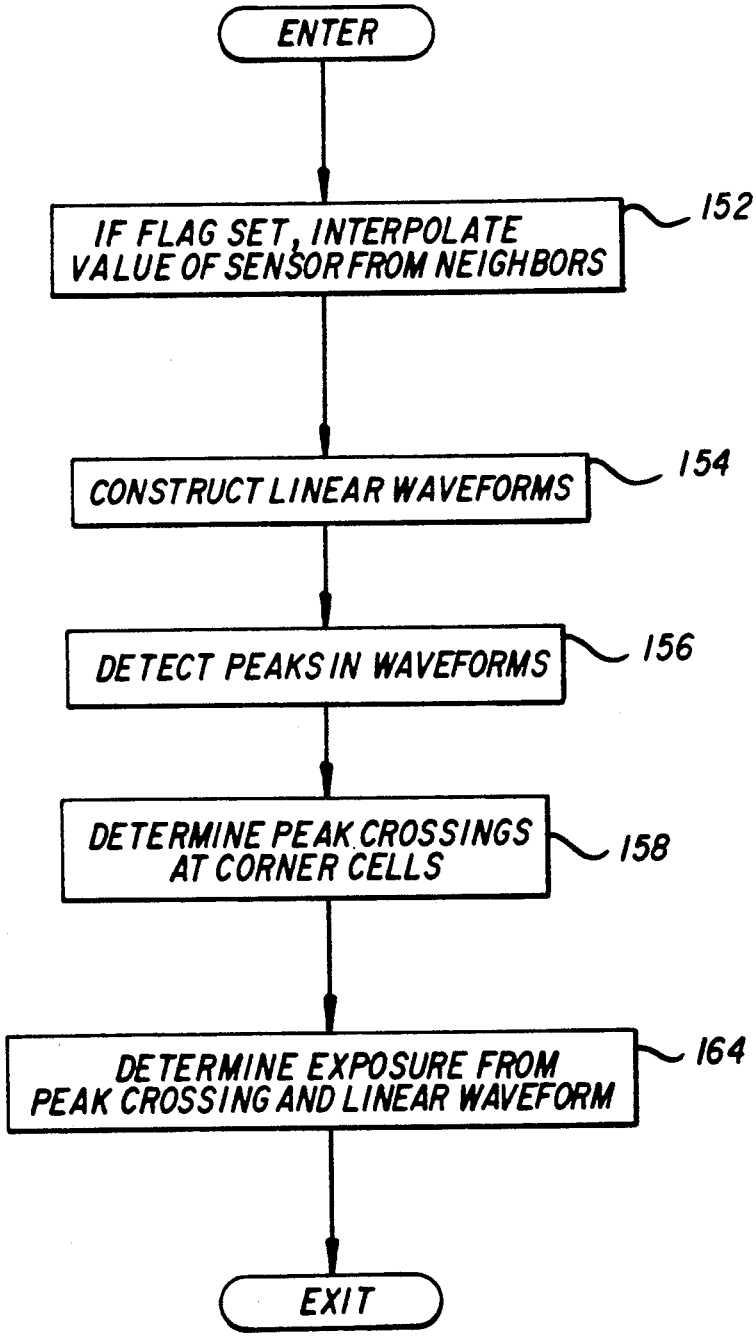
FIG. 11 is a flow chart illustrating one exposure calculation algorithm according to the present invention.

A first exposure algorithm for calculating the X-ray exposure for bedside chest radiography will now be described with reference to FIG. 11. The object of the exposure estimation procedure is to correctly estimate the exposure received by the film in the region of the mediastinum 50 (see FIG. 3) of the patient when the orientation of the sensor with respect to the patient is unknown. The exposure estimation proceeds as follows. The sensor signals from the sensor array are digitized and if a flag is set for a sensor, the sensor value is determined by linear interpolation between the neighboring sensors (152). A discrete linear waveform of sensor values is formed (154) for each of the linear arrays 32–38 respectively. Peaks are detected (156) in the linear waveforms, for example by using a method analogous to the peak detection method disclosed in U.S. Pat. No. 4,731,863 issued Mar. 15, 1988 to Sezan et al. The method of peak detection detects peaks in the linear waveform by generating a peak detection function $r_N(n)$ as follows. A cumulative sum C(n) of the outputs for each linear image is calculated $$C(n) = \sum_{m}^{n} S(m), \tag{3}$$

where S(m) is the signal value of the $m^{th}$ sensor in the array.

The cumulative sum C(n) is smoothed by convolving with a uniform rectangular window $w_N(n)$ to produce a smoothed cumulative sum $\overline{C}_N(n)$:

$$\overline{C}_N(n) = C(n) * w_N(n), \tag{4}$$

where the subscript N represents the size of the window $w_N(n)$ in numbers of samples; and where the uniform rectangular window is defined as:

$$W_N(n) = \begin{cases} \frac{1}{N}, & -\frac{N-1}{2} \leqq n \leqq \frac{N-1}{2} \\ 0, \text{ otherwise} \end{cases} \tag{5}$$

The smoothed cumulative sum $C_N(n)$ is subtracted from the cumulative sum C(n) to generated the peak detection function $r_N(n)$, $$r_N(n) = C(n) - \overline{C}_N(n) \tag{6}$$

Figure 12:
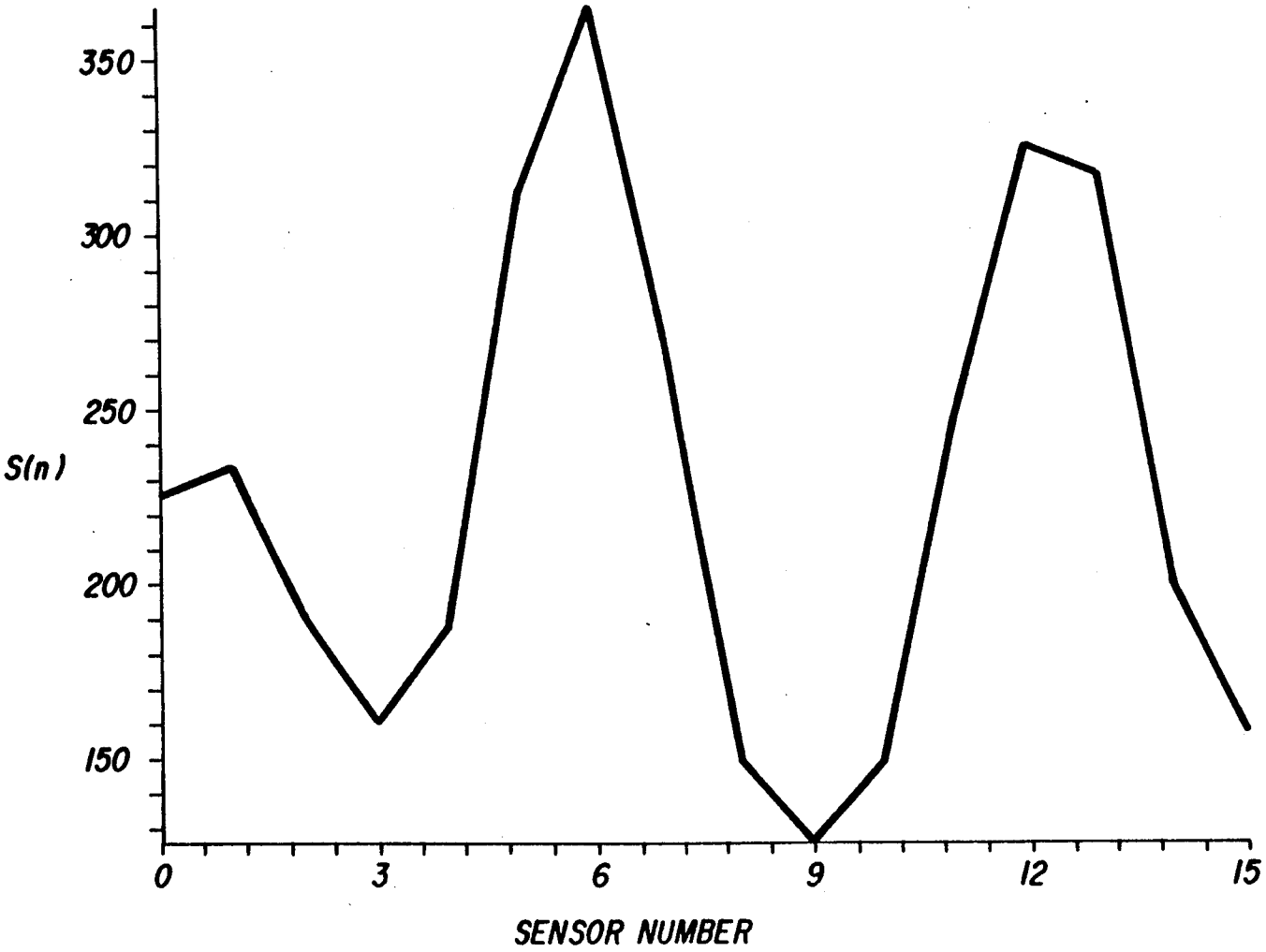
FIG. 12 is a graph showing a typical waveform generated by one of the linear sensor arrays shown in FIG. 2.
Figure 13:
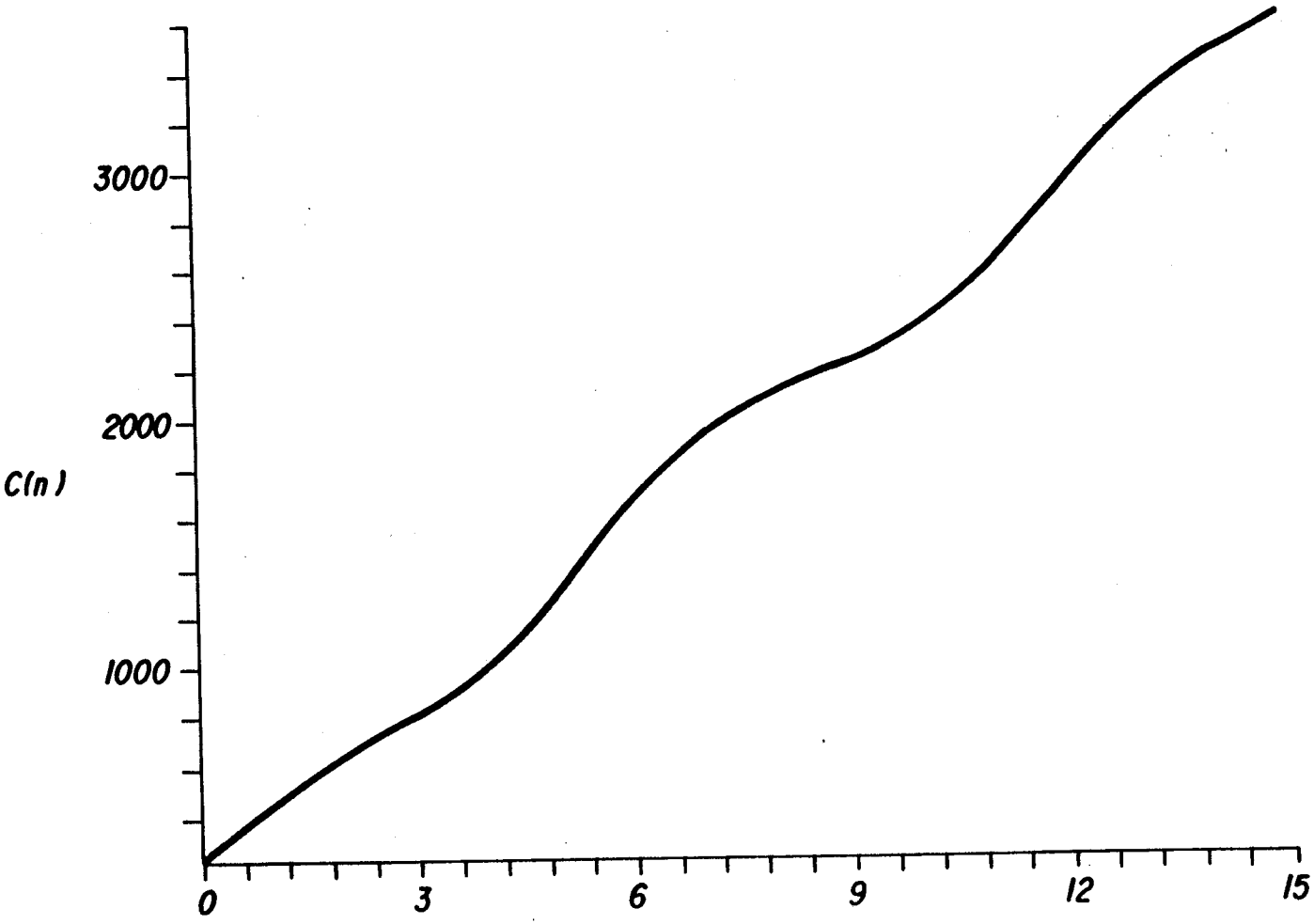
FIG. 13 is a graph showing the cumulative sum generated from the waveform shown in FIG. 12.
Figure 14:
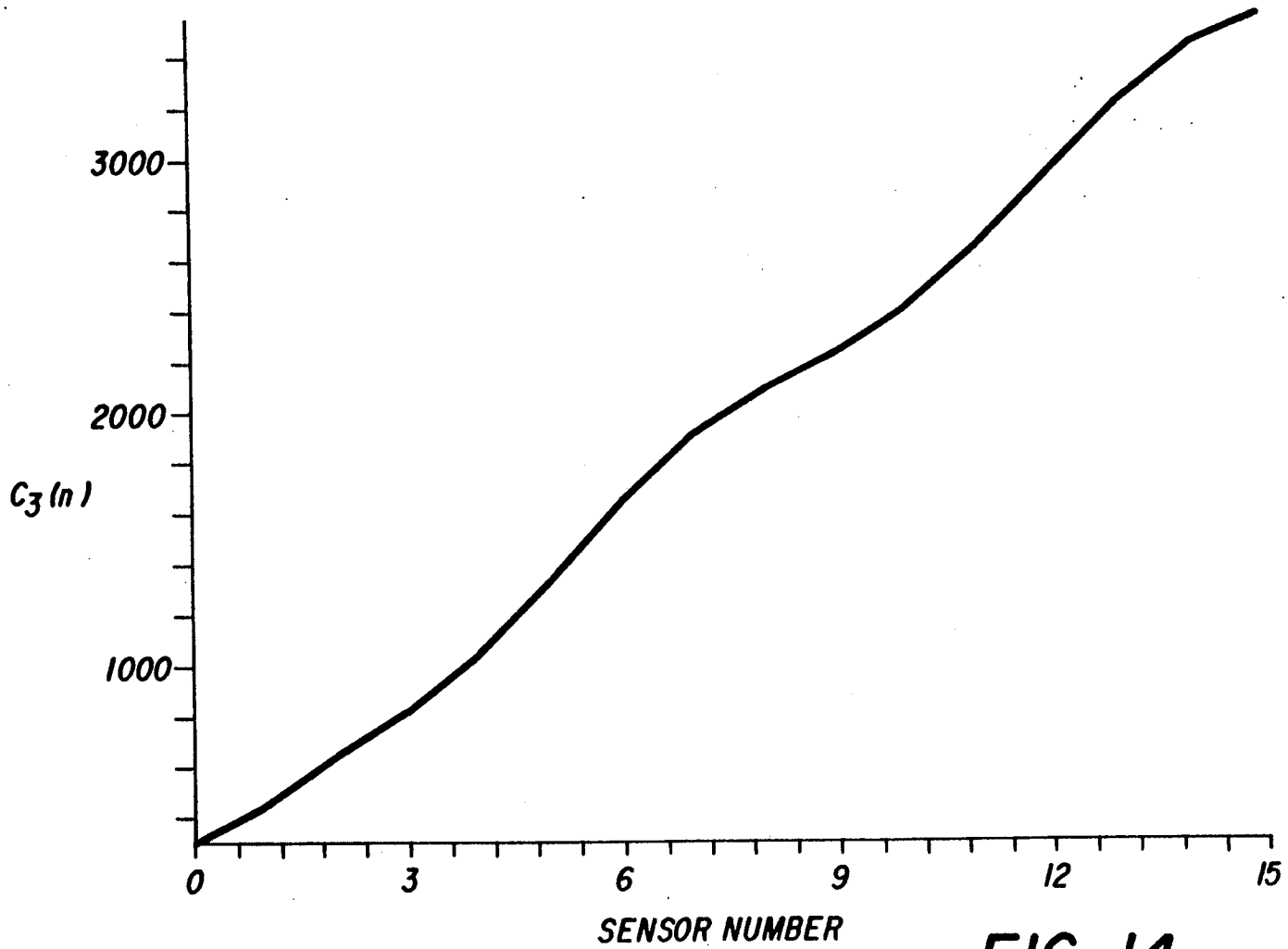
FIG. 14 is a graph showing the smoothed cumulative sum generated from the sum shown in FIG. 13.

Positive to negative zero crossings of the peak detection function $r_N(n)$ represent the start of a peak and a maximum following such a zero crossing represents the end of the peak. FIG. 12 shows a typical linear waveform S(n) from one of the linear sensor arrays. FIG. 13 shows the cumulative sum C(n) generated from S(n) in FIG. 12. FIG. 14 shows the smoothed cumulative sum $\overline{C}_N(n)$ generated from the cumulative sum; and FIG. 15 shows the peak detection function $r_N(n)$ generated from the difference between C(n) and $\overline{C}_N(n)$ for N=3—.

Figure 15:
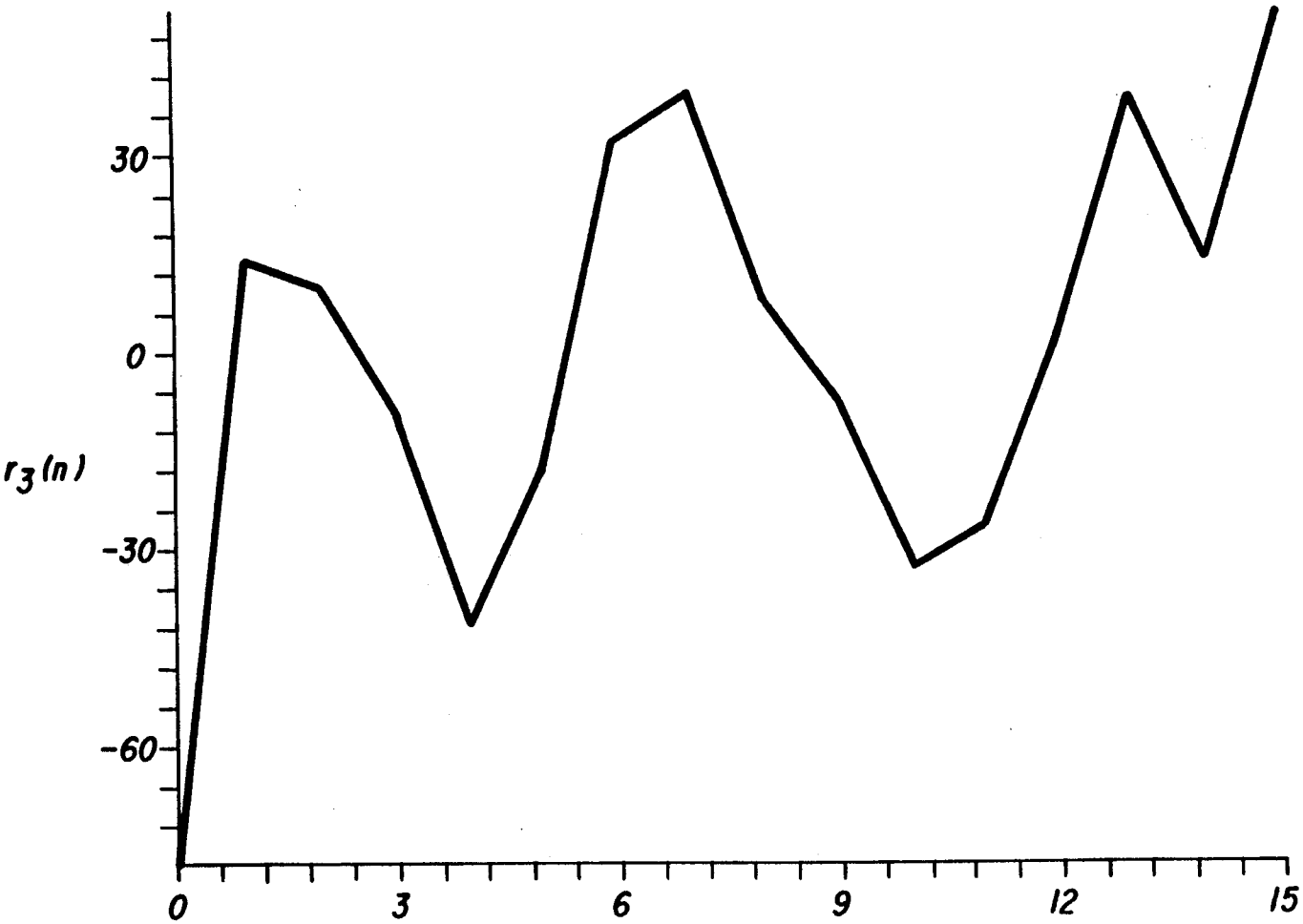
FIG. 15 is a graph showing the peak detection function generated from the difference between the cumulative sum of FIG. 13 and of the smoothed sum of FIG. 14.

As seen from FIG. 15, the first peak in the waveform starts at sensor #0 and ends at sensor #1, and the second peak starts at sensor #3 and ends at sensor #7, and the third peak starts at sensor #9 and ends at sensor #15.

Figure 16:
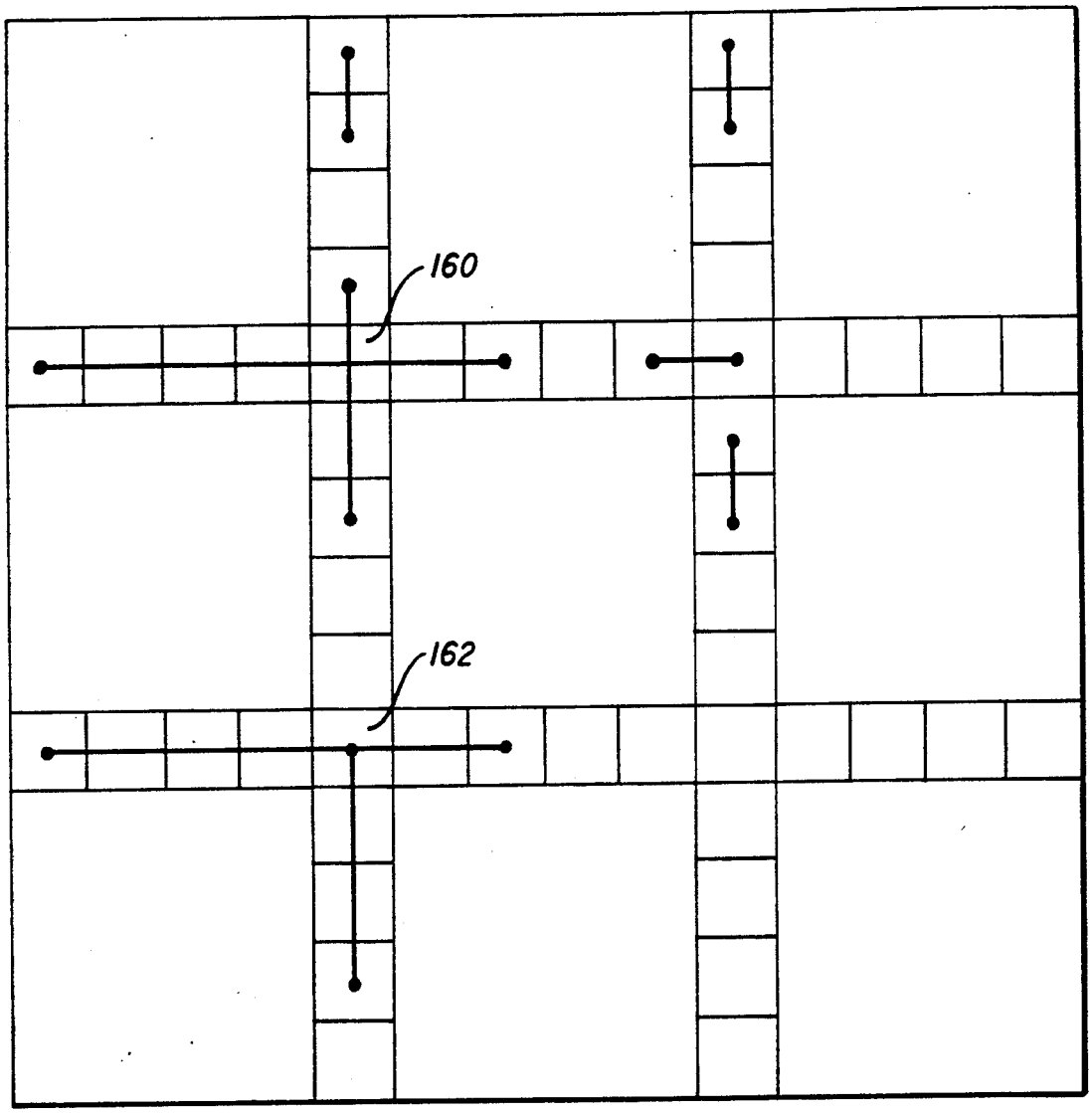
FIG. 16 is a schematic diagram illustrating one example of the location of peaks detected by the sensor array.

Returning to FIG. 11, after the peaks are detected in the linear waveform, peaks that cross each other at the corner sensors of the rectangular pattern are identified (158). The corner where a peak crossing occurs is likely to be over a lung. FIG. 16 illustrates the location of peaks in the linear waveform for a typical exposure. The peaks are identified by lines between dots on the sensor elements. In this example there are peak crossings at sensor 160 and 162. Finally, employing the peak crossing information, mediastinum exposure is estimated (164) (see FIG. 11) as follows. There are six possible cases of peak crossings at the corner sensors:

1. no peak crossings at any corners;
2. a peak crossing at only one corner;
3. peak crossings at two adjacent corners;
4. peak crossings at two diagonal corners;

5. peak crossings at three corners; and
6. peak crossings at all four corners.

The implication of each of these cases will now be described, and the appropriate exposure determination explained.

CASE 1

The sensor has failed to detect the lungs (perhaps because they may be filled with fluid), or the patient projection may be lateral (i.e. the patient is turned sideways to the sensor). An estimate of the actual exposure E is computed as follows:

$$E=(E_1+E_2+E_3+E_4)/4 \quad (7)$$

where $E_i$ is the minimum value of the linear waveform $S_i(n)$ between corners.

CASE 2

Only one peak crossing was detected. This situation is most likely to occur when one lung is missing or filled with fluid or the patient projection is lateral. An estimate of the exposure is computed as follows:

$$E=(E_1+E_2)/2 \quad (8)$$

where $E_1$ and $E_2$ are the minimum values of the linear waveforms between the end of the peaks at the corner where the peak crossing occurred and the two adjacent corners.

CASE 3

When the peak crossings occur at two adjacent corners, the sensor is ideally aligned with the lung field, with the two peak crossing corners arranged over the lung field as shown in FIG. 3. In this case, the exposure E is computed as:

$$E=(E_1+E_2)/2 \quad (9)$$

where $E_1$ is the minimum value of the linear waveform between the two peaks at the adjacent corners where the peak crossings occurred, and $E_2$ is the minimum value of the linear waveform between the two opposite corners.

CASE 4

When peak crossings occur at diagonal corners there may be a fluid filled lung or gas in the digestive tract, or the cassette may be extremely rotated with respect to the patient. In this case, the estimated exposure E is computed as:

$$E=(E_1+E_2+E_3+E_4)/4 \quad (10)$$

where $E_i$ is the minimum value of the linear waveform between a peak at a corner and an adjacent corner.

CASE 5

Three peak crossings can occur due to a bubble of gas in the digestive tract. In this case, it may not be clear what two peak crossings represent the lung field. If two of the peak crossings are stronger than a third, then the two probably represent the lung field. Exposure E is computed by calculating the average mean $a_i$ of the two peaks at each of the three corners as follows:

$$a_i=(m_1+m_2)/2,\ i=1,2,3 \quad (11)$$

where $m_1$ is the mean of the value of the linear waveform within one of the crossing peaks, and $m_2$ is the mean of the value of the waveform within the other peak at the crossing. If two of the average means $a_i$ at adjacent corners are greater than the third, then the exposure is estimated as in Case 3 above, ignoring the peak crossing at the corner. If not, the exposure E is computed as:

$$E=(E_1+E_2)/2 \quad (12)$$

where $E_1$ and $E_2$ are the minimum values of the waveforms between the peak crossings.

CASE 6

Peak crossings at all four corners of the detector can also result from bubbles of gas in the digestive tract. As in Case 5 above, if two of the peaks are stronger than the other two, these two peaks probably represent the lung field. The exposure E is computed by first calculating the average means $a_i$ of the two peaks at each corner as in Case 5 above Equation 7. If the average means of the two peak crossings at two adjacent corners are greater than the other two, the exposure is calculated as in Case 3 above. If the average means of the peaks at two diagonal corners are greater than the average means of the peaks at the other two corners, the exposure is computed as in Case 4 above. If neither of the preceeding conditions holds, the exposure E is computed as:

$$E=(E_1+E_2+E_3+E_4)/4 \quad (13)$$

where $E_i$ is the minimum value of the linear waveform between peaks at the four corners.

A computer program written in the Fortran language for operating on a VAX/VMS computer for performing the exposure calculation described above is included in Appendix D.

A second procedure for calculation exposure will now be described with reference to FIG. 17. This procedure is independent of exam type, and sensor array configuration. First, the sensor values S(n) are stored in a sorting array (164). If a flag is set for any of the sensors, the signal value S(n) for the flagged sensor is set to zero (166) in the sorting array. Next, the array is sorted in ascending order (168), to form a rank order of signal values. An example of values sorted by rank order is shown in FIG. 18.

Figure 19:
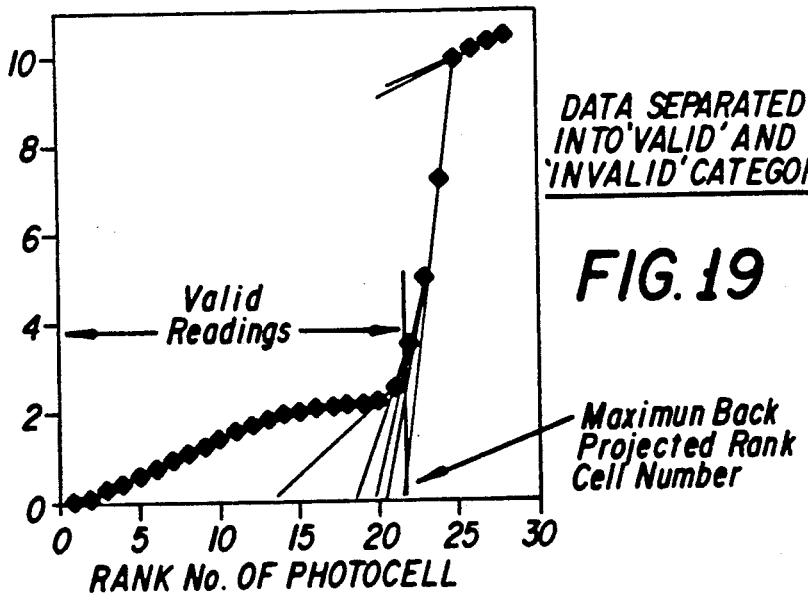

Next, the rank order of the highest valued cell from the subject exposure is determined (170) by constructing a line through successive pairs of values in the rank order array, and calculating the intercept of each line with the rank number axis. The maximum intercept is the rank number of the last cell containing subject exposure information. This step is illustrated graphically in FIG. 19. Next, the rank order of the last cell containing subject exposure information is divided by 2 (172) to determine the median cell with subject exposure information. The exposure is then determined (174) as the value in the median cell.

Figure 17:
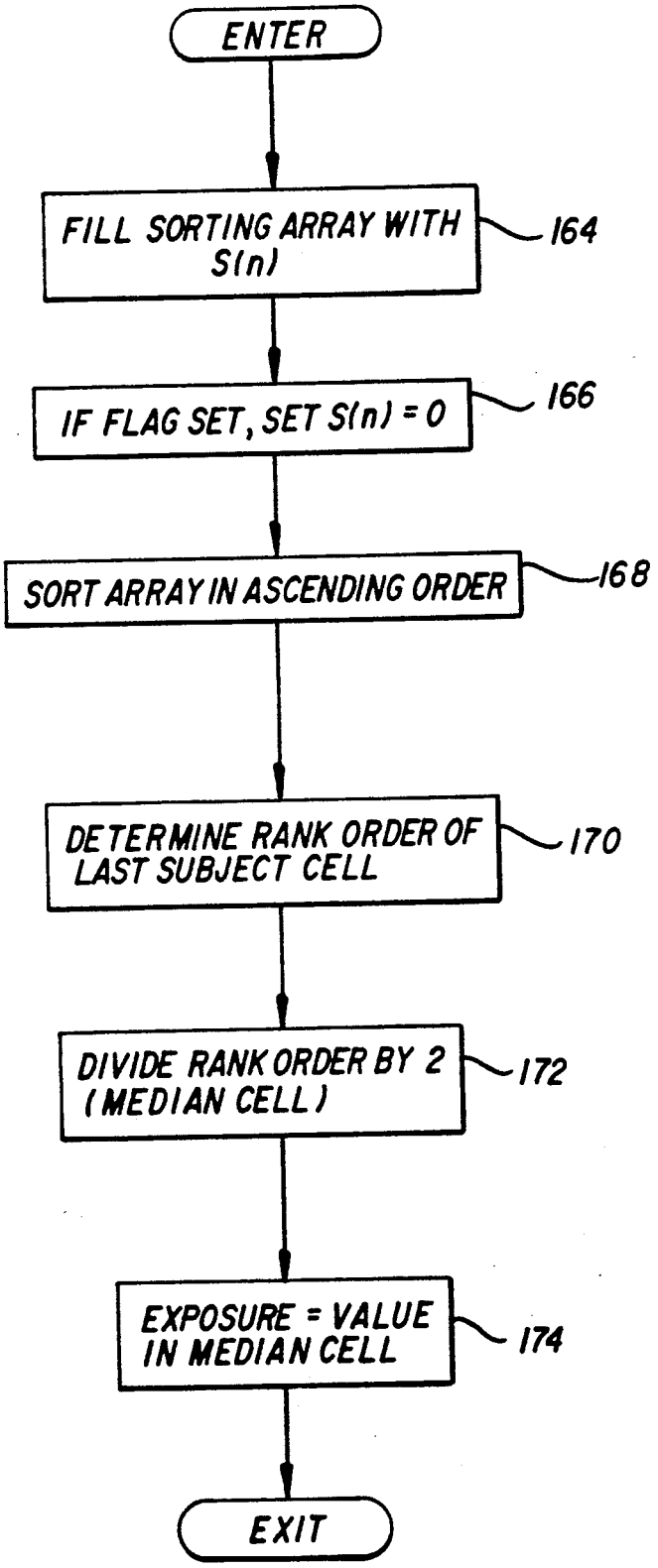
FIG. 17 is a flow chart describing an alternative method of calculating exposures.
Figure 18:
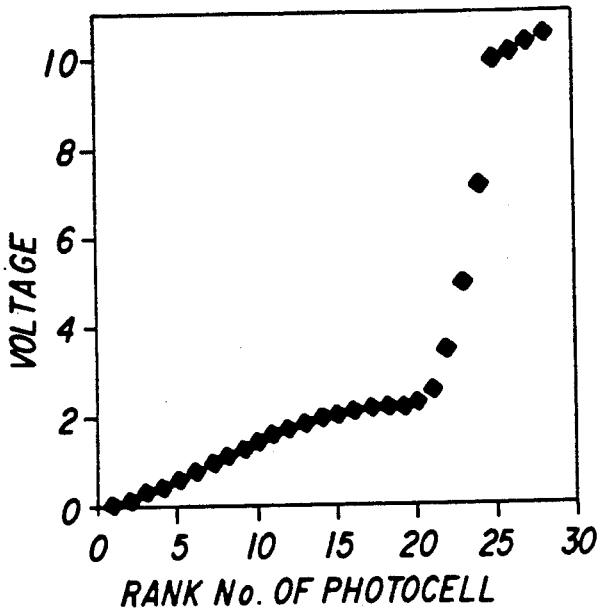
FIGS. 18 and 19 are graphs useful in describing the alternative method of calculating exposures.

A computer program written in the C language for operating on a Compact TM personal computer to perform the exposure determination algorithm described in FIG. 17 is included as Appendix E.

Figure 20:
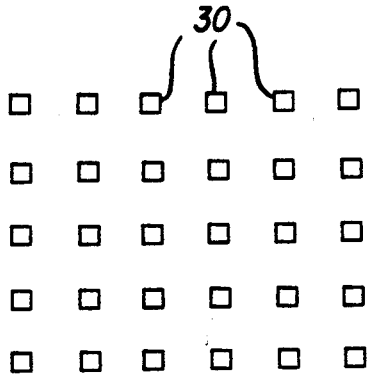
FIG. 20 is a schematic diagram showing an alternative arrangement of sensors useful with the alternative method of calculating X-ray exposures.
Figure 21:
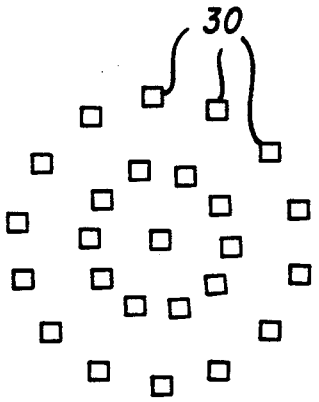
FIG. 21 is a schematic diagram illustrating a still further arrangement of sensors useful with the alternative method of calculating X-ray exposures.

In addition to the configuration of sensors shown in FIG. 2, other sensor configurations may be employed with this second mode of exposure calculation. One example is a sparse rectangular array of sensors 30 as illustrated in FIG. 20, or a circular arrangement as shown in FIG. 21. The preprocessing and calibration of the sensor would proceed as described above.

ADVANTAGES AND INDUSTRIAL APPLICABILITY

The X-ray phototimer according to the present invention is useful in the field of radiography and particularly in bedside radiography, and is advantageous in that more accurate exposure is possible in the exposure control mode, thereby reducing the number of necessary reexposures. In the exposure checking mode, the phototimer is advantageous in that an incorrect exposure may be identified immediately and reexposure effected, thereby eliminating the need for setting up the X-ray equipment for reexposure after incorrect exposure is determined by processing the film. In the exposure control mode of operation, the phototimer terminates the X-ray exposure when a proper exposure level has been achieved.

Appendix A . Page 1 of 6 Copyright Eastman Kodak Company

Listing B:calb.C

```
 1  /* CALB1.C Lee Frank XRAY SENSOR calibration                    */
 2  /* Note use of command line input, format 'CALB1 Calb.dat T# */
 3  /* where Calb.dat is gain data file. Because this is          */
 4  /* not in the critical time path, floating point numbers can */
 5  /* be used.photocells.                                         */
 6
 7  #include "stdio.h"    /* Standard I/O header */
 8  #define ADDRESS 1808
 9
10  /* initialize common variables */
11  int wirebyt[5];
12  int bp[8] = { 1, 2, 4, 8, 16, 32, 64, 128 };
13  int pcell[8][65];
14  int hist[420];
15
16
17  float fract = .5;     /* fraction up from darkest for criteria */
18                        /* default is median value */
19  main(argc,argv)
20    int argc;
21    char *argv[];
22
23    {
24     int i, j, k, l, m,trip;
25     int pause();
26     int blank();
27     int beep();
28     int wire();
29     int ifetch();
30     int xray();
31     int pfill();
32     double sum, ii, jj, kk, ll;
33
34     FILE *fp;
35     char *nbs[2];
36     char s;
37
38   /* initialize output board /*
39
40   outp(ADDRESS+15,128); /*set digital lines to output mode*/
41   outp(ADDRESS+15,128);
42   wirebyt[1]=15;        /* bank switche preset byte        */
43   wire(11,1);            /* sent                            */
44
45
46     /* PRINT HEADER ON SCREEN */
47
48     printf("\n\n\n\n\n");
49     printf("                          Expert Exposure Control\n");
50     printf("                          ----------------------\n\n");
51     printf("                        Photocell Gain Calibration\n");
52     printf("                                 Lee Frank \n\n");
53
54
55     /* PROCESS COMMAND LINE  DATA */
56
57     if(argc==1)
58       {
59        printf("\nNo output file specified -- Try again!\n");
60        exit(1);
61       }
62
```

```
63 |      ++argv;
64 |      printf("Gain calibration will be placed in %s.\n\n",*argv);
65 |      printf("\nWe are assuming the sensor is ready and ");
66 |      printf("the X-rays are off.\n");
67 |
68 |
69 |       /* WARNING THIS BOARD NEEDS ONE RUN TO CLEAN UP STORED*/
70 |       /* THUS THE EXTRA PFILL(0)!!!!! */
71 |
72 |
73 |      pfill(0);
74 |      pfill(0);
75 |      printf("Dark current data is now gathered.\n");
76 |      printf("NOW PLEASE TURN THE X-RAYS ON");
77 |      printf(" -- I AM WAITING!!!\n");
78 |
79 |      i=1000;
80 |      if(argc==3)
81 |        {
82 |          i = atoi(*++argv);
83 |          --argv;
84 |        }
85 |      xpause(i);
86 |      trip=i;
87 |
88 |      pause(6);
89 |      for(i=1;i<5;i++) pfill(i);
90 |
91 |      sum =0;
92 |      for(i=0;i<65;i++)
93 |         {
94 |           j= (pcell[1][i]+pcell[2][i]+pcell[3][i]+pcell[4][i])/4;
95 |           j= pcell[0][i]-j;
96 |           pcell[5][i]=j;
97 |           jj=j;
98 |           sum=sum+jj;
99 |         }
100 |
101 |      /* remove excessively low gain (less than 1/4 average cells */
102 |      sum=sum/64;
103 |      k = sum;
104 |      k = k/4;
105 |      for(i=0;i<64;i++)
106 |        {
107 |          if(pcell[5][i]<k) pcell[5][i]=0;
108 |        }
109 |
110 |        /* two photocells oscillate */
111 |        pcell[5][18]=0;
112 |        pcell[5][19]=0;
113 |
114 |      /* Record that record file, format is trigger level,
115 |         64 gains with zeros for bad channels */
116 |
117 |      fp=fopen(*argv,"w");
118 |      if(fp==NULL)
119 |          {
120 |           printf("\nCan't open %s, sorry Boss!!\n",*argv);
121 |           exit(1);
122 |           }
123 |      fprintf(fp," %d",trip);
124 |      for(i=0;i<65;i++) fprintf(fp," %d",pcell[5][i]);
125 |      fclose(fp);
126 |
127 |      printf("CALB1.C  Gain Calibration for Sensor\n");
128 |      printf("\n Input Form: Calb1 %s %d",*argv,trip);
129 |      printf("\n Program initializes sensor, read dark");
130 |      printf(" levels, waits for first X-rays, pauses");
131 |      printf("\n.6 second, obtains 4 pass exposed values");
132 |
133 |     printf("\n\n");
134 |     for(i=0;i<4;i++)  printf("#  dark change      ");
135 |     printf("\n");
136 |
137 |     for(i=0;i<16;i++)
138 |         {
139 |          for(j=0;j<4;j++)
140 |           {
```

```
141 |          k=4*i-j;
142 |          printf("%2d",k);
143 |          printf("%5d ",pcell[0][k]);
144 |          printf("%5d      ",pcell[5][k]);
145 |         }
146 |       printf("\n");
147 |       }
148 |
149 |
150 |    }
151 |
152 |
153 |  /*  Application specific subroutines  */
154 |
155 |  xray(i)      /* manual assurance of Xray status */
156 |     int i;    /* 0 or 1 only permitted off or on */
157 |     {         /* as a subroutine it is easy to   */
158 |      int j;   /* replace with relay driver.      */
159 |
160 |      printf("\nPlease make sure X-rays are ");
161 |      if(i==0) printf("OFF ");
162 |      if(i==1) printf("ON ");
163 |      printf("then hit ENTER when ready.\n");
164 |      fflush(stdin);
165 |      j=getc(stdin);
166 |     }
167 |
168 |  pfill(k)      /* loads i th column of pcell[i][ ] */
169 |    int k;      /* from a to d, improved version with minimum */
170 |    {           /* bank switching & settling after bank switching*/
171 |     int ifetch();
172 |     int i, j, w;
173 |
174 |          for(i=0;i<4;i++)
175 |            {
176 |              wire(11-i,0);
177 |                 /*set bank switches for data collection*/
178 |
179 |              for(w=0;w<20;w++); /*settle down pause*/
180 |
181 |              for(j=0;j<16;j++)
182 |                  {
183 |                    pcell[k][i+4*j] = ifetch(j);
184 |                  }
185 |
186 |               wire(11-i,1); /*restore bank switches*/
187 |             }
188 |     }
189 |
190 |
191 |  xpause(i)      /* checks 16 cells from pcell[0][n] for change */
192 |    int i;       /* of - i or less then returns (photocurrent   */
193 |                 /* is negative.)                               */
194 |    {
195 |     int ifetch();
196 |     int jl,k,l,ch,trip;
197 |
198 |     trip=0;
199 |     jl=0;                          /* bank 1 detectors    */
200 |     wire(11-jl,0);                 /* zero turns on bank */
201 |     for(k=0;k<20;k++);             /*pause to settle system */
202 |
203 |     while(trip<1)
204 |         {
205 |           l=0;
206 |           for(k=0;k<16;k++)
207 |               {
208 |                ch=4*k+jl;
209 |                l=l+pcell[0][ch]-ifetch(k);
210 |               }
211 |           if(l>i) trip=1;
212 |         }
213 |           wire(11-jl,1);                /* 1 turns off bank */
214 |     }
215 |
216 |
217 |
218 |
219 |  ifetch(i) /* fetch a2d data from channel i */
220 |   int i;
```

```
221 |     {
222 |       int j, k, l, m;
223 |
224 |        /*set channel*/
225 |       outp(ADDRESS+4,128);
226 |       outp(ADDRESS+5,i);
227 |
228 |       outp(ADDRESS+6,0);    /*start convert*/
229 |       j=ADDRESS+4;
230 |       k=inp(j);
231 |       while (k<128) k=inp(j); /*wait if needed*/
232 |
233 |
234 |       l = inp(ADDRESS+5);    /*low sig. byte */
235 |       m = inp(ADDRESS+6);    /*high sig. byte */
236 |       l = l+ 256*m;
237 |       return(l);
238 |     }
239 |
240 |  out(i,j)      /* D to A out channel i, value j    */
241 |     int i,j;  /* see manual for limits on values */
242 |     {
243 |       int k,l,m,n;
244 |
245 |       k = j/256;      /*most sig byte    */
246 |       if(k<0) k = k + 16;
247 |       l = j-256*k;    /* least sig byte */
248 |
249 |       m = ADDRESS + (2*i) -1;
250 |       n = m -1;
251 |
252 |       outp(m,k);
253 |       outp(n,l);
254 |
255 |     }
256 |
257 |  pause(i) /* one pause = .1 second */
258 |   int i;
259 |   {
260 |    int j,k;
261 |    for(j=0;j<i;j++) for(k=0;k<14700;k++) ;
262 |   }
263 |
264 |
265 |  wire(i,j)       /* i is wire, j is 0 or 1 to output on j */
266 |     int i,j;      /* i ranges from 0 to 23 */
267 |     {
268 |       int k,l;
269 |       k= i/8;          /* k is bundle 0 to 2 */
270 |       l= i-8*k;
271 |
272 |       if(j==1)
273 |         {
274 |           wirebyt[k] = wirebyt[k] | bp[l];
275 |         }
276 |       if(j==0)
277 |         {
278 |           wirebyt[k] = wirebyt[k] & (255-bp[l]);
279 |         }
280 |        outp(ADDRESS+15,128);
281 |        outp(ADDRESS+12+k,wirebyt[k]);
282 |      }
283 |
284 |
```

Appendix B  Page 3 of 5  Copyright of Eastman Kodak Company

Listing B:grab.C

```
1 |  /* grab.C Lee Frank XRAY SENSOR data grabber    */
2 |  /* Command line inputt 'grab Calb.dat knee.dat Comment words'  */
3 |
4 |  #include "stdio.h"   /* Standard I/O header */
5 |  #define ADDRESS 1808
6 |
7 |  /* initialize common variables */
8 |  int wirebyt[5];
9 |  int bp[8] = { 1, 2, 4, 8, 16, 32, 64, 128 };
```

```
int pcell[6][65];
int hist[420];


float fract = .5;     /* fraction up from darkest for criteria */
                      /* default is median value */
main(argc,argv)
  int argc;
  char *argv[];

  {
   int i, j, k, l, m,trip;
   int pause();
   int blank();
   int beep();
   int wire();
   int ifetch();
   int xray();
   int pfill();
   double sum, ii, jj, kk, ll;

   FILE *fp;
   char *nbs[2];
   char s;

 /* initialize output board /*

 outp(ADDRESS+15,128); /*set digital lines to output mode*/
 outp(ADDRESS+15,128);
 wirebyt[1]=15;        /* bank switche preset byte        */
 wire(11,1);            /* sent                            */
 wire(11,1);            /* sent                            */


   /* PRINT HEADER ON SCREEN */

   printf("\n\n\n\n\n");
   printf("                          Expert Exposure Control\n");
   printf("                          -----------------------\n\n");
   printf("                            Photocell Data Scan\n");
   printf("                                 Lee Frank \n\n");


   /* PROCESS COMMAND LINE  DATA */

   if(argc<4)
     {
      printf("\nSorry Boss - try again.\n");
      printf("\nInsufficient Data on Command line");
      printf("\nUse Following form:\n              ");
      printf("Grab gain.dat knee.dat Comment for knee.\n");

      exit(1);
     }

   ++argv;
   fp=fopen(*argv,"r");
   if(fp==NULL)
     {
      printf("Sorry Boss, %s can't be opened.",*argv);
      exit(1);
     }
   fscanf(fp,"%d",&trip);
   for(i=0;i<64;i++) fscanf(fp,"%d",&pcell[2][i]);
   fclose(fp);

   /* second (record file) */
   ++argv;
   fp=fopen(*argv,"w");
   if(fp==NULL)
     {
      printf("Sorry Boss, %s can't be opened.",*argv);
      exit(1);
     }
   for(i=3;i<argc;i++)
        {
         ++argv;
         fprintf(fp," %s",*argv);
        }
```

```
89  |     fprintf(fp,"\n");
90  |
91  |
92  |      /* WARNING THIS BOARD NEEDS ONE RUN TO CLEAN UP STORED*/
93  |      /* THUS THE EXTRA PFILL(0)!!!!! */
94  |
95  |
96  |     pfill(0);
97  |     pfill(0);
98  |     printf("Dark current data is now gathered.\n");
99  |     printf("NOW PLEASE TURN THE X-RAYS ON");
100 |     printf(" -- I AM WAITING!!!\n");
101 |
102 |     xpause(trip);
103 |     pause(6);
104 |
105 |     pfill(3);
106 |
107 |     for(i=0;i<64;i++)
108 |       {
109 |         pcell[4][i]=0;
110 |         if(pcell[2][i]>0)
111 |           {
112 |            j=pcell[0][i]-pcell[3][i];
113 |            jj=j;
114 |            kk=pcell[2][i];
115 |            jj=1000*jj/kk;
116 |            pcell[4][i]=jj;
117 |           }
118 |        fprintf(fp,"%d ",pcell[4][i]);
119 |      }
120 |     fclose(fp);
121 |     printf("Data gathered & posted to disk\n");
122 |   }
123 |
124 |
125 |  /*  Application specific subroutines  */
126 |
127 |  xray(i)      /* manual assurance of Xray status */
128 |     int i;    /* 0 or 1 only permitted off or on */
129 |     {         /* as a subroutine it is easy to   */
130 |      int j;   /* replace with relay driver.      */
131 |
132 |      printf("\nPlease make sure X-rays are ");
133 |      if(i==0) printf("OFF ");
134 |      if(i==1) printf("ON ");
135 |      printf("then hit ENTER when ready.\n");
136 |      fflush(stdin);
137 |      j=getc(stdin);
138 |     }
139 |
140 |  pfill(k)      /* loads i th column of pcell[i][ ] */
141 |    int k;      /* from a to d, improved version with minimum */
142 |    {           /* bank switching & settling after bank switching*/
143 |     int ifetch();
144 |     int i, j, w;
145 |
146 |          for(i=0;i<4;i++)
147 |            {
148 |              wire(11-i,0);
149 |              wire(11-i,0);
150 |                 /*set bank switches for data collection*/
151 |
152 |              for(w=0;w<20;w++); /*settle down pause*/
153 |
154 |              for(j=0;j<16;j++)
155 |                  {
156 |                   pcell[k][i+4*j] = ifetch(j);
157 |                  }
158 |
159 |               wire(11-i,1); /*restore bank switches*/
160 |               wire(11-i,1); /*restore bank switches*/
161 |             }
162 |     }
163 |
164 |
165 |  xpause(i)      /* checks 16 cells from pcell[0][n] for change */
166 |    int i;       /* of - i or less then returns (photocurrent   */
167 |                 /* is negative.)                               */
168 |    {
```

```
169 |     int ifetch();
170 |     int jl,k,l,ch,trip;
171 |
172 |     trip=0;
173 |     jl=0;                          /* bank 1 detectors    */
174 |     wire(11-jl,0);                 /* zero turns on bank */
175 |     for(k=0;k<20;k++);             /*pause to settle system */
176 |
177 |     while(trip<1)
178 |        {
179 |          for(k=0;k<16;k++)
180 |             {
181 |               ch=4*k+jl;
182 |               l=pcell[0][ch]-ifetch(k);
183 |               if (l>1) trip= 1;
184 |              }
185 |        }
186 |          wire(11-jl,1);                /* 1 turns off bank */
187 |     }
188 |
189 |
190 |
191 |
192 |  ifetch(i) /* fetch a2d data from channel i */
193 |   int i;
194 |    {
195 |      int j, k, l, m;
196 |
197 |       /*set channel*/
198 |      outp(ADDRESS+4,128);
199 |      outp(ADDRESS+5,i);
200 |
201 |      outp(ADDRESS+6,0);   /*start convert*/
202 |      j=ADDRESS+4;
203 |      k=inp(j);
204 |      while (k<128) k=inp(j); /*wait if needed*/
205 |
206 |
207 |      l = inp(ADDRESS+5);   /*low sig. byte */
208 |      m = inp(ADDRESS+6);   /*high sig. byte */
209 |      l = l+ 256*m;
210 |      return(l);
211 |    }
212 |
213 |  out(i,j)      /* D to A out channel i, value j    */
214 |     int i,j;  /* see manual for limits on values */
215 |     {
216 |       int k,l,m,n;
217 |
218 |       k = j/256;      /*most sig byte    */
219 |       if(k<0) k = k + 16;
220 |       l = j-256*k;   /* least sig byte */
221 |
222 |       m = ADDRESS + (2*i) -1;
223 |       n = m -1;
224 |
225 |       outp(m,k);
226 |       outp(n,l);
227 |
228 |     }
229 |
230 |  pause(i) /* one pause = .1 second */
231 |   int i;
232 |   {
233 |    int j,k;
234 |    for(j=0;j<i;j++) for(k=0;k<14700;k++) ;
235 |   }
236 |
237 |
238 |  wire(i,j)       /* i is wire, j is 0 or 1 to output on j */
239 |     int i,j;      /* i ranges from 0 to 23 */
240 |     {
241 |       int k,l;
242 |       k= i/8;          /* k is bundle 0 to 2 */
243 |       l= i-8*k;
244 |
245 |       if(j==1)
246 |         {
```

```
247 |            wirebyt[k] = wirebyt[k] | bp[l];
248 |            }
249 |        if(j==0)
250 |            {
251 |              wirebyt[k] = wirebyt[k] & (255-bp[l]);
252 |            }
253 |        outp(ADDRESS-15,128);
254 |        outp(ADDRESS-12+k,wirebyt[k]);
255 |       }
256 |
257 |
```

```
 1 |  /* Xhruna.C Lee Frank XRAY SENSOR data processor                    */
 2 |  /* (sort>hist)  first pass                                          */
 3 |  /* Command line input 'Xhrun file.dat file.srt'                     */
 4 |  /* Disk output sorted & limited array in file.srt                   */
 5 |
 6 |  #include "stdio.h"   /* Standard I/O header */
 7 |  #define ADDRESS 1808
 8 |
 9 |  /* initialize common variables */
10 |  int wirebyt[5];
11 |  int bp[8] = { 1, 2, 4, 8, 16, 32, 64, 128 };
12 |  int pcell[6][65];
13 |  int hist[100];
14 |
15 |
16 |  float fract = .5;     /* fraction up from darkest for criteria */
17 |                        /* default is median value */
18 |  main(argc,argv)
19 |    int argc;
20 |    char *argv[];
21 |
22 |    {
23 |     int h,i, j, k, l, m, n;
24 |     int insert();
25 |     double sum, ii, jj, kk, ll;
26 |     char comm[200];
27 |
28 |     FILE *fp;
29 |
30 |
31 |
32 |     /* PRINT HEADER ON SCREEN & PAPER*/
33 |
34 |     printf("\n\n\n\n\n");
35 |     printf("                          XHRUNA FIRST PASS\n");
36 |     printf("                        ----------------------\n\n");
37 |     printf("                         Data Processing Module\n");
38 |     printf("                               Lee Frank \n\n");
39 |
40 |     fprintf(stdprn,"            ");
41 |     fprintf(stdprn,"                 XHRUNA FIRST PASS\n\15");
42 |     fprintf(stdprn,"            ");
43 |     fprintf(stdprn,"                 -------------------\n\n\15");
44 |     fprintf(stdprn,"            ");
45 |     fprintf(stdprn,"                Data Processing Module\n\15");
46 |     fprintf(stdprn,"            ");
47 |     fprintf(stdprn,"                       Lee Frank \n\n\15");
48 |
49 |
50 |
51 |     /* PROCESS COMMAND LINE  DATA */
52 |
53 |     if(argc<3)
54 |       {
55 |        printf("\nSorry Boss - try again.\n");
56 |        printf("\nInsufficient Data on Command line");
57 |
58 |        exit(1);
59 |       }
60 |
61 |     ++argv;
62 |     fp=fopen(*argv,"r");
63 |     if(fp==NULL)
64 |       {
```

```
65 |        printf("Sorry Boss, %s can't be opened.",*argv);
66 |        exit(1);
67 |      }
68 |    fgets(comm,100,fp);
69 |    fprintf(stdprn,"%s\15\n",comm);
70 |    printf("%s",comm);
71 |    for(i=0;i<64;i++)
72 |      {
73 |       fscanf(fp,"%d",&pcell[0][i]);
74 |      }
75 |    fclose(fp);
76 |   /* Populate hist[] with valid, counted readings */
77 |
78 |    n=0;
79 |    for(i=0;i<64;i++)
80 |      {
81 |        if(pcell[0][i]>0)
82 |          {
83 |            hist[n]=pcell[0][i];
84 |            n++;
85 |          }
86 |      }
87 |
88 |    /*Sort hist[] into ascending order */
89 |
90 |    insert(hist,n);
91 |
92 |    for(i=0;i<n;i++)
93 |      {
94 |        printf("%3d %5d   ",i,hist[i]);
95 |        fprintf(stdprn,"%3d %5d     ",i,hist[i]);
96 |        j=i+1;
97 |        if(6*(j/6)==j)
98 |          {
99 |            printf("\n");
100 |           fprintf(stdprn,"\n\15");
101 |          }
102 |      }
103 |
104 |    j=0;
105 |    for(i=1;i<n;i++)
106 |      {
107 |        h=0;
108 |        /* if statment to avoid divide by zero */
109 |        if(hist[i]>hist[i-1]) h=i - hist[i]/(hist[i]-hist[i-1]);
110 |        if(h>j) j=h;
111 |      }
112 |    printf("\n clip limit = %d\n",j);
113 |    fprintf(stdprn,"\n\15Clip limit = %d cell.\n\15",j);
114 |    printf("Chosen cell = %d,",j/2);
115 |    fprintf(stdprn,"Chosen data cell = %d,",j/2);
116 |    printf(" value = %d\n",hist[j/2]);
117 |    fprintf(stdprn," value = %d\n\15",hist[j/2]);
118 |    printf(" %s source file\n",*argv);
119 |    fprintf(stdprn,"%s is the source file.\n\15",*argv);
120 |
121 |
122 |    /* Determine exposure constant */
123 |    printf("\nWhat was the exposure time in milliseconds ?");
124 |    scanf("%d",&i);
125 |    fprintf(stdprn,"With an exposure time of %d millisec",i);
126 |    i = hist[j/2]*i;
127 |    printf("\nExposure multiplier is %d\n",i);
128 |    fprintf(stdprn,"., the Exposure multiplier is %d\n\15",i);
129 |    /*save data for  xhrunb.C */
130 |    fp=fopen("Expos.dat","w");
131 |    fprintf(fp,"%d",i);
132 |    fclose(fp);
133 |
134 |
135 |
136 |    /*Save data for plotter*/
137 |    ++argv;
138 |    printf(" %s destination file\n",*argv);
139 |    fprintf(stdprn,"%s is the destination file.\n\14\15",*argv);
140 |    fp=fopen(*argv,"w");
141 |    fprintf(fp,"Sort of %s Cell Rank, Data Number,",comm);
142 |    for(i=0;i<n;i++) fprintf(fp," %d %d",i+1,hist[i]);
```

```
143 |      fclose(fp);
144 |    }
145 |
146 |
147 |   /*  Application specific subroutines  */
148 |
149 |
150 |   int insert(a,na)
151 |    int a[];          /* array of integers */
152 |    int na;           /* number of integers to sort */
153 |
154 |    {
155 |     int i, j, temp;
156 |
157 |     for(i=1;i<na;i++)
158 |      {
159 |        temp = a[i];
160 |        j = i-1;
161 |        while( (j>=0) && (temp< a[j]))
162 |          {
163 |            a[j+1] = a[j];
164 |            j = j -1;
165 |          }
166 |        a[j+1] = temp;
167 |      }
168 |    }
```

Copyright Eastman Kodak Company

```
C >>>>> VERSION: 1                    (Aug. 15, 1988)
C-----------------------------------------------------------------C
C                        PROGRAM   PTIMER                         C
C                                                                 C
C-----------------------------------------------------------------C
C       Purpose:  To determine an estimate of the exposure level  C
C                 over the mediastinal field using the signals    C
C                 detected by four linear discrete arrays configured C
C                 in a tic-tac-toe pattern.                       C
C                                                                 C
C       Author :  M.Ibrahim Sezan                                 C
C                 Research Laboratories, Eastman Kodak Company    C
C                 Aug. 13, 1988                                   C
C                                                                 C
C Modifications:  NONE                                            C
C                                                                 C
C Subprograms                                                     C
C       called :  CASENO, CASEj (j=1-->16), CROSS,INTEG, PADD, PKFIND C
C                 PRAMID                                          C
C                                                                 C
C Detailed                                                        C
C  description :  Tic-Tac-Toe pattern :                           C
C                                                                 C
C  coordinate                                                     C
C                          VLEFT     VRIGHT                       C
C  0                         |         |                          C
C  1                         |         |                          C
C  2                         |         |                          C
C  3                         |         |                          C
C  4                         |         |                          C
C  5       HTOP      - - - - + - - - - - + - - - - - -             C
C  6                         |         |                          C
C  7                         |         |                          C
C  8                         |         |                          C
C  9                         |         |                          C
C  10      HBOT      - - - - + - - - - - + - - - - - -             C
C  11                         |         |                          C
C  12                         |         |                          C
C  13                         |         |                          C
C  14                         |         |                          C
C  15                         |         |                          C
C                                                                 C
C                     1 2 3 4 5 6 7 8 9 10 11 12 13               C
C                                                                 C
C                                                                 C
C                                                                 C
C          The '-' indicates a single detector and '+' indicates  C
C          a 'crossover' detector which is common to two linear   C
C          arrays of detectors. Ideally, one pair of the crossover C
C          detectors is located over the lung field, and the other C
C          pair is located over the mediastinal field. In practice, C
C          however, different situations may be possible. These   C
C          issues will be discussed in the following code.        C
```

```
C           Preliminaries:                                          C
C                                                                   C
C         The vertical and horizontal arrays have 16 and 14         C
C         detectors, respectively. The program arrays ( the word    C
C         'array' is used for both the detectors and the program    C
C         variables; the meaning should be clear from the context)  C
C         VLEFT(I) and VRIGHT(I) holds the values detected by the   C
C         vertical detector arrays on the left and right,           C
C         respectively. HTOP(I) and HBOT(I) holds the               C
C         values detected by the horizontal detector arrays at the  C
C         top and bottom, respectively. Thus, VLEFT(I), VRIGHT(I);  C
C         I in [0,15] and, HTOP(I), HBOT(I); I in [0,13] can be     C
C         viewed as four 1-D discrete signals.                      C
C                                                                   C
C         A 'crossover' detector is a detector common to two linear C
C         arrays. There are 4 crossover detectors. 'Crossing' peaks C
C         are a pair of peaks whose extents include the same        C
C         crossover detector.                                       C
C                                                                   C
C                                                                   C
C         The Exposure Estimation Technique: Overview               C
C                                                                   C
C                                                                   C
C         1. Locate the peaks of these four signals                 C
C                                                                   C
C         The location of the peaks of these signals are determined C
C         from their normalized integrated values using our peak    C
C         detection algorithm (US patent No. .....). Normalized     C
C         integrated values are computed in INTEG. The peak finding C
C         signal used in locating the peaks is derived from the     C
C         integrated values in PRAMID. Each peak is characterized   C
C         by a START and END point and,also, the signal mean within C
C         the peak:                                                 C
C         For example for the k th peak of VLEFT(I):                C
C         VL_S(k)=i=value at which the peak Starts;                 C
C         VL_E(k)=n=value at which the peak Ends,                   C
C         where i,n, in [0,15], and                                 C
C         VL_M(k) denotes the mean value of the signal within the   C
C         kth peak. These three parameters are determined in PKFIND. C
C                                                                   C
C         2. Determine crossing peaks over crossover detectors:     C
C                                                                   C
C         The peaks whose supports (extents) include the croosover  C
C         detectors are of particular importance. If the support of C
C         two peaks belonging to a vertical and a horizontal array  C
C         include the same crossover detector, the peaks are said to C
C         be 'crossing' peaks. The crossover detectors with crossing C
C         peaks are potentially located over the lung field.        C
C         For example, in the case of a configuration like          C
C                                                                   C
C                              |         |                          C
C                              |         |                          C
C                        - - X - - - - - X - -                      C
C                              |         |                          C
C                        - - + - - - - - + - -                      C
C                              |         |                          C
C                              |         |                          C
C                              |         |                          C
C                              4         9                          C
C                                                                   C
C          where 'X' denote the crossover detectors over which there C
C          are crossing peaks, the lung field lies on the upper half C
C          of the image. Possibly the bottom crossover detectors lie C
C          over the lung field. Crossing peaks are determined in    C
C          CROSS .                                                  C
C                                                                   C

INTEGER*4          NCASE        ! Case # (1 --> 16)

INTEGER*4          HB_S(15)     ! Starting points of peaks in HBOT
INTEGER*4          HB_E(15)     ! End points of peaks of HBOT
REAL*4             HB_M(15)     ! Mean signal values within the
                                ! the peaks in HBOT
INTEGER*4          HB_IX(2)     ! Indicator for peaks over crossover
                                ! detectors, e.g., HB_IX(1)=j, ==>
                                ! the extent of j th peak of HBOT
                                ! includes the 1st (leftmost) crossover

                                ! detector on HBOT

INTEGER*4          HT_S(15)     ! Starting points of peaks in HTOP
INTEGER*4          HT_E(15)     ! End points of peaks in HTOP
REAL*4             HT_M(15)     ! Mean signal values within the
                                ! the peaks in HTOP
```

```
INTEGER*4          HT_IX(2)      ! Indicator for peaks over crossover
                                 ! detectors, e.g., HT_IX(2)=j, ==>
                                 ! the extent of j th peak of HTOP
                                 ! includes the 2nd (rightmost)
                                 ! crossover detector on HTOP

INTEGER*4          KOUNT_VL      ! # of peaks in VLEFT
INTEGER*4          KOUNT_VR      ! # of peaks in VRIGHT
INTEGER*4          KOUNT_HT      ! # of peaks in HTOP
INTEGER*4          KOUNT_HB      ! # of peaks in HBOT

INTEGER*4          LBOT          ! LBOT=1 if there are crossing peaks
                                 ! on left bottom crossover detector
                                 !(i.e., where VLEFT and HBOT intersect)
                                 ! otherwise LBOT=0
INTEGER*4          LTOP          ! LTOP=1 if there are crossing peaks
                                 ! on left top crossover detector
                                 !(i.e., where VLEFT and HTOP intersect)
                                 ! otherwise LTOP=0
INTEGER*4          RBOT          ! RBOT=1 if there are crossing peaks
                                 ! on right bottom crossover detector
                                 !(i.e.,where VRIGHT and HBOT intersect
                                 ! otherwise RBOT=0
INTEGER*4          RTOP          ! RTOP=1 if there are crossing peaks
                                 ! on right top crossover detector
                                 !(i.e.,where VRIGHT and HTOP intersect)
                                 ! otherwise RTOP=0

INTEGER*4          VL_S(15)      ! Starting points of peaks in VLEFT
INTEGER*4          VL_E(15)      ! End points of peaks in VLEFT
REAL*4             VL_M(15)      ! Mean signal values within the
                                 ! the peaks in VLEFT
INTEGER*4          VL_IX(2)      ! Indicator for peaks over crossover
                                 ! detectors, e.g., VL_IX(1)=j, ==>
                                 ! the extent of j th peak of VLEFT
                                 ! includes the 1st (upper) crossover
                                 ! detector on VLEFT

INTEGER*4          VR_S(15)      ! Starting points of peaks in VRIGHT
INTEGER*4          VR_E(15)      ! End points of peaks in VRIGHT
REAL*4             VR_M(15)      ! Mean signal values within the
                                 ! the peaks in VRIGHT

C          3. Compute an estimate for the mediastinal exposure:      C
C                                                                    C
C          The computation of the mediastinal exposure estimate      C
C          depends on the configuration of the crossing peaks. It    C
C          can easily be seen that the crossing peaks can exist      C
C          in 16 different ways (including the case where there are  C
C          no crossing peaks). In the above example, an estimate can C
C          be computed as                                            C
C          e = 1/2(a + b)                                            C
C          where                                                     C
C          a=MINIMUM [HT_E(j), HT_S(k)]                              C
C          i.e., the minimum value between the two crossing peaks of C
C          HTOP (jth and kth peaks in HTOP) and                      C
C          b=MINIMUM [HBOT(4), HBOT(9)].                             C
C          (Some of the detectors between the crossover detectors    C
C          are assumed to lie over the mediastinum.)                 C
C          The 16 possible cases will be handled separately in       C
C          estimating the exposure. The possible cases are           C
C          illustrated in SUBROUTINE CASENO where the case is        C
C          identified. Following case identification, the appropriateC
C          subroutine, SUBROUTINE CASEj ,j=1,2,..,16, is called to   C
C          compute the exposure estimate.                            C
C                                                                    C
C--------------------------------------------------------------------C

C       Common Variables

        REAL*4             CIN(30)       ! Work array holding padded CUMDF values
        REAL*4             CUMDF(0:15)   ! Normalized integrated array data
        REAL*4             COUT(0:15)    ! Peak finding signal
        INTEGER*4          LRES          ! Results file unit number
        INTEGER*4          N             ! Peak finding window size

        COMMON/DATA/CIN,CUMDF
        COMMON/PEAK/COUT
        COMMON/WINDOW/N
        COMMON/RESULT/LRES
```

```
C       Local Variables

        CHARACTER*10        FVL          ! Vertcal left array data file
        CHARACTER*10        FVR          ! Vertical right array data file
        CHARACTER*10        FHB          ! Horizontal bottom array data file
        CHARACTER*10        FHT          ! Horizontal top array data file
        CHARACTER*10        FRES         ! Results file

        INTEGER*4           HBOT(0:15)   ! Horizontal bottom array data
        INTEGER*4           HCRSS(2)     ! Coordinates of crossover detectors
                                         ! of horizontal arrays
        INTEGER*4           HTOP(0:15)   ! Horizontal top array data

        INTEGER*4           NT_V         ! # of detectors in vertical arrays
        INTEGER*4           NT_H         ! # of detectors in horizontal arrays
        INTEGER*4           VCRSS(2)     ! Coordinates of crossover detectors
                                         ! of vertical arrays
        INTEGER*4           VLEFT(0:15)  ! Vertical left array data
        INTEGER*4           VRIGHT(0:15) ! Vertical right array data

C       Subroutine Parameters (input)

        INTEGER*4           VR_IX(15)    ! Indicator for peaks over crossover
                                         ! detectors, e.g., VR_IX(2)=j, ==>
                                         ! the extent of j th peak of VRIGHT
                                         ! includes the 2nd (lower) crossover
                                         ! detector on VRIGHT


C------PERFORMANCE MEASUREMENT
        LSTAT=LIB$INIT_TIMER()
        IF(.NOT.LSTAT) CALL LIB$STOP(%VAL(LSTAT))
C-----------------------------------------------
        TYPE *,' '
        TYPE *,' EXPERT EXPOSURE CONTROL'
        TYPE *,' ------------------------'
        TYPE *,' '

        TYPE 1000
1000    FORMAT(' ENTER LEFT VERTICAL ARRAY DATA FILE SPECS',T45,'*',$)
        ACCEPT 1010,FVL
1010    FORMAT(A)
        TYPE 1020
1020    FORMAT(' ENTER RIGHT VERTICAL ARRAY DATA FILE SPECS',T45,'*',$)
        ACCEPT 1010,FVR
        TYPE 1030
1030    FORMAT(' ENTER TOP HORIZONTAL ARRAY DATA FILE SPECS',T45,'*',$)
        ACCEPT 1010,FHT
        TYPE 1040
1040    FORMAT(' ENTER BOTTOM HORIZONTAL ARRAY DATA FILE SPECS',T50,'*',$)
        ACCEPT 1010,FHB
        TYPE 2000
2000    FORMAT(' ENTER THE WINDOW SIZE (DEFAULT = 3)',T50,'*',$)
        ACCEPT 2010,N
2010    FORMAT(I)
        IF( N.EQ.0 ) N=3
        TYPE 3000
3000    FORMAT(' ENTER THE OUTPUT FILE SPECS FOR RESULTS',T45,'*',$)
        ACCEPT 1010,FRES

        TYPE *,' '
        TYPE *,'>>>>>>>>>>PROGRAM IS IN PROGRESS.........'

C------HARDWARE-SPECIFIC DATA INPUT

         NT_H=14        ! # of detectors in horizontal arrays
         NT_V=16        ! # of detectors in vertical arrays
         HCRSS(1)=4     ! Coordinate of 1st (leftmost) crossover detector on HTOP
         HCRSS(2)=9     ! Coordinate of 2nd (rightmost) crossover detector on HTO
P
         VCRSS(1)=5     ! Coordinate of 1st (upper) crossover detector on VLEFT
         VCRSS(2)=10    ! Coordinate of 2nd (lower) crossover detector on VLEFT

C------OPEN THE FILES

        LSTAT=LIB$GET_LUN(LVL)
        IF(.NOT.LSTAT) CALL LIB$STOP(%VAL(LSTAT))
        LSTAT=LIB$GET_LUN(LVR)
        IF(.NOT.LSTAT) CALL LIB$STOP(%VAL(LSTAT))
        LSTAT=LIB$GET_LUN(LHT)
        IF(.NOT.LSTAT) CALL LIB$STOP(%VAL(LSTAT))
        LSTAT=LIB$GET_LUN(LHB)
        IF(.NOT.LSTAT) CALL LIB$STOP(%VAL(LSTAT))
```

```
      LSTAT=LIB$GET_LUN(LRES)
      IF(.NOT.LSTAT) CALL LIB$STOP(%VAL(LSTAT))

      OPEN(UNIT=LVL,FILE=FVL,READONLY,STATUS='OLD')
      OPEN(UNIT=LVR,FILE=FVR,READONLY,STATUS='OLD')
      OPEN(UNIT=LHT,FILE=FHT,READONLY,STATUS='OLD')
      OPEN(UNIT=LHB,FILE=FHB,READONLY,STATUS='OLD')
      OPEN(UNIT=LRES,FILE=FRES,STATUS='NEW')

C------START PROCESSING ARRAY DATA
C      ---------------------------
C
C     LEFT VERTICAL ARRAY:

      WRITE(LRES,*)' **** LEFT VERTICAL ARRAY ****'
      DO 10 I=0,NT_V -1              ! READ IN THE DATA
      READ(LVL,*) IDUMMY,VLEFT(I)
10    CONTINUE

      CALL INTEG(VLEFT,NT_V)
      CALL PADD(NT_V)
      CALL PRAMID(NT_V)
      CALL PKFIND(VLEFT,NT_V,VCRSS, KOUNT_VL,VL_S,VL_E,VL_M,VL_IX)

C     RIGHT VERTICAL ARRAY:

      WRITE(LRES,*)' **** RIGHT VERTICAL ARRAY ****'
      DO 20 I=0,NT_V -1              ! READ IN THE DATA
      READ(LVR,*) IDUMMY,VRIGHT(I)
20    CONTINUE

      CALL INTEG(VRIGHT,NT_V)
      CALL PADD(NT_V)
      CALL PRAMID(NT_V)
      CALL PKFIND(VRIGHT,NT_V,VCRSS, KCOUNT_VR,VR_S,VR_E,VR_M,VR_IX)

C     TOP HORIZONTAL ARRAY

      WRITE(LRES,*)' **** TOP HORIZONTAL ARRAY ****'
      DO 30 I=0,NT_H -1              ! READ IN THE DATA
      READ(LHT,*) IDUMMY,HTOP(I)
30    CONTINUE

      CALL INTEG(HTOP,NT_H)
      CALL PADD(NT_H)
      CALL PRAMID(NT_H)
      CALL PKFIND(HTOP,NT_H,HCRSS, KCOUNT_HT,HT_S,HT_E,HT_M,HT_IX)

C     BOTTOM HORIZONTAL ARRAY

      WRITE(LRES,*)' **** BOTTOM HORIZONTAL ARRAY ****'
      DO 40 I=0,NT_H -1              ! READ IN THE DATA
      READ(LHB,*) IDUMMY,HBOT(I)
40    CONTINUE

      CALL INTEG(HBOT,NT_H)
      CALL PADD(NT_H)
      CALL PRAMID(NT_H)
      CALL PKFIND(HBOT,NT_H,HCRSS, KCOUNT_HB,HB_S,HB_E,HB_M,HB_IX)

C------DETERMINE CROSSING PEAKS OVER CROSSOVER DETECTORS

      CALL CROSS(VL_IX,VR_IX,HT_IX,HB_IX, LTOP,RTOP,RBOT,LBOT)

C------DETERMINE THE CASE #

      CALL CASENO(LTOP,RTOP,RBOT,LBOT, NCASE)

C------GIVEN THE CASE, COMPUTE THE EXPOSURE ESTIMATE

      IF(NCASE.EQ.1) THEN
      CALL CASE1(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.2) THEN
      CALL CASE2(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF
```

```
      IF(NCASE.EQ.3) THEN
      CALL CASE3(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.4) THEN
      CALL CASE4(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.5) THEN
      CALL CASE5(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.6) THEN
      CALL CASE6(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.7) THEN
      CALL CASE7(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.8) THEN
      CALL CASE8(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.9) THEN
      CALL CASE9(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.10) THEN
      CALL CASE10(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.11) THEN
      CALL CASE11(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.12) THEN
      CALL CASE12(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.13) THEN
      CALL CASE13(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.14) THEN
      CALL CASE14(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.15) THEN
      CALL CASE15(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF

      IF(NCASE.EQ.16) THEN
      CALL CASE16(VLEFT,VRIGHT,HTOP,HBOT, VL_S,VL_E,VL_M,VL_IX,
     + VR_S,VR_E,VR_M,VR_IX, HT_S,HT_E,HT_M,HT_IX,
     + HB_S,HB_E,HB_M,HB_IX, VCRSS,HCRSS)
      END IF
```

```
C------TIMING

999     LSTAT=LIB$SHOW_TIMER()
        IF(.NOT.LSTAT) CALL LIB$STOP(%VAL(LSTAT))
C
        STOP
        END

C-----------------------------------------------------------------C
        SUBROUTINE INTEG (INPUT,NT)
C-----------------------------------------------------------------C
C                                                                 C
C       Purpose  :  To integrate and then normalize a given array of  C
C                   values.                                       C
C                                                                 C
C       Author   :  M.Ibrahim Sezan                               C
C                   Research Laboratories, Eastman Kodak Company  C
C                   August 15,1988                                C
C                                                                 C
C  Modifications:   None                                          C
C                                                                 C
C-----------------------------------------------------------------C

C     Common Variables

      REAL*4            CIN(30)
      REAL*4            CUMDF(0:15)
      INTEGER*4         LRES

      COMMON/DATA/CIN,CUMDF
      COMMON/RESULT/LRES

C     Input Variables

      INTEGER*4         INPUT(0:15)          ! Input array
      INTEGER*4         NT                   ! # of points in the array

C     Local Variable

      INTEGER*4         NSUM

      DO 5 I=0,NT-1
      WRITE(LRES,*)I,INPUT(I)
5     CONTINUE

      DO 10 I=0,15
      CUMDF(I)=0.0
10    CONTINUE

      NSUM=0
      DO 20 I=0,NT-1
      NSUM=NSUM+INPUT(I)
      CUMDF(I)=NSUM                                  ! INTEGRATION
 20   CONTINUE

      DO 30 I=0,NT-1
      CUMDF(I)=CUMDF(I)/FLOATJ(NSUM)        !NORMALIZATION
 30   CONTINUE

      RETURN
      END

C-----------------------------------------------------------------C
        SUBROUTINE PADD (NT)
C-----------------------------------------------------------------C
C                                                                 C
C       Purpose  :  To padd the integrated values prior to  averaging  C
C                   in routine PRAMID. The padded values are placed in C
C                   the work array CIN.                           C
C                                                                 C
C       Author   :  M.Ibrahim Sezan                               C
C                   Research Laboratories, Eastman Kodak Company  C
C                   August 15,1988                                C
C                                                                 C
C  Modifications:   None                                          C
C                                                                 C
C-----------------------------------------------------------------C

C       Common Variables

        REAL*4          CIN(30)
        REAL*4          CUMDF(0:15)
        INTEGER*4       N
```

```
      COMMON/DATA/CIN,CUMDF
      COMMON/WINDOW/N

C     Input variables

      INTEGER*4       NT      ! # of detectors in the linear array

C     Local variables

      INTEGER*4       NP12
      INTEGER*4       NTT


      NP12=(N+1)/2
      NTT=NT+NP12

      DO 10 I=0,30
      CIN(I)=0.0
10    CONTINUE

C------START PADDING

      DO 20 I=1,NP12
      CIN(I)=CUMDF(0)
20    CONTINUE

      DO 30 I=NP12+1,NTT+NP12
      CIN(I)=1.0
30    CONTINUE


C------FILLING IN THE WORK ARRAY

      DO 40 I=NP12+1,NTT
      K=I-NP12-1
      CIN(I)=CUMDF(K)
      IF(CUMDF(K).EQ.1.0) RETURN
40    CONTINUE

      RETURN
      END

C-----------------------------------------------------------------------C
                    SUBROUTINE  PRAMID(NT)
C-----------------------------------------------------------------------C
C                                                                       C
C       Purpose  :  To generate the 'peak finding' signal which will    C
C                   be used by subroutine PKFIND to locate peaks        C
C                                                                       C
C       Author   :  M.Ibrahim Sezan                                     C
C                   Research Laboratories, Eastman Kodak Company        C
C                   August 15,1985                                      C
C                                                                       C
C  Modifications:   None                                                C
C                                                                       C
C   Detailed                                                            C
C   description :   The peak finding signal is the scaled difference    C
C                   between the integrated values and their local       C
C                   averages which are computed by a uniform running    C
C                   window ('peak finding window'.) (Scaling value is   C
C                   arbitrary: it can be  taken to be unity without     C
C                   loss of generality).                                C
C                                                                       C
C                                                                       C
C Special                                                               C
C considerations:   The size of the peak finding window is set to its   C
C                   default value unless it is specified by the user.   C
C-----------------------------------------------------------------------C

C     Common Variables

      REAL*4          CIN(30)
      REAL*4          COUT(0:15)
      REAL*4          CUMDF(0:15)
      INTEGER*4       N

      COMMON/DATA/CIN,CUMDF
      COMMON/PEAK/COUT
      COMMON/WINDOW/N
```

```
C       Input Variables

        INTEGER*4   NT

C       Local variables

        REAL*4      CSM(30)          ! Averaged values
        INTEGER*4   NM1
        INTEGER*4   NP12
        INTEGER*4   NTT

        F=100.
        NM1=(N-1)/2
        NP12=(N+1)/2
        NTT=NT+NP12

        DO 10 I=1,NTT+NP12
        CSM(I)=CIN(I)
10      CONTINUE

C------AVERAGING

        S=0.0                    ! THE RESULT AT NP12
        DO 20 I=1,N
        S=S+(CIN(I))/N
20      CONTINUE
        CSM(NP12)=S


        DO 30 I=N+1,NTT+NP12       ! RESULT AT OTHER POINTS
        S=S+(CIN(I))/N
        K=I-N
        S=S-(CIN(K))/N
        K=I-NM1
        CSM(K)=S
30      CONTINUE

C------FORMING THE PEAK FINDING SIGNAL

        DO 40 I=1,NT
        K=I+NP12
        I1=I-1
        COUT(I1)=F*(CIN(K)-CSM(K))
40      CONTINUE


        RETURN
        END

C-----------------------------------------------------------------------C
            SUBROUTINE PKFIND(SIGNAL,NT,NCRSS  ,KCOUNT,NS,NE,NM,NX)
C-----------------------------------------------------------------------C
C                                                                       C
C       Purpose : To use the peak detection signal computed at PRAMID   C
C                 in finding peaks of the signal stored in SIGNAL.      C
C                 Peaks are characterized by their Start and End points.C
C                 The mean value of signal within each peak is also     C
C                 determined. Peaks whose supports include crossover    C
C                 detectors are also identified.                        C
C                                                                       C
C       Author  : M. Ibrahim Sezan                                      C
C                 Research Laboratories, Eastman Kodak Company          C
C                 October 14,1985                                       C
C                                                                       C
C Modifications : None                                                  C
C                                                                       C
C                                                                       C
C  Detailed                                                             C
C   description : Peaks are determined from the peak finding signal as  C
C                 follows:                                              C
C                 . The point at which the peak finding signal crosses  C
C                   zero from positive to negative values is the START  C
C                   of the peak. The crossings from negative to         C
C                   positive values determines the point at which the   C
C                   peak MAXIMUM is attained (we don't use the maximum  C
C                   point in this particular application). The point    C
C                   at which the local maximum is reached between two   C
C                   positive-to-negative zero crossings is defined to   C
C                   be the END point of the peak.                       C
C                                                                       C
C-----------------------------------------------------------------------C
```

```
C       Common Variables

        REAL*4        CIN(30)
        REAL*4        COUT(0:15)
        REAL*4        CUMDF(0:15)
        INTEGER*4     N

        COMMON/DATA/CIN,CUMDF
        COMMON/PEAK/COUT
        COMMON/WINDOW/N
        COMMON/RESULT/LRES

C       Input Variables

        INTEGER*4     NCRSS(2)          ! Coordinates of crossover detectors
                                        ! For vertical arrays VCRSS->NCRSS
                                        ! For horizontal arrays HCRSS->NCRSS
        INTEGER*4     NT                ! # of detectors in the linear array
        INTEGER*4     SIGNAL(0:15)      ! Input signal

C       Output variables

        INTEGER*4     KCOUNT            ! # of peaks
        INTEGER*4     NE(15)            ! End point of peaks
        INTEGER*4     NS(15)            ! Start point of peaks
        REAL*4        NM(15)            ! Signal mean within peaks
        INTEGER*4     NX(2)             ! Indicator for peaks over crossover
                                        ! detectors. NX(1)=J, Jth peak is over
                                        ! the 1st crossover detector of the
                                        ! linear array (upper in the case of
                                        ! vertical arrays; leftmost in the case of
                                        ! horizontal arrays). NX(2) refers to the
                                        ! other crossover detector. If NX=0, then
                                        ! there is no peak over the crossover
                                        ! detector.


        CMAX=0.0
        K=0
        I=0
        NSTOP=NT

10      IF(I.LT.NSTOP) GO TO 20
        NE(K)=MAXIN
        GO TO 25

20      IF(COUT(I).GT.0.0) THEN
!!max!!
            IF(COUT(I).GT.CMAX) THEN

              CMAX=COUT(I)
              MAXIN=I
              I=I+1
              GO TO 10

            ELSE

              I=I+1
              GO TO 10

            END IF


        ELSE

          IF((COUT(I-1).GT.0.0).OR.(I.EQ.0)) THEN

              K=K+1                     ! NEXT PEAK ....
              KCOUNT=K                  ! UPDATE PEAK COUNTER
              NS(K)=I                   ! STARTING POINT OF THE
                                        ! PEAK

              IF(K.EQ.1) THEN           ! FIRST PEAK TREATED
                                        ! ACCORDINGLY ......
                 I=I+1
                 GO TO 10

              END IF

              NE(K-1)=MAXIN
              CMAX=0.0
              I=I+1
```

```
            IF(I.EQ.NSTOP) MAXIN=NSTOP        ! IF A 'START' OCCURS AT 1 CODE
                                              ! VALUE BEFORE THE STOPPING CODE
                                              ! VALUE, 'END' POINT IS TAKEN TO
                                              ! BE 'NSTOP'.

            GO TO 10

          ELSE

            I=I+1
            IF(I.EQ.NSTOP) MAXIN=NSTOP        ! 'NSTOP' IS REACHED WHEN THE
                                              ! DECISION SIGNAL WAS
                                              ! NEGATIVE SINCE THE LAST
                                              ! NEGATIVE CROSSOVER OCCURED
           GO TO 10

          END IF

        END IF

C------COMPUTE SIGNAL MEAN WITHIN PEAKS

25      DO 30 I=1,KCOUNT
        NSUM=0
        DO 35 J=NS(I),NE(I)
        NSUM=NSUM+SIGNAL(J)
35      CONTINUE
        IEX=NE(I)-NS(I)+1
        NM(I)=FLOATJ(NSUM)/FLOATJ(IEX)

30      CONTINUE

C------PRINT OUT THE PEAKS (START,END; MAXIMUM)

        WRITE(LRES,500)N
500     FORMAT(2X,'**** WINDOW SIZE : ',I4,//)
        WRITE(LRES,750)
750     FORMAT(10X,'** PEAKS DETECTED:
     +  (START,END; SIGNAL MEAN WITHIN) **',//)

        DO 40 I=1,KCOUNT
        WRITE(LRES,1000)NS(I),NE(I),NM(I)
1000    FORMAT(/,20X,I4,',',I4,';',F9.2,//)
40      CONTINUE

C------IDENTIFY THE PEAKS OVER CROSSOVER DETECTORS

        DO 45 J=1,2
        NX(J)=0
45      CONTINUE

        DO 50 I=1,KCOUNT                      ! 1st CROSSOVER DETECTOR
        IF((NS(I).LE.NCRSS(1)).AND.(NE(I).GE.NCRSS(1))) THEN
        NX(1)=I
        END IF
50      CONTINUE

        DO 60 I=1,KCOUNT                      ! 2nd CROSSOVER DETECTOR
        IF((NS(I).LE.NCRSS(2)).AND.(NE(I).GE.NCRSS(2))) THEN
        NX(2)=I
        END IF

60      CONTINUE

        WRITE(LRES,1750)
1750    FORMAT(10X,'** PEAKS OVER THE CROSSOVER DETECTORS **',//)

        DO 70 I=1,2
        WRITE(LRES,2000)I, NX(I)
2000    FORMAT(/,20X,'DETECTOR No.',I2,':',4X,'PEAK No.',I2,//)
70      CONTINUE

        RETURN
        END

C-----------------------------------------------------------------------C
        SUBROUTINE CROSS(VL_IX,VR_IX,HT_IX,HB_IX, LTOP,RTOP,RBOT,LBOT)
C-----------------------------------------------------------------------C
C                                                                       C
C       Purpose : To identify crossing peaks over crossover detectors.  C
C                                                                       C
C       Author  : M. Ibrahim Sezan                                      C
C                 Research Laboratories, Eastman Kodak Company          C
C                 August 16, 1988                                       C
```

```
C Modifications : None                                                  C
C                                                                       C
C                                                                       C
C  Detailed                                                             C
C   description :     LTOP              RTOP                            C
C                       \  |          |  /                              C
C                          |          |                                 C
C                       - - + - - - - + - -                             C
C                          |          |                                 C
C                       - - + - - - - + - -                             C
C                          |          |                                 C
C                       /  |          |  \                              C
C                     LBOT               RBOT                          C
C                                                                       C
C                                                                       C
C                                                                       C
C                  Indicators LTOP, RTOP, RBOT and LBOT refer to shown  C
C                  crossover detectors. If there are crossing peaks     C
C                  on the crossover detector, its indicator is set to 1;C
C                  otherwise it is set to 0, e.g., LBOT=1, RBOT=1,      C
C                  LTOP=0, RTOP=0 indicates crossing peaks at the       C
C                  bottom crossover detectors.                          C
C                                                                       C
C-----------------------------------------------------------------------C

C       Common Variables

        INTEGER*4   LRES

        COMMON/RESULT/LRES

C       Input Variables

        INTEGER*4           HB_IX(2)      ! Indicator for peaks of HBOT
        INTEGER*4           HT_IX(2)      ! Indicator for peaks of HTOP
        INTEGER*4           VL_IX(2)      ! Indicator for peaks of VLEFT
        INTEGER*4           VR_IX(2)      ! Indicator for peaks of VRIGHT


C       Output Variables

        INTEGER*4           LBOT          ! LBOT=1 if there are crossing peaks
                                          ! on left bottom crossover detector
                                          !(i.e., where VLEFT and HBOT intersect)
                                          ! otherwise LBOT=0
        INTEGER*4           LTOP          ! LTOP=1 if there are crossing peaks
                                          ! on left top crossover detector
                                          !(i.e., where VLEFT and HTOP intersect)
                                          ! otherwise LTOP=0
        INTEGER*4           RBOT          ! RBOT=1 if there are crossing peaks
                                          ! on right bottom crossover detector
                                          !(i.e.,where VRIGHT and HBOT intersect
                                          ! otherwise RBOT=0
        INTEGER*4           RTOP          ! RTOP=1 if there are crossing peaks
                                          ! on right top crossover detector
                                          !(i.e.,where VRIGHT and HTOP intersect)
                                          ! otherwise RTOP=0


C------INITIALIZE INDICATORS

        LTOP=0
        RTOP=0
        RBOT=0
        LBOT=0

C------DETERMINE INDICES OF CROSSING PEAKS AND SET THE INDICATOR VALUES
C      ACCORDINGLY

        IF( (VL_IX(1).NE.0).AND.(HT_IX(1).NE.0) ) LTOP=1
        IF( (VR_IX(1).NE.0).AND.(HT_IX(2).NE.0) ) RTOP=1
        IF( (VR_IX(2).NE.0).AND.(HB_IX(2).NE.0) ) RBOT=1
        IF( (VL_IX(2).NE.0).AND.(HB_IX(1).NE.0) ) LBOT=1

C------PRINT OUT THE INFORMATION
        WRITE(LRES,*)' '
        WRITE(LRES,*)'THE RESULTING CONFIGURATION AND EXPOSURE ESTIMATE'
        WRITE(LRES,*)'==============================================='
        WRITE(LRES,1000)
1000    FORMAT(///,10X,'---->>> THE DETECTORS WITH CROSSING PEAKS :',//)

        WRITE(LRES,1100)LTOP,RTOP
1100    FORMAT(/,20X,'LTOP=',I2,5X,'RTOP=',I2,/////)
```

```
      WRITE(LRES,1200)LBOT,RBOT
1200  FORMAT(/,20X,'LBOT=',I2,5X,'RBOT=',I2,//)

      RETURN
      END
C-----------------------------------------------------------------------C
      SUBROUTINE CASENO(LTOP,RTOP,RBOT,LBOT, NCASE)
C-----------------------------------------------------------------------C
C                                                                       C
C     Purpose : To identify the case number: 16 cases are possible      C
C                                                                       C
C     Author  : M. Ibrahim Sezan                                        C
C               Research Laboratories, Eastman Kodak Company            C
C               August 16, 1988                                         C
C                                                                       C
C Modifications : None                                                  C
C                                                                       C
C                                                                       C
C  Detailed                                                             C
C   description :                                                       C
C                                                                       C
C                          POSSIBLE CASES:                              C
C                                                                       C
C ( X's denote crossover detectors over which crossover peaks exist)    C
C                                                                       C
C                CASE #1                    CASE #2                    C
C                                                                       C
C            |       |                  |       |                      C
C            |       |                  |       |                      C
C        - - X - - - X - -          - - X - - - X - -                  C
C            |       |                  |       |                      C
C        - - + - - - + - -          - - + - - - X - -                  C
C            |       |                  |       |                      C
C*************************************************************************C
C                CASE #3                    CASE #4                    C
C                                                                       C
C            |       |                  |       |                      C
C            |       |                  |       |                      C
C        - - X - - - X - -          - - X - - - X - -                  C
C            |       |                  |       |                      C
C        - - X - - - + - -          - - X - - - X - -                  C
C            |       |                  |       |                      C
C*************************************************************************C
C                CASE #5                    CASE #6                    C
C                                                                       C
C            |       |                  |       |                      C
C            |       |                  |       |                      C
C        - - + - - - X - -          - - + - - - X - -                  C
C            |       |                  |       |                      C
C        - - + - - - X - -          - - X - - - X - -                  C
C            |       |                  |       |                      C
C*************************************************************************C
C                CASE #7                    CASE #8                    C
C                                                                       C
C            |       |                  |       |                      C
C            |       |                  |       |                      C
C        - - + - - - + - -          - - X - - - + - -                  C
C            |       |                  |       |                      C
C        - - X - - - X - -          - - X - - - X - -                  C
C            |       |                  |       |                      C
C*************************************************************************C
C                CASE #9                    CASE #10                   C
C                                                                       C
C            |       |                  |       |                      C
C            |       |                  |       |                      C
C        - - X - - - + - -          - - X - - - + - -                  C
C            |       |                  |       |                      C
C        - - X - - - + - -          - - + - - - X - -                  C
C            |       |                  |       |                      C
C*************************************************************************C
C                CASE #11                   CASE #12                   C
C                                                                       C
```

```
C              |       |               |       |                      C
C              |       |               |       |                      C
C          - - + - - - X - -       - - X - - - + - -                  C
C              |       |               |       |                      C
C          - - X - - - + - -       - - + - - - + - -                  C
C              |       |               |       |                      C
C              |       |               |       |                      C
C*********************************************************************C
C              CASE #13                CASE #14                       C
C              |       |               |       |                      C
C              |       |               |       |                      C
C          - - + - - - X - -       - - + - - - + - -                  C
C              |       |               |       |                      C
C          - - + - - - + - -       - - + - - - X - -                  C
C              |       |               |       |                      C
C              |       |               |       |                      C
C*********************************************************************C
C              CASE #15                CASE #16                       C
C              |       |               |       |                      C
C              |       |               |       |                      C
C          - - + - - - + - -       - - + - - - + - -                  C
C              |       |               |       |                      C
C          - - X - - - + - -       - - + - - - + - -                  C
C              |       |               |       |                      C
C              |       |               |       |                      C
C*********************************************************************C
C          Note that the cases #1,#5,#7,#9 are 'ideal' cases in the   C
C          sense that the orientation of the image (relative locations C
C          of the lung and mediastinal fields) can be determined      C
C          without ambiguity. In the process of estimating the        C
C          mediastinal exposure, the other cases may reduce to these  C
C          ideal cases under certain conditions. See SUBROUTINE CASEj , C
C          j=1,2,...,16.                                              C
C---------------------------------------------------------------------C

C       Common Variables

        INTEGER*4           LRES

        COMMON/RESULT/LRES

C       Input Variables

        INTEGER*4           LBOT        ! LBOT=1 if there are crossing peaks
                                        ! on left bottom crossover detector
                                        !(i.e., where VLEFT and HBOT intersect)
                                        ! otherwise LBOT=0
        INTEGER*4           LTOP        ! LTOP=1 if there are crossing peaks
                                        ! on left top crossover detector
                                        !(i.e., where VLEFT and HTOP intersect)
                                        ! otherwise LTOP=0
        INTEGER*4           RBOT        ! RBOT=1 if there are crossing peaks
                                        ! on right bottom crossover detector
                                        !(i.e.,where VRIGHT and HBOT intersect
                                        ! otherwise RBOT=0
        INTEGER*4           RTOP        ! RTOP=1 if there are crossing peaks
                                        ! on right top crossover detector
                                        !(i.e.,where VRIGHT and HTOP intersect)
                                        ! otherwise RTOP=0

C       Output Variables

        INTEGER*4           NCASE       ! Case #: (1-->16) 16 different cases

1000    FORMAT(/,20X,'====>>>> CASE # =',I2,//)

        IF( (LTOP.EQ.1).AND.(RTOP.EQ.1) ) THEN

            IF( (LBOT.EQ.0).AND.(RBOT.EQ.0) ) THEN
            NCASE=1
            WRITE(LRES,1000)NCASE
            RETURN
            END IF
```

```
    IF( (RBOT.EQ.1).AND.(LBOT.EQ.0) ) THEN
    NCASE=2
    WRITE(LRES,1000)NCASE
    RETURN
    END IF

    IF( (RBOT.EQ.0).AND.(LBOT.EQ.1) ) THEN
    NCASE=3
    WRITE(LRES,1000)NCASE
    RETURN
    END IF

    IF( (RBOT.EQ.1).AND.(LBOT.EQ.1) ) THEN
    NCASE=4
    WRITE(LRES,1000)NCASE
    RETURN
    END IF

IF( (RTOP.EQ.1).AND.(RBOT.EQ.1) ) THEN

    IF( (LTOP.EQ.0).AND.(LBOT.EQ.0) ) THEN
    NCASE=5
    WRITE(LRES,1000)NCASE
    RETURN
    END IF

    IF( (LTOP.EQ.0).AND.(LBOT.EQ.1) ) THEN
    NCASE=6
    WRITE(LRES,1000)NCASE
    RETURN
    END IF

    IF( (LTOP.EQ.1).AND.(LBOT.EQ.0) ) THEN
    NCASE=2
    WRITE(LRES,1000)NCASE
    RETURN
    END IF

    IF( (LTOP.EQ.1).AND.(LBOT.EQ.1) ) THEN
    NCASE=4
    WRITE(LRES,1000)NCASE
    RETURN
    END IF

END IF

IF( (RBOT.EQ.1).AND.(LBOT.EQ.1) ) THEN

    IF( (RTOP.EQ.0).AND.(LTOP.EQ.0) ) THEN
    NCASE=7
    WRITE(LRES,1000)NCASE
    RETURN
    END IF

    IF( (RTOP.EQ.1).AND.(LTOP.EQ.0) ) THEN
    NCASE=6
    WRITE(LRES,1000)NCASE
    RETURN
    END IF

    IF( (RTOP.EQ.0).AND.(LTOP.EQ.1) ) THEN
    NCASE=8
    WRITE(LRES,1000)NCASE
    RETURN
    END IF

    IF( (RTOP.EQ.1).AND.(LTOP.EQ.1) ) THEN
    NCASE=4
    WRITE(LRES,1000)NCASE
    RETURN
    END IF

END IF

IF( (LTOP.EQ.1).AND.(LBOT.EQ.1) ) THEN

    IF( (RTOP.EQ.0).AND.(RBOT.EQ.0)) THEN
    NCASE=9
    WRITE(LRES,1000)NCASE
    RETURN
    END IF
```

```
      IF( (RTOP.EQ.1).AND.(RBOT.EQ.0)) THEN
      NCASE=3
      WRITE(LRES,1000)NCASE
      RETURN
      END IF

      IF( (RTOP.EQ.0).AND.(RBOT.EQ.1)) THEN
      NCASE=8
      WRITE(LRES,1000)NCASE
      RETURN
      END IF

      IF( (RTOP.EQ.1).AND.(RBOT.EQ.1)) THEN
      NCASE=4
      WRITE(LRES,1000)NCASE
      RETURN
      END IF

  END IF

    IF( (LTOP.EQ.1).AND.(RTOP.EQ.0) ) THEN
        IF( (RBOT.EQ.1).AND.(LBOT.EQ.0) ) THEN
        NCASE=10
        WRITE(LRES,1000) NCASE
        RETURN
        END IF
    END IF

    IF( (LTOP.EQ.0).AND.(RTOP.EQ.1) ) THEN
        IF( (RBOT.EQ.0).AND.(LBOT.EQ.1) ) THEN
        NCASE=11
        WRITE(LRES,1000)NCASE
        RETURN
        END IF
    END IF

    IF( (LTOP.EQ.1).AND.(RTOP.EQ.0) ) THEN
        IF( (RBOT.EQ.0).AND.(LBOT.EQ.0) ) THEN
        NCASE=12
        WRITE(LRES,1000)NCASE
        RETURN
        END IF
    END IF

    IF( (LTOP.EQ.0).AND.(RTOP.EQ.1) ) THEN
        IF( (RBOT.EQ.0).AND.(LBOT.EQ.0) ) THEN
        NCASE=13
        WRITE(LRES,1000)NCASE
        RETURN
        END IF
    END IF

    IF( (LTOP.EQ.0).AND.(RTOP.EQ.0) ) THEN
        IF( (RBOT.EQ.1).AND.(LBOT.EQ.0) ) THEN
        NCASE=14
        WRITE(LRES,1000)NCASE
        RETURN
        END IF
    END IF

    IF( (LTOP.EQ.0).AND.(RTOP.EQ.0) ) THEN
        IF( (RBOT.EQ.0).AND.(LBOT.EQ.1) ) THEN
        NCASE=15
        WRITE(LRES,1000)NCASE
        RETURN
        END IF
    END IF

    IF( (LTOP.EQ.0).AND.(RTOP.EQ.0) ) THEN
        IF( (RBOT.EQ.0).AND.(LBOT.EQ.0) ) THEN
        NCASE=16
        WRITE(LRES,1000)NCASE
        END IF
    END IF

    RETURN
    END
```

```
C-----------------------------------------------------------------------C
        SUBROUTINE MINIMA(INPUT,I1,I2, MIN)
C-----------------------------------------------------------------------C
C                                                                       C
C       Purpose : To find the coordinate of the minimum of the array    C
C                 INPUT between coordinates I1 and I2                   C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : See the following code                                C
C-----------------------------------------------------------------------C

C     Input Variables

      INTEGER*4         INPUT(0:15)
      INTEGER*4         I1
      INTEGER*4         I2

C     Output Variables

      INTEGER*4         MIN

C----DETERMINE THE MINIMUM

      MIN=10000

      DO 10 I=I1,I2
      IF(INPUT(I).LE.MIN) MIN=INPUT(I)
10    CONTINUE

      RETURN
      END

C-----------------------------------------------------------------------C
        SUBROUTINE SORT(ARRAY,KDIM)
C-----------------------------------------------------------------------C
C                                                                       C
C       Purpose : In-place sorting of the elements of KDIM dimensional  C
C                 input array INPUT. At output INPUT(1) has the largest C
C                 largest.                                              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : See the following code                                C
C-----------------------------------------------------------------------C

C       Input Variables

        INTEGER*4     KDIM

C       Input/Output Variable

        REAL*4        ARRAY(KDIM)

C------SORTING BEGINS

        DO 10 K=KDIM,2,-1
        DO 20 I=1,K-1

        IF(ARRAY(I+1).GT.ARRAY(I)) THEN
        AUX=ARRAY(I+1)
        ARRAY(I+1)=ARRAY(I)
        ARRAY(I)=AUX
        END IF

20      CONTINUE
10      CONTINUE

        RETURN
        END
```

```
C-----------------------------------------------------------------------C
      SUBROUTINE CASE1(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #1              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #1                                               C
C                                                                       C
C  ( For pictorial illustration of CASE #1 see SUBROUTINE CASENO )      C
C                                                                       C
C    a = MIN [HTOP(HT_E(HT_IX(1)), HTOP(HT_S(HT_IX(2))))]               C
C                                                                       C
C    b = MIN [HBOT(HCRSS(1)), HBOT(HCRSS(2))]                           C
C                                              ==> E=(a+b)/2            C
C-----------------------------------------------------------------------C

C     Common Variables

      INTEGER*4            LRES
      COMMON/RESULT/LRES

C     Input Variables

        INTEGER*4            HBOT(0:15)    ! Horizontal bottom array data
        INTEGER*4            HCRSS(2)      ! Coordinates of crossover detectors
                                           ! of horizontal arrays
        INTEGER*4            HTOP(0:15)    ! Horizontal top array data

        INTEGER*4            VCRSS(2)      ! Coordinates of crossover detectors
                                           ! of vertical arrays
        INTEGER*4            VLEFT(0:15)   ! Vertical left array data
        INTEGER*4            VRIGHT(0:15)  ! Vertical right array data


        INTEGER*4            HB_S(15)      ! Starting points of peaks in HBOT
        INTEGER*4            HB_E(15)      ! End points of peaks in HBOT
        REAL*4               HB_M(15)      ! Mean signal values within the
                                           ! the peaks in HBOT
        INTEGER*4            HB_IX(2)      ! Indicator for peaks over crossover
                                           ! detectors, e.g., HB_IX(1)=j, ==>
                                           ! the extent of j th peak of HBOT
                                           ! includes the 1st (leftmost) crossover

                                           ! detector on HBOT

        INTEGER*4            HT_S(15)      ! Starting points of peaks in HTOP
        INTEGER*4            HT_E(15)      ! End points of peaks in HTOP
        REAL*4               HT_M(15)      ! Mean signal values within the
                                           ! the peaks in HTOP
        INTEGER*4            HT_IX(2)      ! Indicator for peaks over crossover
                                           ! detectors, e.g., HT_IX(2)=j, ==>
                                           ! the extent of j th peak of HTOP
                                           ! includes the 2nd (rightmost)
                                           ! crossover detector on HTOP


        INTEGER*4            VL_S(15)      ! Starting points of peaks in VLEFT
        INTEGER*4            VL_E(15)      ! End points of peaks in VLEFT
        REAL*4               VL_M(15)      ! Mean signal values within the
                                           ! the peaks in VLEFT
        INTEGER*4            VL_IX(2)      ! Indicator for peaks over crossover
                                           ! detectors, e.g., VL_IX(1)=j, ==>
                                           ! the extent of j th peak of VLEFT
                                           ! includes the 1st (upper) crossover
                                           ! detector on VLEFT


        INTEGER*4            VR_S(15)      ! Starting points of peaks in VRIGHT
        INTEGER*4            VR_E(15)      ! End points of peaks in VRIGHT
        REAL*4               VR_M(15)      ! Mean signal values within the
                                           ! the peaks in VRIGHT
        INTEGER*4            VR_IX(15)     ! Indicator for peaks over crossover
                                           ! detectors, e.g., VR_IX(2)=j, ==>
```

```
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''       ''    ''    ''    ''

1000  FORMAT(/,20X,'>>>> MEDIASTINAL EXPOSURE:',F7.2,//)

C------EXPOSURE COMPUTATION

      J1=HT_IX(1)
      I1=HT_E(J1)
      J2=HT_IX(2)
      I2=HT_S(J2)
      CALL MINIMA(HTOP,I1,I2, MIN1)
      I1=HCRSS(1)
      I2=HCRSS(2)
      CALL MINIMA(HBOT,I1,I2, MIN2)
      E=0.5*(FLOATJ(MIN1)+FLOATJ(MIN2))
      WRITE(LRES,1000) E
      RETURN
      END
C-----------------------------------------------------------------------C
      SUBROUTINE CASE2(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #2              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #2                                               C
C                                                                       C
C  ( For pictorial illustration of CASE #2 see SUBROUTINE CASENO )      C
C                                                                       C
C  LET A = [HT_M(HT_IX(1)) + VL_M(VL_IX(1))] /2                         C
C      B = [HT_M(HT_IX(2)) + VR_M(VR_IX(1))] /2                         C
C      C = [HB_M(HB_IX(2)) + VR_M(VR_IX(2))] /2                         C
C                                                                       C
C  SORT A,B,C ----> S1 > S2 > S3                                        C
C  IF ((S1=A,S2=B).OR.(S1=B,S2=A))  ==> same as CASE #1                 C
C  IF ((S1=B,S2=C).OR.(S1=C,S2=B))  ==> same as CASE #5                 C
C  Otherwise, anatomical consistency is not satisfied:                  C
C                                                                       C
C  LET a = MIN [HTOP(HT_E(HT_IX(1))), HTOP(HT_S(HT_IX(2)))]             C
C      b = MIN [VRIGHT(VR_E(VR_IX(1))), VRIGHT(VR_S(VR_IX(2)))]         C
C                                  ==> E = (a+b)/2                      C
C-----------------------------------------------------------------------C

C     Common Variables

      INTEGER*4          LRES
      COMMON/RESULT/LRES

C     Input Variables

        INTEGER*4        HBOT(0:15)    ! Horizontal bottom array data
        INTEGER*4        HCRSS(2)      ! Coordinates of crossover detectors
                                       ! of horizontal arrays
        INTEGER*4        HTOP(0:15)    ! Horizontal top array data

        INTEGER*4        VCRSS(2)      ! Coordinates of crossover detectors
                                       ! of vertical arrays
        INTEGER*4        VLEFT(0:15)   ! Vertical left array data
        INTEGER*4        VRIGHT(0:15)  ! Vertical right array data

        INTEGER*4        HB_S(15)      ! Starting points of peaks in HBOT
        INTEGER*4        HB_E(15)      ! End points of peaks in HBOT
        REAL*4           HB_M(15)      ! Mean signal values within the
                                       ! the peaks in HBOT
        INTEGER*4        HB_IX(2)      ! Indicator for peaks over crossover
                                       ! detectors, e.g., HB_IX(1)=j, ==>
                                       ! the extent of j th peak of HBOT
                                       ! includes the 1st (leftmost) crossover
```

```
                                        ! detector on HBOT

      INTEGER*4          HT_S(15)       ! Starting points of peaks in HTOP
      INTEGER*4          HT_E(15)       ! End points of peaks in HTOP
      REAL*4             HT_M(15)       ! Mean signal values within the
                                        ! the peaks in HTOP
      INTEGER*4          HT_IX(2)       ! Indicator for peaks over crossover
                                        ! detectors, e.g., HT_IX(2)=j, ==>
                                        ! the extent of j th peak of HTOP
                                        ! includes the 2nd (rightmost)
                                        ! crossover detector on HTOP


      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks In VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT


      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''        ''    ''    ''    ''

C     Local Variable

      REAL*4             WORK(4)        ! Work array used in sorting

1000  FORMAT(/,20X,'>>>> MEDIASTINAL EXPOSURE:',F7.2,//)


C------EXPOSURE COMPUTATION

      J1=HT_IX(1)
      J2=VL_IX(1)
      A=0.5*(HT_M(J1)+VL_M(J2))
      J1=HT_IX(2)
      J2=VR_IX(1)
      B=0.5*(HT_M(J1)+VR_M(J2))
      J1=HB_IX(2)
      J2=VR_IX(2)
      C=0.5*(HB_M(J1)+VR_M(J2))

      WORK(1)=A
      WORK(2)=B
      WORK(3)=C
      CALL SORT(WORK,3)
      IF( ((WORK(1).EQ.A).AND.(WORK(2).EQ.B)) .OR.
     +    ((WORK(1).EQ.B).AND.(WORK(2).EQ.A)) )   THEN
      WRITE(LRES,*)'---> THIS CASE REDUCED TO CASE #1..'
      CALL CASE1(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
      RETURN
      END IF

      IF( ((WORK(1).EQ.B).AND.(WORK(2).EQ.C)) .OR.
     +    ((WORK(1).EQ.C).AND.(WORK(2).EQ.B)) )   THEN
      WRITE(LRES,*)'--->THIS CASE REDUCED TO CASE #5..'
      CALL CASE5(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
      RETURN
      END IF

C------ANATOMICAL CONSISTENCY IS NOT SATISFIED

      J1=HT_IX(1)
      I1=HT_E(J1)
```

```
      J2=HT_IX(2)
      I2=HT_S(J2)
      CALL MINIMA(HTOP,I1,I2, MIN1)

      J1=VR_IX(1)
      I1=VR_E(J1)
      J2=VR_IX(2)
      I2=VR_S(J2)
      CALL MINIMA(VRIGHT,I1,I2, MIN2)

      E=0.5*(FLOATJ(MIN1)+FLOATJ(MIN2))
      WRITE(LRES,1000) E

      RETURN
      END
C-----------------------------------------------------------------------C
      SUBROUTINE CASE3(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #3              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #3                                               C
C                                                                       C
C  ( For pictorial illustration of CASE #3 see SUBROUTINE CASENO )      C
C                                                                       C
C  LET A = [HT_M(HT_IX(1)) + VL_M(VL_IX(1))] /2                         C
C      B = [HT_M(HT_IX(2)) + VR_M(VR_IX(1))] /2                         C
C      D = [HB_M(HB_IX(1)) + VL_M(VL_IX(2))] /2                         C
C                                                                       C
C  SORT A,B,D ----> S1 > S2 > S3                                        C
C  IF ((S1=A,S2=B).OR.(S1=B,S2=A))  ==> same as CASE #1                 C
C  IF ((S1=A,S2=D).OR.(S1=D,S2=A))  ==> same as CASE #9                 C
C  Otherwise, anatomical consistency is not satisfied:                  C
C                                                                       C
C  LET a = MIN [HTOP(HT_E(HT_IX(1))), HTOP(HT_S(HT_IX(2)))]             C
C      b = MIN [VLEFT(VL_E(VL_IX(1))), VLEFT(VL_S(VL_IX(2)))]           C
C                                  ==> E = (a+b)/2                      C
C-----------------------------------------------------------------------C

C     Common Variables

      INTEGER*4            LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data


        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover
                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
```

```
                                        ! detectors, e.g., HT_IX(2)=j, ==>
                                        ! the extent of j th peak of HTOP
                                        ! includes the 2nd (rightmost)
                                        ! crossover detector on HTOP

      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT

      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''      ''    ''    ''    ''

C     Local Variable

      REAL*4             WORK(4)        ! Work array used in sorting

1000  FORMAT(/,20X,'>>>> MEDIASTINAL EXPOSURE:',F7.2,//)


C------EXPOSURE COMPUTATION

      J1=HT_IX(1)
      J2=VL_IX(1)
      A=0.5*(HT_M(J1)+VL_M(J2))
      J1=HT_IX(2)
      J2=VR_IX(1)
      B=0.5*(HT_M(J1)+VR_M(J2))
      J1=HB_IX(1)
      J2=VL_IX(2)
      D=0.5*(HB_M(J1)+VL_M(J2))

      WORK(1)=A
      WORK(2)=B
      WORK(3)=D
      CALL SORT(WORK,3)
      IF( ((WORK(1).EQ.A).AND.(WORK(2).EQ.B)) .OR.
     +    ((WORK(1).EQ.B).AND.(WORK(2).EQ.A)) )   THEN
      WRITE(LRES,*)'---> THIS CASE REDUCED TO CASE #1..'
      CALL CASE1(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
      RETURN
      END IF

      IF( ((WORK(1).EQ.A).AND.(WORK(2).EQ.D)) .OR.
     +    ((WORK(1).EQ.D).AND.(WORK(2).EQ.A)) )   THEN
      WRITE(LRES,*)'---> THIS CASE REDUCED TO CASE #9..'
      CALL CASE9(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
      RETURN
      END IF

C------ANATOMICAL CONSISTENCY IS NOT SATISFIED

      J1=HT_IX(1)
      I1=HT_E(J1)
      J2=HT_IX(2)
      I2=HT_S(J2)
      CALL MINIMA(HTOP,I1,I2, MIN1)

      J1=VL_IX(1)
      I1=VL_E(J1)
      J2=VL_IX(2)
```

```
      I2=VL_S(J2)
      CALL MINIMA(VLEFT,I1,I2, MIN2)

      E=0.5*(FLOATJ(MIN1)+FLOATJ(MIN2))
      WRITE(LRES,1000) E
      RETURN
      END

C-----------------------------------------------------------------------C
      SUBROUTINE CASE4(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #4              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #4                                               C
C                                                                       C
C  ( For pictorial illustration of CASE #4 see SUBROUTINE CASENO )      C
C                                                                       C
C  LET A = [HT_M(HT_IX(1)) + VL_M(VL_IX(1))] /2                         C
C      B = [HT_M(HT_IX(2)) + VR_M(VR_IX(1))] /2                         C
C      C = [HB_M(HB_IX(2)) + VR_M(VR_IX(2))] /2                         C
C      D = [VL_M(VL_IX(2)) + HB_M(HB_IX(1))] /2                         C
C                                                                       C
C  SORT A,B,C,D ----> S1 > S2 > S3 > S4                                 C
C  IF ((S1=A,S2=B).OR.(S1=B,S2=A))  ==> same as CASE #1                 C
C  IF ((S1=B,S2=C).OR.(S1=C,S2=B))  ==> same as CASE #5                 C
C  IF ((S1=C,S2=D).OR.(S1=D,S2=C))  ==> same as CASE #7                 C
C  IF ((S1=A,S2=D).OR.(S1=D,S2=A))  ==> same as CASE #9                 C
C  Otherwise, anatomical consistency is not satisfied:                  C
C                                                                       C
C  LET a = MIN [HTOP(HT_E(HT_IX(1))), HTOP(HT_S(HT_IX(2)))]             C
C      b = MIN [VRIGHT(VR_E(VR_IX(1))), VRIGHT(VR_S(VR_IX(2)))]         C
C      c = MIN [HBOT(HB_E(HB_IX(1))), HBOT(HB_S(HB_IX(2)))]             C
C      d = MIN [VLEFT(VL_E(VL_IX(1))), VLEFT(VL_S(VL_IX(2)))]           C
C                                  ==> E = (a+b+c+d)/4                  C
C-----------------------------------------------------------------------C

C     Common Variables

      INTEGER*4            LRES
      COMMON/RESULT/LRES

C     Input Variables

        INTEGER*4            HBOT(0:15)    ! Horizontal bottom array data
        INTEGER*4            HCRSS(2)      ! Coordinates of crossover detectors
                                           ! of horizontal arrays
        INTEGER*4            HTOP(0:15)    ! Horizontal top array data

        INTEGER*4            VCRSS(2)      ! Coordinates of crossover detectors
                                           ! of vertical arrays
        INTEGER*4            VLEFT(0:15)   ! Vertical left array data
        INTEGER*4            VRIGHT(0:15)  ! Vertical right array data


        INTEGER*4            HB_S(15)      ! Starting points of peaks in HBOT
        INTEGER*4            HB_E(15)      ! End points of peaks in HBOT
        REAL*4               HB_M(15)      ! Mean signal values within the
                                           ! the peaks in HBOT
        INTEGER*4            HB_IX(2)      ! Indicator for peaks over crossover
                                           ! detectors, e.g., HB_IX(1)=j, ==>
                                           ! the extent of j th peak of HBOT
                                           ! includes the 1st (leftmost) crossover

                                           ! detector on HBOT

        INTEGER*4            HT_S(15)      ! Starting points of peaks in HTOP
        INTEGER*4            HT_E(15)      ! End points of peaks in HTOP
        REAL*4               HT_M(15)      ! Mean signal values within the
                                           ! the peaks in HTOP
        INTEGER*4            HT_IX(2)      ! Indicator for peaks over crossover
                                           ! detectors, e.g., HT_IX(2)=j, ==>
                                           ! the extent of j th peak of HTOP
```

```
                                        ! includes the 2nd (rightmost)
                                        ! crossover detector on HTOP

      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT

      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''        ''    ''    ''    ''
      INTEGER*4          MIN3           !  ''        ''    ''    ''    ''
      INTEGER*4          MIN4           !  ''        ''    ''    ''    ''

C     Local Variable

      REAL*4             WORK(4)        ! Work array used in sorting

1000  FORMAT(/,20X,'>>>> MEDIASTINAL EXPOSURE:',F7.2,//)


C------EXPOSURE COMPUTATION

      J1=HT_IX(1)
      J2=VL_IX(1)
      A=0.5*(HT_M(J1)+VL_M(J2))
      J1=HT_IX(2)
      J2=VR_IX(1)
      B=0.5*(HT_M(J1)+VR_M(J2))
      J1=HB_IX(2)
      J2=VR_IX(2)
      C=0.5*(HB_M(J1)+VR_M(J2))
      J1=VL_IX(2)
      J2=HB_IX(1)
      D=0.5*(VL_M(J1)+HB_M(J2))

      WORK(1)=A
      WORK(2)=B
      WORK(3)=C
      WORK(4)=D
      CALL SORT(WORK,4)

      IF( ((WORK(1).EQ.A).AND.(WORK(2).EQ.B)) .OR.
     +    ((WORK(1).EQ.B).AND.(WORK(2).EQ.A)) )   THEN
      WRITE(LRES,*)'---> THIS CASE REDUCED TO CASE #1..'
      CALL CASE1(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
      RETURN
      END IF

      IF( ((WORK(1).EQ.B).AND.(WORK(2).EQ.C)) .OR.
     +    ((WORK(1).EQ.C).AND.(WORK(2).EQ.B)) )   THEN
      WRITE(LRES,*)'---> THIS CASE REDUCED TO CASE #5..'
      CALL CASE5(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
      RETURN
      END IF

      IF( ((WORK(1).EQ.C).AND.(WORK(2).EQ.D)) .OR.
     +    ((WORK(1).EQ.D).AND.(WORK(2).EQ.C)) )   THEN
      WRITE(LRES,*)'---> THIS CASE REDUCED TO CASE #7..'
      CALL CASE7(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
```

```
      RETURN
      END IF

      IF( ((WORK(1).EQ.A).AND.(WORK(2).EQ.D)) .OR.
     +    ((WORK(1).EQ.D).AND.(WORK(2).EQ.A)) )   THEN
      WRITE(LRES,*)'---> THIS CASE REDUCED TO CASE#9..'
      CALL CASE9(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)

      RETURN
      END IF

C------ANATOMICAL CONSISTENCY IS NOT SATISFIED

      J1=HT_IX(1)
      I1=HT_E(J1)
      J2=HT_IX(2)
      I2=HT_S(J2)
      CALL MINIMA(HTOP,I1,I2, MIN1)

      J1=VR_IX(1)
      I1=VR_E(J1)
      J2=VR_IX(2)
      I2=VR_S(J2)
      CALL MINIMA(VRIGHT,I1,I2, MIN2)

      J1=HB_IX(1)
      I1=HB_E(J1)
      J2=HB_IX(2)
      I2=HB_S(J2)
      CALL MINIMA(HBOT,I1,I2, MIN3)


      J1=VL_IX(1)
      I1=VL_E(J1)
      J2=VL_IX(2)
      I2=VL_S(J2)
      CALL MINIMA(VLEFT,I1,I2, MIN4)

      E=0.25*(FLOATJ(MIN1)+FLOATJ(MIN2)+FLOATJ(MIN3)+FLOATJ(MIN4))
      WRITE(LRES,1000) E

      RETURN
      END
C-----------------------------------------------------------------------C
      SUBROUTINE CASE5(VLEFT,VRIGHT,HTOP,HBOT, VL_S,VL_E,VL_M,VL_IX,
     +                VR_S,VR_E,VR_M,VR_IX, HT_S,HT_E,HT_M,HT_IX,
     +                HB_S,HB_E,HB_M,HB_IX, VCRSS, HCRSS)
C-----------------------------------------------------------------------C
C                                                                       C
C       Purpose : To compute exposure estimate for CASE #5              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #5                                               C
C                                                                       C
C  ( For pictorial illustration of CASE #5 see SUBROUTINE CASENO )      C
C                                                                       C
C  LET                                                                  C
C      a = MIN [VRIGHT(VR_E(VR_IX(1))), VRIGHT(VR_S(VR_IX(2)))]         C
C      b = MIN [VLEFT(VCRSS(1)), VLEFT(VCRSS(2))]                       C
C                                  ==> E = (a+b)/2                      C
C-----------------------------------------------------------------------C

C     Common Variables

      INTEGER*4          LRES
      COMMON/RESULT/LRES

C     Input Variables

        INTEGER*4          HBOT(0:15)   ! Horizontal bottom array data
        INTEGER*4          HCRSS(2)     ! Coordinates of crossover detectors
                                        ! of horizontal arrays
        INTEGER*4          HTOP(0:15)   ! Horizontal top array data
```

```
      INTEGER*4          VCRSS(2)       ! Coordinates of crossover detectors
                                        ! of vertical arrays
      INTEGER*4          VLEFT(0:15)    ! Vertical left array data
      INTEGER*4          VRIGHT(0:15)   ! Vertical right array data


      INTEGER*4          HB_S(15)       ! Starting points of peaks in HBOT
      INTEGER*4          HB_E(15)       ! End points of peaks in HBOT
      REAL*4             HB_M(15)       ! Mean signal values within the
                                        ! the peaks in HBOT
      INTEGER*4          HB_IX(2)       ! Indicator for peaks over crossover
                                        ! detectors, e.g., HB_IX(1)=j, ==>
                                        ! the extent of j th peak of HBOT
                                        ! includes the 1st (leftmost) crossover

                                        ! detector on HBOT

      INTEGER*4          HT_S(15)       ! Starting points of peaks in HTOP
      INTEGER*4          HT_E(15)       ! End points of peaks in HTOP
      REAL*4             HT_M(15)       ! Mean signal values within the
                                        ! the peaks in HTOP
      INTEGER*4          HT_IX(2)       ! Indicator for peaks over crossover
                                        ! detectors, e.g., HT_IX(2)=j, ==>
                                        ! the extent of j th peak of HTOP
                                        ! includes the 2nd (rightmost)
                                        ! crossover detector on HTOP


      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT


      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT

      INTEGER*4          MIN1           ! Minimum value input from MINIMA
      INTEGER*4          MIN2           !  ''      ''    ''    ''    ''

1000  FORMAT(/,20X,'>>>> MEDIASTINAL EXPOSURE:',F7.2,//)


C------EXPOSURE COMPUTATION
      J1=VR_IX(1)
      I1=VR_E(J1)
      J2=VR_IX(2)
      I2=VR_S(J2)
      CALL MINIMA(VRIGHT,I1,I2, MIN1)

      I1=VCRSS(1)
      I2=VCRSS(2)
      CALL MINIMA(VLEFT,I1,I2, MIN2)

      E=0.5*(FLOATJ(MIN1)+FLOATJ(MIN2))
      WRITE(LRES,1000) E

      RETURN
      END
C-----------------------------------------------------------------------C
      SUBROUTINE CASE6(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #6              C
C                                                                       C
C       Author  : M. Ibrahim Sezan                                      C
```

```
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #6                                               C
C                                                                       C
C  ( For pictorial illustration of CASE #6 see SUBROUTINE CASENO )      C
C                                                                       C
C  LET                                                                  C
C      B = [HT_M(HT_IX(2)) + VR_M(VR_IX(1))] /2                         C
C      C = [HB_M(HB_IX(2)) + VR_M(VR_IX(2))] /2                         C
C      D = [VL_M(VL_IX(2)) + HB_M(HB_IX(1))] /2                         C
C                                                                       C
C  SORT B,C,D ----> S1 > S2 > S3                                        C
C  IF ((S1=B,S2=C).OR.(S1=C,S2=B))  ==> same as CASE #5                 C
C  IF ((S1=C,S2=D).OR.(S1=D,S2=C))  ==> same as CASE #7                 C
C  Otherwise, anatomical consistency is not satisfied:                  C
C                                                                       C
C  LET                                                                  C
C      a = MIN [VRIGHT(VR_E(VR_IX(1))), VRIGHT(VR_S(VR_IX(2)))]         C
C      b = MIN [HBOT(HB_E(HB_IX(1))), HBOT(HB_S(HB_IX(2)))]             C
C                                  ==> E = (a+b)/2                      C
C-----------------------------------------------------------------------C

C     Common Variables

      INTEGER*4            LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP

        INTEGER*4          VL_S(15)      ! Starting points of peaks in VLEFT
        INTEGER*4          VL_E(15)      ! End points of peaks in VLEFT
        REAL*4             VL_M(15)      ! Mean signal values within the
                                         ! the peaks in VLEFT
        INTEGER*4          VL_IX(2)      ! Indicator for peaks over crossover
                                         ! detectors, e.g., VL_IX(1)=j, ==>
                                         ! the extent of j th peak of VLEFT
                                         ! includes the 1st (upper) crossover
                                         ! detector on VLEFT

        INTEGER*4          VR_S(15)      ! Starting points of peaks in VRIGHT
        INTEGER*4          VR_E(15)      ! End points of peaks in VRIGHT
        REAL*4             VR_M(15)      ! Mean signal values within the
                                         ! the peaks in VRIGHT
        INTEGER*4          VR_IX(15)     ! Indicator for peaks over crossover
```

```
                                        ! detectors, e.g., VR_IX(2)=j, ==>
                                        ! the extent of j th peak of VRIGHT
                                        ! includes the 2nd (lower) crossover
                                        ! detector on VRIGHT
        INTEGER*4          MIN1         ! Minimum value input from MINIMA
        INTEGER*4          MIN2         !  ''      ''    ''    ''    ''

C       Local Variable

        REAL*4             WORK(4)      ! Work array used in sorting

1000    FORMAT(/,20X,'>>>> MEDIASTINAL EXPOSURE:',F7.2,//)


C------EXPOSURE COMPUTATION

        J1=HT_IX(2)
        J2=VR_IX(1)
        B=0.5*(HT_M(J1)+VR_M(J2))
        J1=HB_IX(2)
        J2=VR_IX(2)
        C=0.5*(HB_M(J1)+VR_M(J2))
        J1=VL_IX(2)
        J2=HB_IX(1)
        D=0.5*(VL_M(J1)+HB_M(J2))

        WORK(1)=B
        WORK(2)=C
        WORK(3)=D
        CALL SORT(WORK,3)

        IF( ((WORK(1).EQ.B).AND.(WORK(2).EQ.C)) .OR.
     +      ((WORK(1).EQ.C).AND.(WORK(2).EQ.B)) )   THEN
        WRITE(LRES,*)'---> THIS CASE REDUCED TO CASE #5..'
        CALL CASE5(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
        RETURN
        END IF

        IF( ((WORK(1).EQ.C).AND.(WORK(2).EQ.D)) .OR.
     +      ((WORK(1).EQ.D).AND.(WORK(2).EQ.C)) )   THEN
        WRITE(LRES,*)'---> THIS CASE REDUCED TO CASE #7..'
        CALL CASE7(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
        RETURN
        END IF

C------ANATOMICAL CONSISTENCY IS NOT SATISFIED


        J1=VR_IX(1)
        I1=VR_E(J1)
        J2=VR_IX(2)
        I2=VR_S(J2)
        CALL MINIMA(VRIGHT,I1,I2, MIN1)

        J1=HB_IX(1)
        I1=HB_E(J1)
        J2=HB_IX(2)
        I2=HB_S(J2)
        CALL MINIMA(HBOT,I1,I2, MIN2)

        E=0.5*(FLOATJ(MIN1)+FLOATJ(MIN2))
        WRITE(LRES,1000) E

        RETURN
        END

C-----------------------------------------------------------------------C
        SUBROUTINE CASE7(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #7              C
C                                                                       C
C       Author  : M. Ibrahim Sezan                                      C
C                 Research Laboratories, Eastman Kodak Company          C
C                 August 16, 1988                                       C
C                                                                       C
```

```
C Modifications : None                                                  C
C                                                                       C
C                                                                       C
C  Detailed                                                             C
C   description : CASE #7                                               C
C                                                                       C
C  ( For pictorial illustration of CASE #7 see SUBROUTINE CASENO )      C
C                                                                       C
C  LET                                                                  C
C      a = MIN [HBOT(HB_E(HB_IX(1))), HBOT(HB_S(HB_IX(2)))]             C
C      b = MIN [HTOP(HCRSS(1)), HTOP(HCRSS(2))]                         C
C                                  ==> E = (a+b)/2                      C
C-----------------------------------------------------------------------C

C     Common Variables

      INTEGER*4          LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP


        INTEGER*4          VL_S(15)      ! Starting points of peaks in VLEFT
        INTEGER*4          VL_E(15)      ! End points of peaks in VLEFT
        REAL*4             VL_M(15)      ! Mean signal values within the
                                         ! the peaks in VLEFT
        INTEGER*4          VL_IX(2)      ! Indicator for peaks over crossover
                                         ! detectors, e.g., VL_IX(1)=j, ==>
                                         ! the extent of j th peak of VLEFT
                                         ! includes the 1st (upper) crossover
                                         ! detector on VLEFT


        INTEGER*4          VR_S(15)      ! Starting points of peaks in VRIGHT
        INTEGER*4          VR_E(15)      ! End points of peaks in VRIGHT
        REAL*4             VR_M(15)      ! Mean signal values within the
                                         ! the peaks in VRIGHT
        INTEGER*4          VR_IX(15)     ! Indicator for peaks over crossover
                                         ! detectors, e.g., VR_IX(2)=j, ==>
                                         ! the extent of j th peak of VRIGHT
                                         ! includes the 2nd (lower) crossover
                                         ! detector on VRIGHT

        INTEGER*4          MIN1          ! Minimum value input from MINIMA
        INTEGER*4          MIN2          !  ''      ''    ''    ''    ''

1000    FORMAT(/,20X,'>>>> MEDIASTINAL EXPOSURE:',F7.2,//)
```

```
C------EXPOSURE COMPUTATION
        J1=HB_IX(1)
        I1=HB_E(J1)
        J2=HB_IX(2)
        I2=HB_S(J2)
        CALL MINIMA(HBOT,I1,I2, MIN1)

        I1=HCRSS(1)
        I2=HCRSS(2)
        CALL MINIMA(HTOP,I1,I2, MIN2)

        E=0.5*(FLOATJ(MIN1)+FLOATJ(MIN2))
        WRITE(LRES,1000) E

        RETURN
        END

C-----------------------------------------------------------------------C
        SUBROUTINE CASE8(VLEFT,VRIGHT,HTOP,HBOT, VL_S,VL_E,VL_M,VL_IX,
     +                   VR_S,VR_E,VR_M,VR_IX, HT_S,HT_E,HT_M,HT_IX,
     +                   HB_S,HB_E,HB_M,HB_IX, VCRSS, HCRSS)
C-----------------------------------------------------------------------C
C                                                                       C
C       Purpose : To compute exposure estimate for CASE #8              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #8                                               C
C                                                                       C
C  ( For pictorial illustration of CASE #8 see SUBROUTINE CASENO )      C
C                                                                       C
C  LET A = [HT_M(HT_IX(1)) + VL_M(VL_IX(1))] /2                         C
C      C = [HB_M(HB_IX(2)) + VR_M(VR_IX(2))] /2                         C
C      D = [VL_M(VL_IX(2)) + HB_M(HB_IX(1))] /2                         C
C                                                                       C
C  SORT A,C,D ----> S1 > S2 > S3                                        C
C  IF ((S1=C,S2=D).OR.(S1=D,S2=C))  ==> same as CASE #7                 C
C  IF ((S1=A,S2=D).OR.(S1=D,S2=A))  ==> same as CASE #9                 C
C  Otherwise, anatomical consistency is not satisfied:                  C
C                                                                       C
C  LET                                                                  C
C      a = MIN [HBOT(HB_E(HB_IX(1))), HBOT(HB_S(HB_IX(2)))]             C
C      b = MIN [VLEFT(VL_E(VL_IX(1))), VLEFT(VL_S(VL_IX(2)))]           C
C                                  ==> E = (a+b)/2                      C
C-----------------------------------------------------------------------C

C     Common Variables

      INTEGER*4            LRES
      COMMON/RESULT/LRES

C     Input Variables

        INTEGER*4            HBOT(0:15)    ! Horizontal bottom array data
        INTEGER*4            HCRSS(2)      ! Coordinates of crossover detectors
                                           ! of horizontal arrays
        INTEGER*4            HTOP(0:15)    ! Horizontal top array data

        INTEGER*4            VCRSS(2)      ! Coordinates of crossover detectors
                                           ! of vertical arrays
        INTEGER*4            VLEFT(0:15)   ! Vertical left array data
        INTEGER*4            VRIGHT(0:15)  ! Vertical right array data

        INTEGER*4            HB_S(15)      ! Starting points of peaks in HBOT
        INTEGER*4            HB_E(15)      ! End points of peaks in HBOT
        REAL*4               HB_M(15)      ! Mean signal values within the
                                           ! the peaks in HBOT
        INTEGER*4            HB_IX(2)      ! Indicator for peaks over crossover
                                           ! detectors, e.g., HB_IX(1)=j, ==>
                                           ! the extent of j th peak of HBOT
                                           ! includes the 1st (leftmost) crossover
                                           ! detector on HBOT

        INTEGER*4            HT_S(15)      ! Starting points of peaks in HTOP
        INTEGER*4            HT_E(15)      ! End points of peaks in HTOP
        REAL*4               HT_M(15)      ! Mean signal values within the
```

```
                                        ! the peaks in HTOP
      INTEGER*4          HT_IX(2)       ! Indicator for peaks over crossover
                                        ! detectors, e.g., HT_IX(2)=j, ==>
                                        ! the extent of j th peak of HTOP
                                        ! includes the 2nd (rightmost)
                                        ! crossover detector on HTOP


      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT


      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''      ''    ''    ''    ''

C     Local Variable

      REAL*4             WORK(4)        ! Work array used in sorting

1000  FORMAT(/,20X,'>>>> MEDIASTINAL EXPOSURE:',F7.2,//)


C------EXPOSURE COMPUTATION

      J1=HT_IX(1)
      J2=VL_IX(1)
      A=0.5*(HT_M(J1)+VL_M(J2))
      J1=HB_IX(2)
      J2=VR_IX(2)
      C=0.5*(HB_M(J1)+VR_M(J2))
      J1=VL_IX(2)
      J2=HB_IX(1)
      D=0.5*(VL_M(J1)+HB_M(J2))

      WORK(1)=A
      WORK(2)=C
      WORK(3)=D
      CALL SORT(WORK,3)
      IF( ((WORK(1).EQ.C).AND.(WORK(2).EQ.D)) .OR.
     +    ((WORK(1).EQ.D).AND.(WORK(2).EQ.C)) )   THEN
      WRITE(LRES,*)'---> THIS CASE REDUCED TO CASE #7..'
      CALL CASE7(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
      RETURN
      END IF

      IF( ((WORK(1).EQ.A).AND.(WORK(2).EQ.D)) .OR.
     +    ((WORK(1).EQ.D).AND.(WORK(2).EQ.A)) )   THEN
      WRITE(LRES,*)'---> THIS CASE REDUCED TO CASE #9..'
      CALL CASE9(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)

      RETURN
      END IF

C------ANATOMICAL CONSISTENCY IS NOT SATISFIED


      J1=HB_IX(1)
      I1=HB_E(J1)
      J2=HB_IX(2)
      I2=HB_S(J2)
      CALL MINIMA(HBOT,I1,I2, MIN1)
```

```
      J1=VL_IX(1)
      I1=VL_E(J1)
      J2=VL_IX(2)
      I2=VL_S(J2)
      CALL MINIMA(VLEFT,I1,I2, MIN2)

      E=0.5*(FLOATJ(MIN1)+FLOATJ(MIN2))
      WRITE(LRES,1000) E

      RETURN
      END

C-----------------------------------------------------------------------C
      SUBROUTINE CASE9(VLEFT,VRIGHT,HTOP,HBOT, VL_S,VL_E,VL_M,VL_IX,
     +                 VR_S,VR_E,VR_M,VR_IX, HT_S,HT_E,HT_M,HT_IX,
     +                 HB_S,HB_E,HB_M,HB_IX, VCRSS, HCRSS)
C-----------------------------------------------------------------------C
C                                                                       C
C       Purpose : To compute exposure estimate for CASE #9              C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #9                                               C
C                                                                       C
C  ( For pictorial illustration of CASE #9 see SUBROUTINE CASENO )      C
C                                                                       C
C  LET                                                                  C
C      a = MIN [VLEFT(VL_E(VL_IX(1))), VLEFT(VL_S(VL_IX(2)))]           C
C      b = MIN [VRIGHT(VCRSS(1)), VRIGHT(VCRSS(2))]                     C
C                                  ==> E = (a+b)/2                      C
C-----------------------------------------------------------------------C

C     Common Variables

      INTEGER*4          LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP

        INTEGER*4          VL_S(15)      ! Starting points of peaks in VLEFT
        INTEGER*4          VL_E(15)      ! End points of peaks in VLEFT
        REAL*4             VL_M(15)      ! Mean signal values within the
                                         ! the peaks in VLEFT
        INTEGER*4          VL_IX(2)      ! Indicator for peaks over crossover
                                         ! detectors, e.g., VL_IX(1)=j, ==>
```

```
                                        ! the extent of j th peak of VLEFT
                                        ! includes the 1st (upper) crossover
                                        ! detector on VLEFT

      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT
      INTEGER*4          MIN1           ! Minimum value input from MINIMA
      INTEGER*4          MIN2           !  ''      ''    ''    ''    ''

1000  FORMAT(/,20X,'>>>> MEDIASTINAL EXPOSURE:',F7.2,//)


C------EXPOSURE COMPUTATION
      J1=VL_IX(1)
      I1=VL_E(J1)
      J2=VL_IX(2)
      I2=VL_S(J2)
      CALL MINIMA(VLEFT,I1,I2, MIN1)

      I1=VCRSS(1)
      I2=VCRSS(2)
      CALL MINIMA(VRIGHT,I1,I2, MIN2)

      E=0.5*(FLOATJ(MIN1)+FLOATJ(MIN2))
      WRITE(LRES,1000) E

      RETURN
      END
C-----------------------------------------------------------------------C
      SUBROUTINE CASE10(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #10             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #10                                              C
C                                                                       C
C  ( For pictorial illustration of CASE #10 see SUBROUTINE CASENO )     C
C                                                                       C
C  LET                                                                  C
C                                                                       C
C      a = MIN [HTOP(HT_E(HT_IX(1))), HTOP(HCRSS(2))]                   C
C      b = MIN [VRIGHT(VCRSS(1)), VRIGHT(VR_S(VR_IX(2)))]               C
C      c = MIN [HBOT(HCRSS(1)), HBOT(HB_S(HB_IX(2)))]                   C
C      d = MIN [VLEFT(VL_E(VL_IX(1))), VLEFT(VCRSS(2))]                 C
C                                                                       C
C                                  ==> E = (a+b+c+d)/4                  C
C-----------------------------------------------------------------------C

C     Common Variables

      INTEGER*4          LRES
      COMMON/RESULT/LRES

C     Input Variables

        INTEGER*4          HBOT(0:15)     ! Horizontal bottom array data
        INTEGER*4          HCRSS(2)       ! Coordinates of crossover detectors
                                          ! of horizontal arrays
        INTEGER*4          HTOP(0:15)     ! Horizontal top array data

        INTEGER*4          VCRSS(2)       ! Coordinates of crossover detectors
                                          ! of vertical arrays
        INTEGER*4          VLEFT(0:15)    ! Vertical left array data
```

```
      INTEGER*4          VRIGHT(0:15) ! Vertical right array data

      INTEGER*4          HB_S(15)     ! Starting points of peaks in HBOT
      INTEGER*4          HB_E(15)     ! End points of peaks in HBOT
      REAL*4             HB_M(15)     ! Mean signal values within the
                                      ! the peaks in HBOT
      INTEGER*4          HB_IX(2)     ! Indicator for peaks over crossover
                                      ! detectors, e.g., HB_IX(1)=j, ==>
                                      ! the extent of j th peak of HBOT
                                      ! includes the 1st (leftmost) crossover

                                      ! detector on HBOT

      INTEGER*4          HT_S(15)     ! Starting points of peaks in HTOP
      INTEGER*4          HT_E(15)     ! End points of peaks in HTOP
      REAL*4             HT_M(15)     ! Mean signal values within the
                                      ! the peaks in HTOP
      INTEGER*4          HT_IX(2)     ! Indicator for peaks over crossover
                                      ! detectors, e.g., HT_IX(2)=j, ==>
                                      ! the extent of j th peak of HTOP
                                      ! includes the 2nd (rightmost)
                                      ! crossover detector on HTOP

      INTEGER*4          VL_S(15)     ! Starting points of peaks in VLEFT
      INTEGER*4          VL_E(15)     ! End points of peaks in VLEFT
      REAL*4             VL_M(15)     ! Mean signal values within the
                                      ! the peaks in VLEFT
      INTEGER*4          VL_IX(2)     ! Indicator for peaks over crossover
                                      ! detectors, e.g., VL_IX(1)=j, ==>
                                      ! the extent of j th peak of VLEFT
                                      ! includes the 1st (upper) crossover
                                      ! detector on VLEFT

      INTEGER*4          VR_S(15)     ! Starting points of peaks in VRIGHT
      INTEGER*4          VR_E(15)     ! End points of peaks in VRIGHT
      REAL*4             VR_M(15)     ! Mean signal values within the
                                      ! the peaks in VRIGHT
      INTEGER*4          VR_IX(15)    ! Indicator for peaks over crossover
                                      ! detectors, e.g., VR_IX(2)=j, ==>
                                      ! the extent of j th peak of VRIGHT
                                      ! includes the 2nd (lower) crossover
                                      ! detector on VRIGHT

      INTEGER*4          MIN1         ! Minimum value input from MINIMA
      INTEGER*4          MIN2         !  ''      ''    ''    ''    ''
      INTEGER*4          MIN3         !  ''      ''    ''    ''    ''
      INTEGER*4          MIN4         !  ''      ''    ''    ''    ''

1000  FORMAT(/,20X,'>>>> MEDIASTINAL EXPOSURE:',F7.2,//)


C------EXPOSURE COMPUTATION

      J1=HT_IX(1)
      I1=HT_E(J1)
      I2=HCRSS(2)
      CALL MINIMA(HTOP,I1,I2, MIN1)

      I1=VCRSS(1)
      J2=VR_IX(2)
      I2=VR_S(J2)
      CALL MINIMA(VRIGHT,I1,I2, MIN2)

      I1=HCRSS(1)
      J2=HB_IX(2)
      I2=HB_S(J2)
      CALL MINIMA(HBOT,I1,I2, MIN3)

      J1=VL_IX(1)
      I1=VL_E(J1)
      I2=VCRSS(2)
      CALL MINIMA(VLEFT,I1,I2, MIN4)

      E=0.25*(FLOATJ(MIN1)+FLOATJ(MIN2)+FLOATJ(MIN3)+FLOATJ(MIN4))
      WRITE(LRES,1000) E

      RETURN
      END
```

```
C-----------------------------------------------------------------------C
      SUBROUTINE CASE11(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #11             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #11                                              C
C                                                                       C
C  ( For pictorial illustration of CASE #11 see SUBROUTINE CASENO )     C
C                                                                       C
C  LET                                                                  C
C                                                                       C
C      a = MIN [HTOP(HCRSS(1)), HT_E(HT_IX(2))]                         C
C      b = MIN [VRIGHT(VR_E(VR_IX(1))), VRIGHT(VCRSS(2))]               C
C      c = MIN [HBOT(HB_E(HB_IX(1))), HBOT(HCRSS(2))]                   C
C      d = MIN [VLEFT(VCRSS(1)), VLEFT(VL_S(VL_IX(2)))]                 C
C                                                                       C
C                                  ==> E = (a+b+c+d)/4                  C
C-----------------------------------------------------------------------C

C     Common Variables

      INTEGER*4          LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP

        INTEGER*4          VL_S(15)      ! Starting points of peaks in VLEFT
        INTEGER*4          VL_E(15)      ! End points of peaks in VLEFT
        REAL*4             VL_M(15)      ! Mean signal values within the
                                         ! the peaks in VLEFT
        INTEGER*4          VL_IX(2)      ! Indicator for peaks over crossover
                                         ! detectors, e.g., VL_IX(1)=j, ==>
                                         ! the extent of j th peak of VLEFT
                                         ! includes the 1st (upper) crossover
                                         ! detector on VLEFT

        INTEGER*4          VR_S(15)      ! Starting points of peaks in VRIGHT
        INTEGER*4          VR_E(15)      ! End points of peaks in VRIGHT
```

```
      REAL*4              VR_M(15)      ! Mean signal values within the
                                        ! the peaks in VRIGHT
      INTEGER*4           VR_IX(15)     ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT

      INTEGER*4           MIN1          ! Minimum value input from MINIMA
      INTEGER*4           MIN2          !  ''        ''    ''    ''    ''
      INTEGER*4           MIN3          !  ''        ''    ''    ''    ''
      INTEGER*4           MIN4          !  ''        ''    ''    ''    ''

1000  FORMAT(/,20X,'>>>> MEDIASTINAL EXPOSURE:',F7.2,//)


C------EXPOSURE COMPUTATION

      I1=HCRSS(1)
      J1=HT_IX(2)
      I2=HT_S(J2)
      CALL MINIMA(HTOP,I1,I2, MIN1)

      J1=VR_IX(1)
      I1=VR_E(J1)
      I2=VCRSS(2)
      CALL MINIMA(VRIGHT,I1,I2, MIN2)

      J1=HB_IX(1)
      I1=HB_E(J1)
      I2=HCRSS(2)
      CALL MINIMA(HBOT,I1,I2, MIN3)

      I1=VCRSS(1)
      J2=VL_IX(2)
      I2=VL_S(J2)
      CALL MINIMA(VLEFT,I1,I2, MIN4)
      E=0.25*(FLOATJ(MIN1)+FLOATJ(MIN2)+FLOATJ(MIN3)+FLOATJ(MIN4))
      WRITE(LRES,1000) E

      RETURN
      END
C-----------------------------------------------------------------------C
      SUBROUTINE CASE12(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #12             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #12                                              C
C                                                                       C
C  ( For pictorial illustration of CASE #12 see SUBROUTINE CASENO )     C
C                                                                       C
C  LET                                                                  C
C                                                                       C
C      a = MIN [HTOP(HT_E(HT_IX(1))), HTOP(HCRSS(2))]                   C
C      b = MIN [VLEFT(VL_E(VL_IX(1))), VLEFT(VCRSS(2))]                 C
C                                                                       C
C                                    ==> E = (a+b)/2                    C
C-----------------------------------------------------------------------C

C     Common Variables

      INTEGER*4           LRES
      COMMON/RESULT/LRES

C     Input Variables

        INTEGER*4           HBOT(0:15)    ! Horizontal bottom array data
        INTEGER*4           HCRSS(2)      ! Coordinates of crossover detectors
                                          ! of horizontal arrays
        INTEGER*4           HTOP(0:15)    ! Horizontal top array data
```

```
      INTEGER*4          VCRSS(2)       ! Coordinates of crossover detectors
                                        ! of vertical arrays
      INTEGER*4          VLEFT(0:15)    ! Vertical left array data
      INTEGER*4          VRIGHT(0:15)   ! Vertical right array data

      INTEGER*4          HB_S(15)       ! Starting points of peaks in HBOT
      INTEGER*4          HB_E(15)       ! End points of peaks in HBOT
      REAL*4             HB_M(15)       ! Mean signal values within the
                                        ! the peaks in HBOT
      INTEGER*4          HB_IX(2)       ! Indicator for peaks over crossover
                                        ! detectors, e.g., HB_IX(1)=j, ==>
                                        ! the extent of j th peak of HBOT
                                        ! includes the 1st (leftmost) crossover

                                        ! detector on HBOT

      INTEGER*4          HT_S(15)       ! Starting points of peaks in HTOP
      INTEGER*4          HT_E(15)       ! End points of peaks in HTOP
      REAL*4             HT_M(15)       ! Mean signal values within the
                                        ! the peaks in HTOP
      INTEGER*4          HT_IX(2)       ! Indicator for peaks over crossover
                                        ! detectors, e.g., HT_IX(2)=j, ==>
                                        ! the extent of j th peak of HTOP
                                        ! includes the 2nd (rightmost)
                                        ! crossover detector on HTOP

      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT

      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT

      INTEGER*4          MIN1           ! Minimum value input from MINIMA
      INTEGER*4          MIN2           !  ''       ''    ''    ''    ''

1000  FORMAT(/,20X,'>>>> MEDIASTINAL EXPOSURE:',F7.2,//)


C------EXPOSURE COMPUTATION

      J1=HT_IX(1)
      I1=HT_E(J1)
      I2=HCRSS(2)
      CALL MINIMA(HTOP,I1,I2, MIN1)

      J1=VL_IX(1)
      I1=VL_E(J1)
      I2=VCRSS(2)
      CALL MINIMA(VLEFT,I1,I2, MIN2)

      E=0.5*(FLOATJ(MIN1)+FLOATJ(MIN2))
      WRITE(LRES,1000) E

      RETURN
      END
C-----------------------------------------------------------------------C
      SUBROUTINE CASE13(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #13             C
C                                                                       C
C       Author  : M. Ibrahim Sezan                                      C
C                 Research Laboratories, Eastman Kodak Company          C
```

```
C                 August 16, 1988                                        C
C                                                                        C
C Modifications : None                                                   C
C                                                                        C
C                                                                        C
C  Detailed                                                              C
C   description : CASE #13                                               C
C                                                                        C
C  ( For pictorial illustration of CASE #13 see SUBROUTINE CASENO )      C
C                                                                        C
C  LET                                                                   C
C                                                                        C
C      a = MIN [HTOP(HCRSS(1)), HT_S(HT_IX(2))]                          C
C      b = MIN [VRIGHT(VR_E(VR_IX(1))), VRIGHT(VCRSS(2))]                C
C                                                                        C
C                                  ==> E = (a+b)/2                       C
C------------------------------------------------------------------------C

C     Common Variables

      INTEGER*4          LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP

        INTEGER*4          VL_S(15)      ! Starting points of peaks in VLEFT
        INTEGER*4          VL_E(15)      ! End points of peaks in VLEFT
        REAL*4             VL_M(15)      ! Mean signal values within the
                                         ! the peaks in VLEFT
        INTEGER*4          VL_IX(2)      ! Indicator for peaks over crossover
                                         ! detectors, e.g., VL_IX(1)=j, ==>
                                         ! the extent of j th peak of VLEFT
                                         ! includes the 1st (upper) crossover
                                         ! detector on VLEFT

        INTEGER*4          VR_S(15)      ! Starting points of peaks in VRIGHT
        INTEGER*4          VR_E(15)      ! End points of peaks in VRIGHT
        REAL*4             VR_M(15)      ! Mean signal values within the
                                         ! the peaks in VRIGHT
        INTEGER*4          VR_IX(15)     ! Indicator for peaks over crossover
                                         ! detectors, e.g., VR_IX(2)=j, ==>
                                         ! the extent of j th peak of VRIGHT
                                         ! includes the 2nd (lower) crossover
                                         ! detector on VRIGHT

        INTEGER*4          MIN1          ! Minimum value input from MINIMA
        INTEGER*4          MIN2          !  ''        ''    ''    ''   ''

1000    FORMAT(/,20X,'>>>> MEDIASTINAL EXPOSURE:',F7.2,//)
```

```
C------EXPOSURE COMPUTATION

        I1=HCRSS(1)
        J1=HT_IX(2)
        I2=HT_S(J2)
        CALL MINIMA(HTOP,I1,I2, MIN1)

        J1=VR_IX(1)
        I1=VR_E(J1)
        I2=VCRSS(2)
        CALL MINIMA(VRIGHT,I1,I2, MIN2)

        E=0.5*(FLOATJ(MIN1)+FLOATJ(MIN2))
        WRITE(LRES,1000) E

        RETURN
        END

C-----------------------------------------------------------------------C
      SUBROUTINE CASE14(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #14             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #14                                              C
C                                                                       C
C  ( For pictorial illustration of CASE #14 see SUBROUTINE CASENO )     C
C                                                                       C
C  LET                                                                  C
C      a = MIN [VRIGHT(VCRSS(1)), VRIGHT(VR_S(VR_IX(2)))]               C
C      b = MIN [HBOT(HCRSS(1)), HBOT(HB_S(HB_IX(2)))]                   C
C                                                                       C
C                                  ==> E = (a+b)/2                      C
C-----------------------------------------------------------------------C

C     Common Variables

      INTEGER*4          LRES
      COMMON/RESULT/LRES

C     Input Variables

        INTEGER*4          HBOT(0:15)    ! Horizontal bottom array data
        INTEGER*4          HCRSS(2)      ! Coordinates of crossover detectors
                                         ! of horizontal arrays
        INTEGER*4          HTOP(0:15)    ! Horizontal top array data

        INTEGER*4          VCRSS(2)      ! Coordinates of crossover detectors
                                         ! of vertical arrays
        INTEGER*4          VLEFT(0:15)   ! Vertical left array data
        INTEGER*4          VRIGHT(0:15)  ! Vertical right array data

        INTEGER*4          HB_S(15)      ! Starting points of peaks in HBOT
        INTEGER*4          HB_E(15)      ! End points of peaks in HBOT
        REAL*4             HB_M(15)      ! Mean signal values within the
                                         ! the peaks in HBOT
        INTEGER*4          HB_IX(2)      ! Indicator for peaks over crossover
                                         ! detectors, e.g., HB_IX(1)=j, ==>
                                         ! the extent of j th peak of HBOT
                                         ! includes the 1st (leftmost) crossover

                                         ! detector on HBOT

        INTEGER*4          HT_S(15)      ! Starting points of peaks in HTOP
        INTEGER*4          HT_E(15)      ! End points of peaks in HTOP
        REAL*4             HT_M(15)      ! Mean signal values within the
                                         ! the peaks in HTOP
        INTEGER*4          HT_IX(2)      ! Indicator for peaks over crossover
                                         ! detectors, e.g., HT_IX(2)=j, ==>
                                         ! the extent of j th peak of HTOP
                                         ! includes the 2nd (rightmost)
                                         ! crossover detector on HTOP
```

```
      INTEGER*4          VL_S(15)      ! Starting points of peaks in VLEFT
      INTEGER*4          VL_E(15)      ! End points of peaks in VLEFT
      REAL*4             VL_M(15)      ! Mean signal values within the
                                       ! the peaks in VLEFT
      INTEGER*4          VL_IX(2)      ! Indicator for peaks over crossover
                                       ! detectors, e.g., VL_IX(1)=j, ==>
                                       ! the extent of j th peak of VLEFT
                                       ! includes the 1st (upper) crossover
                                       ! detector on VLEFT

      INTEGER*4          VR_S(15)      ! Starting points of peaks in VRIGHT
      INTEGER*4          VR_E(15)      ! End points of peaks in VRIGHT
      REAL*4             VR_M(15)      ! Mean signal values within the
                                       ! the peaks in VRIGHT
      INTEGER*4          VR_IX(15)     ! Indicator for peaks over crossover
                                       ! detectors, e.g., VR_IX(2)=j, ==>
                                       ! the extent of j th peak of VRIGHT
                                       ! includes the 2nd (lower) crossover
                                       ! detector on VRIGHT

      INTEGER*4          MIN1          ! Minimum value input from MINIMA
      INTEGER*4          MIN2          ! ''      ''    ''    ''    ''

1000  FORMAT(/,20X,'>>>> MEDIASTINAL EXPOSURE:',F7.2,//)


C------EXPOSURE COMPUTATION


      I1=VCRSS(1)
      J2=VR_IX(2)
      I2=VR_S(J2)
      CALL MINIMA(VRIGHT,I1,I2, MIN1)

      I1=HCRSS(1)
      J2=HB_IX(2)
      I2=HB_S(J2)
      CALL MINIMA(HBOT,I1,I2, MIN2)

      E=0.5*(FLOATJ(MIN1)+FLOATJ(MIN2))
      WRITE(LRES,1000) E

      RETURN
      END

C-----------------------------------------------------------------------C
      SUBROUTINE CASE15(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
C-----------------------------------------------------------------------C
C                                                                       C
C       Purpose : To compute exposure estimate for CASE #15             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #15                                              C
C                                                                       C
C  ( For pictorial illustration of CASE #15 see SUBROUTINE CASENO )     C
C                                                                       C
C  LET                                                                  C
C      a = MIN [HBOT(HB_E(HB_IX(1))), HBOT(HCRSS(2))]                   C
C      b = MIN [VLEFT(VCRSS(I)), VLEFT(VL_S(VL_IX(2)))]                 C
C                                                                       C
C                                    ==> E = (a+b)/2                    C
C-----------------------------------------------------------------------C

C     Common Variables

      INTEGER*4          LRES
      COMMON/RESULT/LRES

C     Input Variables

      INTEGER*4          HBOT(0:15)    ! Horizontal bottom array data
```

```
      INTEGER*4          HCRSS(2)       ! Coordinates of crossover detectors
                                        ! of horizontal arrays
      INTEGER*4          HTOP(0:15)     ! Horizontal top array data

      INTEGER*4          VCRSS(2)       ! Coordinates of crossover detectors
                                        ! of vertical arrays
      INTEGER*4          VLEFT(0:15)    ! Vertical left array data
      INTEGER*4          VRIGHT(0:15)   ! Vertical right array data

      INTEGER*4          HB_S(15)       ! Starting points of peaks in HBOT
      INTEGER*4          HB_E(15)       ! End points of peaks in HBOT
      REAL*4             HB_M(15)       ! Mean signal values within the
                                        ! the peaks in HBOT
      INTEGER*4          HB_IX(2)       ! Indicator for peaks over crossover
                                        ! detectors, e.g., HB_IX(1)=j, ==>
                                        ! the extent of j th peak of HBOT
                                        ! includes the 1st (leftmost) crossover

                                        ! detector on HBOT

      INTEGER*4          HT_S(15)       ! Starting points of peaks in HTOP
      INTEGER*4          HT_E(15)       ! End points of peaks in HTOP
      REAL*4             HT_M(15)       ! Mean signal values within the
                                        ! the peaks in HTOP
      INTEGER*4          HT_IX(2)       ! Indicator for peaks over crossover
                                        ! detectors, e.g., HT_IX(2)=j, ==>
                                        ! the extent of j th peak of HTOP
                                        ! includes the 2nd (rightmost)
                                        ! crossover detector on HTOP


      INTEGER*4          VL_S(15)       ! Starting points of peaks in VLEFT
      INTEGER*4          VL_E(15)       ! End points of peaks in VLEFT
      REAL*4             VL_M(15)       ! Mean signal values within the
                                        ! the peaks in VLEFT
      INTEGER*4          VL_IX(2)       ! Indicator for peaks over crossover
                                        ! detectors, e.g., VL_IX(1)=j, ==>
                                        ! the extent of j th peak of VLEFT
                                        ! includes the 1st (upper) crossover
                                        ! detector on VLEFT


      INTEGER*4          VR_S(15)       ! Starting points of peaks in VRIGHT
      INTEGER*4          VR_E(15)       ! End points of peaks in VRIGHT
      REAL*4             VR_M(15)       ! Mean signal values within the
                                        ! the peaks in VRIGHT
      INTEGER*4          VR_IX(15)      ! Indicator for peaks over crossover
                                        ! detectors, e.g., VR_IX(2)=j, ==>
                                        ! the extent of j th peak of VRIGHT
                                        ! includes the 2nd (lower) crossover
                                        ! detector on VRIGHT

      INTEGER*4          MIN1           ! Minimum value input from MINIMA
      INTEGER*4          MIN2           ! ''      ''   ''   ''   ''

1000  FORMAT(/,20X,'>>>> MEDIASTINAL EXPOSURE:',F7.2,//)


C------EXPOSURE COMPUTATION

      J1=HB_IX(1)
      I1=HB_E(J1)
      I2=HCRSS(2)
      CALL MINIMA(HBOT,I1,I2, MIN1)

      I1=VCRSS(1)
      J2=VL_IX(2)
      I2=VL_S(J2)
      CALL MINIMA(VLEFT,I1,I2, MIN2)

      E=0.5*(FLOATJ(MIN1)+FLOATJ(MIN2))
      WRITE(LRES,1000) E

      RETURN
      END

C-----------------------------------------------------------------------C
      SUBROUTINE CASE16(VLEFT,VRIGHT,HTOP,HBOT, VL_S,VL_E,VL_M,VL_IX,
     +                  VR_S,VR_E,VR_M,VR_IX, HT_S,HT_E,HT_M,HT_IX,
     +                  HB_S,HB_E,HB_M,HB_IX, VCRSS, HCRSS)
```

```
C-----------------------------------------------------------------------C
C                                                                       C
C       Purpose : To compute exposure estimate for CASE #16             C
C                                                                       C
C       Author  : M. Ibrahim Sezan                                      C
C                 Research Laboratories, Eastman Kodak Company          C
C                 August 16, 1988                                       C
C                                                                       C
C Modifications : None                                                  C
C                                                                       C
C                                                                       C
C  Detailed                                                             C
C   description : CASE #16                                              C
C                                                                       C
C  ( For pictorial illustration of CASE #16 see SUBROUTINE CASENO )     C
C                                                                       C
C    In this case no crossing peaks are found. Exposure is estimated by C
C    averaging the values at the crossover detectors                    C
C-----------------------------------------------------------------------C

C     Common Variables

      INTEGER*4           LRES
      COMMON/RESULT/LRES

C     Input Variables

        INTEGER*4           HBOT(0:15)    ! Horizontal bottom array data
        INTEGER*4           HCRSS(2)      ! Coordinates of crossover detectors
                                          ! of horizontal arrays
        INTEGER*4           HTOP(0:15)    ! Horizontal top array data

        INTEGER*4           VCRSS(2)      ! Coordinates of crossover detectors
                                          ! of vertical arrays
        INTEGER*4           VLEFT(0:15)   ! Vertical left array data
        INTEGER*4           VRIGHT(0:15)  ! Vertical right array data

        INTEGER*4           HB_S(15)      ! Starting points of peaks in HBOT
        INTEGER*4           HB_E(15)      ! End points of peaks in HBOT
        REAL*4              HB_M(15)      ! Mean signal values within the
                                          ! the peaks in HBOT
        INTEGER*4           HB_IX(2)      ! Indicator for peaks over crossover
                                          ! detectors, e.g., HB_IX(1)=j, ==>
                                          ! the extent of j th peak of HBOT
                                          ! includes the 1st (leftmost) crossover

                                          ! detector on HBOT

        INTEGER*4           HT_S(15)      ! Starting points of peaks in HTOP
        INTEGER*4           HT_E(15)      ! End points of peaks in HTOP
        REAL*4              HT_M(15)      ! Mean signal values within the
                                          ! the peaks in HTOP
        INTEGER*4           HT_IX(2)      ! Indicator for peaks over crossover
                                          ! detectors, e.g., HT_IX(2)=j, ==>
                                          ! the extent of j th peak of HTOP
                                          ! includes the 2nd (rightmost)
                                          ! crossover detector on HTOP
      INTEGER*4           VL_S(15)        ! Starting points of peaks in VLEFT
      INTEGER*4           VL_E(15)        ! End points of peaks in VLEFT
      REAL*4              VL_M(15)        ! Mean signal values within the
                                          ! the peaks in VLEFT
      INTEGER*4           VL_IX(2)        ! Indicator for peaks over crossover
                                          ! detectors, e.g., VL_IX(1)=j, ==>
                                          ! the extent of j th peak of VLEFT
                                          ! includes the 1st (upper) crossover
                                          ! detector on VLEFT


      INTEGER*4           VR_S(15)        ! Starting points of peaks in VRIGHT
      INTEGER*4           VR_E(15)        ! End points of peaks in VRIGHT
      REAL*4              VR_M(15)        ! Mean signal values within the
                                          ! the peaks in VRIGHT
      INTEGER*4           VR_IX(15)       ! Indicator for peaks over crossover
                                          ! detectors, e.g., VR_IX(2)=j, ==>
                                          ! the extent of j th peak of VRIGHT
                                          ! includes the 2nd (lower) crossover
                                          ! detector on VRIGHT

1000  FORMAT(/,20X,'>>>> MEDIASTINAL EXPOSURE:',F7.2,//)
```

```
C------EXPOSURE COMPUTATION

        J1=VLEFT(VCRSS(1))
        J2=VLEFT(VCRSS(2))
        I1=VRIGHT(VCRSS(1))
        I2=VRIGHT(VCRSS(2))
        E=0.25*(FLOATJ(I1)+FLOATJ(I2)+FLOATJ(J1)+FLOATJ(J2))
        WRITE(LRES,1000) E

        RETURN
        END
```

Appendix E
Listing B:xhrunb.C

Copyright Eastman Kodak Company

```
 1 |  /* Xhrunb.C Lee Frank XRAY SENSOR data processor                    */
 2 |  /* (sort>hist)  successive passes                                   */
 3 |  /* Command line input 'Xhrun file.dat file.srt'                     */
 4 |  /* Disk output sorted & limited array in file.srt                   */
 5 |
 6 |  #include "stdio.h"   /* Standard I/O header */
 7 |  #define ADDRESS 1808
 8 |
 9 |  /* initialize common variables */
10 |  int wirebyt[5];
11 |  int bp[8] = { 1, 2, 4, 8, 16, 32, 64, 128 };
12 |  int but[24] = { 3,6,9,12,17,25,33,42,50,67,83,100,130,200,300,
13 |                  400,600,800,1000,1500,2000,3000,4000,6000 };
14 |  int pcell[6][65];
15 |  int hist[100];
16 |
17 |  main(argc,argv)
18 |    int argc;
19 |    char *argv[];
20 |
21 |    {
22 |     int h,i, j, k, l, m, n;
23 |     int insert();
24 |     double sum, ii, jj, kk, ll;
25 |     char comm[200];
26 |
27 |     FILE *fp;
28 |
29 |
30 |
31 |     /* PRINT HEADER ON SCREEN & PAPER*/
32 |
33 |     printf("\n\n\n\n\n");
34 |     printf("                          XHRUNB DATA RUNS\n");
35 |     printf("                        ----------------------\n\n");
36 |     printf("                         Data Processing Module\n");
37 |     printf("                               Lee Frank \n\n");
38 |
39 |     fprintf(stdprn,"            ");
40 |     fprintf(stdprn,"                 XHRUNB DATA RUNS\n\15");
41 |     fprintf(stdprn,"            ");
42 |     fprintf(stdprn,"                -------------------\n\n\15");
43 |     fprintf(stdprn,"            ");
44 |     fprintf(stdprn,"                Data Processing Module\n\15");
45 |     fprintf(stdprn,"            ");
46 |     fprintf(stdprn,"                       Lee Frank \n\n\15");
47 |
48 |
49 |
50 |     /* PROCESS COMMAND LINE  DATA */
51 |
52 |     if(argc<3)
53 |       {
54 |        printf("\nSorry Boss - try again.\n");
55 |        printf("\nInsufficient Data on Command line");
```

```
56 |
57 |        exit(1);
58 |       }
59 |
60 |     ++argv;
61 |     fp=fopen(*argv,"r");
62 |     if(fp==NULL)
63 |       {
64 |        printf("Sorry Boss, %s can't be opened.",*argv);
65 |        exit(1);
66 |       }
67 |     fgets(comm,100,fp);
68 |     fprintf(stdprn,"%s\15\n",comm);
69 |     printf("%s",comm);
70 |     for(i=0;i<64;i++)
71 |       {
72 |        fscanf(fp,"%d",&pcell[0][i]);
73 |       }
74 |     fclose(fp);
75 |    /* Populate hist[] with valid, counted readings */
76 |
77 |     n=0;
78 |     for(i=0;i<64;i++)
79 |        {
80 |          if(pcell[0][i]>0)
81 |            {
82 |              hist[n]=pcell[0][i];
83 |              n++;
84 |            }
85 |        }
86 |
87 |     /*Sort hist[] into ascending order */
88 |
89 |     insert(hist,n);
90 |
91 |     for(i=0;i<n;i++)
92 |        {
93 |          printf("%3d %5d   ",i,hist[i]);
94 |          fprintf(stdprn,"%3d %5d     ",i,hist[i]);
95 |          j=i+1;
96 |          if(6*(j/6)==j)
97 |             {
98 |               printf("\n");
99 |               fprintf(stdprn,"\n\15");
100 |             }
101 |        }
102 |
103 |     j=0;
104 |     for(i=1;i<n;i++)
105 |        {
106 |          h=0;
107 |          /* if statment to avoid divide by zero */
108 |          if(hist[i]>hist[i-1]) h=i - hist[i]/(hist[i]-hist[i-1]);
109 |          if(h>j) j=h;
110 |        }
111 |     printf("\n clip limit = %d\n",j);
112 |     fprintf(stdprn,"\n\15Clip limit = %d cell.\n\15",j);
113 |     printf("Chosen cell = %d,",j/2);
114 |     fprintf(stdprn,"Chosen data cell = %d,",j/2);
115 |     printf(" value = %d\n",hist[j/2]);
116 |     fprintf(stdprn," value = %d\n\15",hist[j/2]);
117 |     printf(" %s source file\n",*argv);
118 |     fprintf(stdprn,"%s is the source file.\n\15",*argv);
119 |
120 |
121 |     /* Determine exposure */
122 |     fp=fopen("Expos.dat","r");
123 |     fscanf(fp,"%d",&i);
124 |     fclose(fp);
125 |     printf("Exposure constant = %d,",i);
```

```
126 |      fprintf(stdprn,"Exposure constant = %d,",i);
127 |      i= i/hist[j/2];
128 |      printf("and estimated correct exposure is");
129 |      fprintf(stdprn,"and estimated correct exposure is");
130 |      printf(" %d milliseconds\n\15",i);
131 |      fprintf(stdprn," %d milliseconds.\n\15",i);
132 |
133 |      k=i;
134 |      l=0;
135 |      for(j=0;j<25;j++)
136 |         {
137 |          m=but[j]-i;
138 |          if(m<0) m=-m;
139 |          if(m<k)
140 |             {
141 |              l=j;
142 |              k=m;
143 |             }
144 |         }
145 |      printf("Nearest machine setting is %d millisec.\n",but[l]);
146 |      fprintf(stdprn,"Nearest machine setting is %d",but[l]);
147 |      fprintf(stdprn," milliseconds.\n\15");
148 |
149 |
150 |      /*Save data for plotter*/
151 |      ++argv;
152 |      printf(" %s destination file\n",*argv);
153 |      fprintf(stdprn,"%s is the destination file.\n\14\15",*argv);
154 |      fp=fopen(*argv,"w");
155 |      fprintf(fp,"Sort of %s Cell Rank, Data Number,",comm);
156 |      for(i=0;i<n;i++) fprintf(fp," %d %d",i+1,hist[i]);
157 |      fclose(fp);
158 |    }
159 |
160 |
161 |  /*  Application specific subroutines  */
162 |
163 |
164 |  int insert(a,na)
165 |   int a[];          /* array of integers */
166 |   int na;            /* number of integers to sort */
167 |
168 |   {
169 |    int i, j, temp;
170 |
171 |    for(i=1;i<na;i++)
172 |     {
173 |       temp = a[i];
174 |       j = i-1;
175 |       while( (j>=0) && (temp< a[j]))
176 |         {
177 |           a[j+1] = a[j];
178 |           j = j -1;
179 |         }
180 |       a[j+1] = temp;
181 |     }
182 |   }
```

We claim:

1. An x-ray phototimer, comprising:

(a) an array of X-ray sensors for producing a plurality of exposure signals;

(b) means for digitizing the exposure signals to produce digital exposure signals; and (c) digital signal processing means responsive to the digital exposure signals for automatically selecting one or more of the digital exposure signals, and calculating an estimated X-ray exposure therefrom, and for producing a signal representing the estimated exposure;

wherein said digital signal processing means performs an exposure algorithm which orders the signals in a rank order on the basis of signal magnitude, adjacent pairs of values in the rank order are employed to calculate an intercept with a rank number axis, the signal values less than the maximum intercept with the rank number axis are selected and exposure is calculated by taking the signal value in the median cell selected.

2. The X-ray phototimer claimed in claim 1, further comprising: display means responsive to the estimated exposure signal for displaying the amount of the estimated exposure.

3. The X-ray phototimer claimed in claim 1, further comprising: control means, which is responsive to said estimated exposure signal and to a signal representing desired exposure, for comparing said estimated exposure signal and said desired exposure signal, and for producing an X-ray source control signal when said estimated exposure signal is equal to said desired exposure signal.

4. The X-ray phototimer claimed in claim 1, wherein said array of X-ray sensors comprises four linear arrays of X-ray sensors arranged in a rectangular pattern central portions of the linear arrays defining a rectangle, the linear arrays extending past the corners of the rectangle.

5. The X-ray phototimer claimed in claim 4, wherein said digital signal processing means selects said one or more digital exposure signals by forming a linear waveform from the digital exposure signals from each linear array, detects peaks in each waveform, and detects peak crossings occurring in the waveform produced at the corners of the rectangle.

6. The X-ray phototimer claimed in claim 5, wherein said digital signal processing means computes the estimated X-ray exposure according to the following rules:

a. when no peak crossings are detected at any of the four corners of the array, the exposure E is estimated by $E=(E_1+E_2+E_3+E_4)/4$ where $E_i$ is the minimum value of the linear waveform between corners of the rectangle;

b. when a peak crossing is detected at only one corner of the rectangle, the exposure E is estimated by $E=(E_1+E_2)/2$ where $E_1$ and $E_2$ are the minimum values of the linear waveforms between the corner where the peak crossing occurred, and the two adjacent corners of the rectangle;

c. when the peak crossings occur at two adjacent corners, the exposure E is estimated by $E=(E_1+E_2)/2$ where $E_1$ is the minimum value of the linear waveform between the two peaks at the adjacent corners where the peak crossings occurred, and $E_2$ is the minimum value of the linear waveform between the two opposite corners;

d. when peak crossings occur at diagonal corners, the exposure E is estimated by $E=(E_1+E_2+E_3+E_4)/4$ where $E_i$ is the minimum value of the waveform between a peak at a corner and an adjacent corner;

e. where peak crossings occur at three corners of the rectangle, exposure E is estimated by calculating the average mean $a_i$ of the two peaks at each of the three corners $a_i=(m_1+m_2)/2$ where $m_1$ is the mean of the value of the linear waveform within one of the crossing peaks and $m_2$ is the mean of the value of the other crossing peak at the crossing, if two of the average means $a_i$ at adjacent corners are greater than the third, then the exposure E is estimated as in (c) above, ignoring the peak crossing at the third corner, if not, the exposure E is estimated as $E=(E_1+E_2)/2$ where $E_1$ and $E_2$ are the minimum values of the waveforms between the peaks at the peak crossings;

f. where peak crossings occur at all four corners of the rectangle, the exposure E is computed by calculating the average mean $a_i$ at each of the corners as in (e) above, if the average means of the peaks at two adjacent corners are greater than the average means at the two opposite corners, the exposure is calculated as in (c) above, if the average means of the peaks at two diagonal corners are greater than the other two average means, the exposure is computed as in (d) above, if neither of the preceding conditions holds, the exposure E is computed as $E=(E_1+E_2+E_3+E_4)/4$ where $E_i$ is the minimum value of the linear waveform between peaks at the four corners.

7. The X-ray phototimer claimed in claim 1, wherein the array of X-ray sensors is a sparse rectangular array.

8. The X-ray phototimer claimed in claim 1, wherein the array of X-ray photo sensors is a circular array.

9. The X-ray phototimer claimed in claim 1, wherein said X-ray sensors are PIN photo diodes.

10. The X-ray phototimer claimed in claim 9, further comprising of plurality of preamplifiers, each preamplifier associated with each photo diode configured as a voltage converter, and wherein said digital processing means also performs a calibration on the sensor array to correct for zero offset and gain variations between the outputs of the photo diodes and preamplifiers.

11. A method of calibrating the phototimer of claim 1 comprising the steps of:

(a) operating the sensor array without input to measure the dark current of the sensors;

(b) operating the phototimer with a predetermined uniform X-ray exposure to determine the gain of each sensor;

(c) operating the phototimer with an X-ray exposure of a phantom, said exposure having a predetermined correct exposure for the phantom, correcting the signals produced thereby for sensor gain, and processing the signals according to the algorithm to produce a calculated exposure value; and (d) multiplying the calculated exposure value by the correct exposure time to generate a speed number.

12. The method claimed in claim 11, further comprising the steps of:

a) operating said phototimer with a patient to generate a patient exposure value, and b) dividing said patient exposure value by the speed number to generate a patient exposure time.

13. The method claimed in claim 11, further comprising the steps of:

a) measuring a standard deviation of dark current of each sensor;

b) calculating the average standard deviation of dark current of all sensors;

c) if the standard deviation of dark current of a sensor is greater than 3 times average, setting a flag indicating a noisy sensor.

14. The method claimed in claim 13, further comprising the step of:

a) setting the gain of a flagged sensor to zero.

15. The method claimed in claim 13, further comprising the step of:

a) producing an error signal indicating a noisy sensor in response to a flagged sensor.

16. The method claimed in claim 11, further comprising the steps of:

a) computing an average gain of all sensors; and b) if the gain of a sensor is less than one-half or greater than 2 times the average gain, setting a flag indicating a bad sensor.

17. The method claimed in claim 13, further comprising the step of:

a) producing an error signal indicating a noisy sensor in response to a flagged sensor.

18. The method claimed in claim 11, further comprising the steps of:

a) computing an average gain of all sensors; and b) if the gain of a sensor is less than one-half or greater than 2 times the average gain, setting a flag indicating a bad sensor.

19. The method claimed in claim 11, further comprising the steps of:

a) computing an equivalent saturation exposure for each sensor;

b) finding the minimum saturation exposure of all the sensors; and c) if during operation of the phototimer with a patient, the value produced by a sensor is greater than the minimum saturation exposure of all sensors, set the value to the minimum saturation exposure value.

* * * * *